US008524644B2

(12) United States Patent
Kawata et al.

(10) Patent No.: US 8,524,644 B2
(45) Date of Patent: Sep. 3, 2013

(54) COMPOSITION AND METHOD FOR FORMING COATING FILM

(75) Inventors: Ken Kawata, Minami-ashigara (JP); Saisuke Watanabe, Minami-ashigara (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 239 days.

(21) Appl. No.: 12/935,140

(22) PCT Filed: Mar. 27, 2009

(86) PCT No.: PCT/JP2009/056358

§ 371 (c)(1),
(2), (4) Date: Oct. 26, 2010

(87) PCT Pub. No.: WO2009/119831

PCT Pub. Date: Oct. 1, 2009

(65) Prior Publication Data

US 2011/0034357 A1 Feb. 10, 2011

(30) Foreign Application Priority Data

Mar. 28, 2008 (JP) ..... 2008-087957
Mar. 28, 2008 (JP) ..... 2008-087958
Mar. 28, 2008 (JP) ..... 2008-087959
Nov. 26, 2008 (JP) ..... 2008-301653

(51) Int. Cl.
*C07C 303/00* (2006.01)
*C10M 129/74* (2006.01)
*C10M 135/08* (2006.01)

(52) U.S. Cl.
USPC ..... 508/459; 508/567; 508/202; 558/44

(58) Field of Classification Search
USPC ..... 508/202, 459, 567; 558/44
See application file for complete search history.

(56) References Cited

U.S. PATENT DOCUMENTS 4,772,651 A * 9/1988 Dunski ..... 524/289
5,898,023 A 4/1999 Francisco et al.

(Continued)

FOREIGN PATENT DOCUMENTS

JP 3-169685 A 7/1991
JP 11-158482 A 6/1999

(Continued)

OTHER PUBLICATIONS

Vernon B., Tirelli, N., Bachi, T., Haldiman, D., Hubbell, J., (Journal of Biomedical Materials Research, Part A, 2003, 64A, (3), pp. 447-456.*

(Continued)

*Primary Examiner* — James Goloboy
(74) *Attorney, Agent, or Firm* — Buchanan Ingersoll & Rooney PC

(57) ABSTRACT

A composition is disclosed comprising an oily medium and at least one compound represented by the following formula (Z)

$$A\text{-}L\text{-}[D^1\text{-}(E)_q\text{-}D^2\text{-}(B)_m\text{—}Z^1\text{—}R]_p \quad (Z)$$

wherein A represents a p-valent chain or cyclic residue; L represents a single bond or a divalent linking group; p represents a carbonyl group or a sulfonyl group; $D^2$ represents a carbonyl group, a sulfonyl group, a carboxyl group, a sulfonyloxyl group, a carbamoyl group, or a sulfamoyl group; E represents a divalent group; R represents a hydrogen atom, a substituted or non-substituted $C_8$ or longer alkyl group, a perfluoroalkyl group or a trialkylsilyl group; B represents an oxyethylene group or the like; and $Z^1$ represents a single bond or a divalent group.

29 Claims, 28 Drawing Sheets

(56) References Cited

U.S. PATENT DOCUMENTS

| | | | | |
|---|---|---|---|---|
| 2006/0148897 | A1 | 7/2006 | Vernon et al. | |
| 2007/0276121 | A1 | 11/2007 | Westergom et al. | |
| 2011/0034357 | A1 | 2/2011 | Kawata et al. | |
| 2011/0104052 | A1* | 5/2011 | Barnett et al. | 424/1.21 |

FOREIGN PATENT DOCUMENTS

| | | | |
|---|---|---|---|
| JP | 2002-507657 | A | 3/2002 |
| JP | 2002-530476 | A | 9/2002 |
| JP | 2004-244593 | A | 9/2004 |
| JP | 2005-036223 | A | 2/2005 |
| JP | 2005-516110 | A | 6/2005 |
| JP | 2006-257383 | A | 9/2006 |
| JP | 2006-328127 | A | 12/2006 |
| JP | 2007-092055 | A | 4/2007 |
| WO | WO 99/49004 | A1 | 9/1999 |
| WO | WO 00/29521 | A1 | 5/2000 |
| WO | WO 2004/024237 | A2 | 3/2004 |

OTHER PUBLICATIONS

International Search Report (PCT/ISA/210) for PCT/JP2009/056358 dated Jun. 30, 2009.

B. Vernon et al., "Water-borne, in situ crosslinked biomaterials from phase-segregated precursors", Journal of Biomedical Materials Research, Part A, 2003, 64A, (3), pp. 447-456.

Notification Concerning Transmittal of International Preliminary Report on Patentability (Form PCT/IB/326) issued Oct. 7, 2010 by the International Bureau of WIPO in corresponding International Patent Application No. PCT/JP2009/056358.

Notification of Transmittal of Translation of the International Preliminary Report on Patentability (Form PCT/IB/338) issued Nov. 18, 2010 by the International Bureau of WIPO in corresponding International Patent Application No. PCT/JP2009/056358.

International Preliminary Report on Patentability (Form PCT/IB/373) and English language translation of the Written Opinion of the International Searching Authority (Form PCT/ISA/237) issued Nov. 9, 2010 by the International Bureau of WIPO in corresponding International Patent Application No. PCT/JP2009/056358.

Notification Concerning Transmittal of International Preliminary Report on Patentability (Form PCT/IB/326) issued Oct. 7, 2010 by the International Bureau of WIPO in International Patent Application No. PCT/JP2009/056367.

Notification of Transmittal of Translation of the International Preliminary Report on Patentability (Form PCT/IB/338) issued Nov. 18, 2010 by the International Bureau of WIPO in International Patent Application No. PCT/JP2009/056367.

International Preliminary Report on Patentability (Form PCT/IB/373) and English language translation of the Written Opinion of the International Searching Authority (Form PCT/ISA/237) issued Nov. 9, 2010 by the International Bureau of WIPO in International Patent Application No. PCT/JP2009/056367.

Office Action issued in corresponding Japanese Patent Application No. 2009-079940 dated Jul. 5, 2013 with English translation.

Office Action issued in corresponding Japanese Patent Application No. 2009-079652 dated Jul. 5, 2013 with English translation.

* cited by examiner

COMPOSITION AND METHOD FOR FORMING COATING FILM

TECHNICAL FIELD

The present invention relates to a novel compound having a small increase rate of viscosity by pressure and a composition containing the same and to a method for forming a coating film using the same. The composition of the invention is useful for various technical fields inclusive of technical fields of a lubricant, a mold release agent and a detergent composition and the like. In addition, the composition of the invention is useful for an enhancement in heat or oxidation stability required for lubricants to be used for internal combustion engines such as automotive engines, etc. so as to endure long-term use under a severe condition.

BACKGROUND ART

For the purposes of reducing a coefficient of friction and suppressing wear in various friction-sliding places, lubricating oils have been used in every industrial machine.

In general, current lubricating oils are constituted so as to form a fluid film in a sliding gap under a mild friction condition (fluid lubrication condition) and to form a semi-solid coating film at a frictional interface under a severe friction condition (boundary lubrication condition). That is, the current lubricating oils contain a low-viscosity oil (namely, a base oil) capable of revealing a low coefficient of friction and a chemical which for the purpose of preventing direct contact between interfaces to be caused after the low-viscosity base oil has been broken under a sever friction condition, is able to react with an interface thereof (for example, an iron interface) to form a tough and soft boundary lubricating film capable of imparting a low coefficient of friction. Though the chemical is dissolved in the base oil, it is accumulated with time at an interface thereof due to the reaction with an interface raw material (in general, steel). However, at the same time, the chemical also reacts with the majority of the face which is not directly related to sliding, and accumulation occurs, whereby the valuable chemical is consumed. In addition, even when the chemical is consumed, the base oil does not vanish but actually remains as various decomposition products; and in many cases, such accelerates deterioration of the lubricating oil per se. Moreover, the boundary lubricating film per se formed by the reaction of the chemical is also peeled off by friction-sliding under a severe condition, and the boundary substrate per se is also peeled off; and they are floated or deposited (sludged) together with the foregoing reaction decomposition products, thereby impairing lubricating ability of the lubricating oil and causing a factor in deteriorating its expected performance. In order to prevent this matter, in general, an antioxidant, a dispersant, a cleaning agent and the like are added to a lubricant (Patent Document 1).

In the light of the above, in the majority of current lubricating oils, for the purpose of reducing the friction under an extremely severe condition (boundary lubrication condition) and also the purposes of reducing and inhibiting side effects of the added chemical, a new chemical is further added. Moreover, for the purpose of reducing a lowering of the lubricating function to be caused due to fine worn powders formed from the interface per se by the wear and decomposition floats of the chemical, a new chemical is further added. And since functions of various chemicals are related to each other in the lubricating oil, it is inevitable and unavoidable that a period of time when the lubricating oil can function as a whole and exhibit the best lubricating effect becomes short due to exhaustion and deterioration of the respective chemicals. It may be said that this is a vicious cycle of a certain kind. In consequence, it is not easy to greatly improve the composition for the purpose of improving performances of current lubricating oils.

However, all of the foregoing compounds called "chemical" are ones containing an element reactive with the iron interface, and furthermore, substances formed through a reaction between such a compound and iron have ability to reduce friction and wear thereof. The element which is essential for the lubrication is phosphorus, sulfur or a halogen and furthermore, is zinc or molybdenum working competitively and complementarily. The former three are distinctly an environmentally hazardous element, and release thereof into the air even as an exhaust gas must be utterly avoided.

In addition, lubricating oils to be used for internal combustion engines, automatic transmissions and the like are required to be made low in viscosity for the purpose of achieving fuel saving, and at the same time, from the viewpoints of effective utilization of resources in recent years, reduction of waste oil, cost reduction of lubricating oil user and the like, a requirement for realization of long drain of a lubricating oil is increasing more and more. In particular, following high performances of internal combustion engines, high outputs, severe driving conditions and the like, lubricating oils for internal combustion engine (engine oils) are being required to have higher performances.

However, in conventional lubricating oils for internal combustion engine, in order to ensure heat or oxidation stability, it is generally conducted to use a highly refined base oil such as hydrocracked mineral oils, etc., or a high-performance base oil such as synthetic oils, etc. and blend the base oil with a sulfur-containing compound having peroxide decomposing ability such as zinc dithiophosphate (ZDTP), molybdenum dithiocarbamate (MoDTC), etc., or an ashless antioxidant such as such as phenol based or amine based antioxidants, etc. However, it may not be said that the heat or oxidation stability by itself is always sufficient. Moreover, though it is possible to improve the heat or oxidation stability to some extent by increasing the blending amount of the antioxidant, there is naturally a limit in an effect for enhancing the heat or oxidation stability according to this technique.

And from the viewpoint of an environmental issue such as a reduction of emission of carbon dioxide, etc., the engine oils are required to be reduced in the content of sulfur or phosphorus for the purposes of enhancing fuel-saving performance and durability and keeping catalytic ability for cleaning an exhaust gas. On the other hand, in diesel engines in recent years, though an emission control mechanism of particulate matter, such as a diesel particulate filter (DPF), etc., is started to be installed, diesel engine oils are required to realize a low ash from the standpoint of an issue of plugging of the mechanism. The realization of a low ash of engine oils means a reduction of a metallic cleaning agent, and it is an extremely important problem to ensure diesel engine cleaning properties to be kept by blending a large amount of a metallic cleaning agent or an ashless dispersant, in particular, cleaning properties of a top ring groove with a high heat load.

When an internal combustion engine is taken as an example, the foregoing lubrication is concerned with lubrication of portions other than a combustion chamber and a lubricating composition. However, as for the lubrication of the combustion chamber, there is actually a big problem, too. That is, studies for controlling (preventing or decreasing) a reduction of deposits formed in a fuel introducing port of the combustion chamber, or a reduction of friction and wear to be caused thereby, by trace additives to be added to the fuel have been continued over a period of many years.

In particular, in recent years, from the viewpoint of exhaust gas regulation, it has been becoming essential to realize a low sulfur concentration of a fuel composition. However, there is a concern that according to this, the lubricating properties are lowered, thereby causing a lowering of durability of a valve gear mechanism including cams and valves. Here, it is also driven by necessity to review the conventional element contributing to a reduction of friction and wear.

That is, in order to exhibit efficacy by small amount addition, reactivity with an interface raw material is an essential requirement, and nevertheless an element capable of revealing desired low friction by forming a boundary lubricating film is essential, at the same time, it is required to reduce sulfur, phosphorus and heavy metals, the presence per se of which is problematic. The lubricating oils are a material supporting the current industrial machines themselves, and even if they are not easily displaced, this is the moment at which a composition of lubricating oil and a lubrication mechanism per se as a background thereof must be seriously reviewed by the latest scientific technologies and functional raw material technologies after a lapse of 150 years or more.

At the beginning, while it has been described that "For the purposes of reducing a coefficient of friction and suppressing wear in various friction-sliding places, lubricating oils have been used in every industrial machine", a mission of the lubricating oil itself is to keep and preserve a motor function of machine. Though we make a machine work and utilize it, when the work (action) is taken out (counteraction), friction is inevitably caused at a mutually sliding interface. In order to reduce vigorous wear generated by the friction and prevent a mechanical damage such as seizure, etc. from occurring, it is necessary to ensure a sliding gap, and for that reason, various solid or liquid lubricating films have been applied.

A theoretical analysis of the behavior of such a liquid film in the friction state starts from the matter that the Navier-Stokes equations describing the motion of a viscous fluid in the hydrodynamics were applied to a gap with a narrow Reynolds. In those days, an experimentally verified phenomenon in which a wedge-shaped oil film in a bearing generates a high hydrodynamic pressure was theoretically explained, thereby laying the foundation of the fluid lubrication theory of the day.

According to this theory, in view of the fact that the Sommerfeld number which is utilized as a basic characteristic number of the bearing design is expressed by the following equation, it is noted that a film thickness d of a sliding gap is related to a pressure P, a viscosity Θ (→also correlated with a temperature T) and a sliding velocity V. Since the film thickness d itself of the sliding gap accurately depends upon an average roughness Ra of the surface thereof, it may be said that factors relating to breakage of the film thickness d of the sliding gap are the pressure P, the temperature T, the viscosity η, the average roughness Ra of the surface and the sliding velocity V.

$$\text{Sommerfeld number } S=[\eta(T)*R(\text{bearing radius})*V(\text{velocity})]/[2\pi P(\text{pressure})*d^2(\text{gap})]$$

From the viewpoint of keeping the oil film, as for the factors influencing the gap d, it may be easily analogized that at a high temperature, factors of a reduction of the viscosity of the oil film and an interface roughness are important and that under a high pressure, the pressure and the pressure dependency of the oil film viscosity are naturally important.

In consequence, the history of a technology for keeping a liquid film started from control of the viscosity of a base oil. First of all, in order to prevent breakage, an oil with relatively high viscosity, namely a highly viscous oil is used. However, a machine must start up, and at that time, a high viscosity is disadvantageous. Furthermore, in general, at the start-up time, the temperature is lower than that at the operation time, in most cases, the oil hardly moves because of its extremely high viscosity; and therefore, in a sense of utterly avoiding breakage at the high-temperature time, a high viscosity index oil which is originally low in viscosity was used, and furthermore, a polymer (viscosity index improver) was added to a low-viscosity base oil.

The technology developed in response to severer conditions at a high temperature and under a high pressure is a technology concerning an interface protective film (boundary lubricating film) capable of firmly adhering directly to an interface, in particular an iron interface and having flexibility. Historically, starting from the addition of a soap, inorganic films such as iron chloride, iron sulfide, iron phosphate, etc. were formed; and in recent years, reactive and low-friction organometallic complexes such as Mo-DTC, Zn-DTP, etc. have been developed, and a trace amount thereof is added to a base oil.

Though there were an improvement of viscosity physical properties against the temperature as described previously and a technical development of forming a lubricating film by another method, a technical and simple approach as in the invention, in which a viscosity-pressure modulus is controlled and optimized for the purpose of inhibiting breakage of an oil film while controlling the viscosity against the pressure has not been revealed yet.

However, the theory concerning the viscosity-pressure modulus has been surely established with the times.

As for the friction mechanism, there is known an elastic fluid lubrication mechanism between the foregoing mild fluid lubrication mechanism and severe boundary lubrication mechanism. A theoretical study of this elastic fluid lubrication mechanism started from the study regarding the true contact face shape and the generated pressure, published by Hertz in 1882; established by a summary of the EHL elastic fluid lubrication theory by Petrosevich in 1951; and became a practical theory by an oil film formation theory taking into consideration of elastic deformation by Dowson/Higginson in 1968.

A region where this elastic fluid lubrication mechanism works is a friction region under a high pressure of, for example, several tons per $cm^2$, namely about several hundred MPa. At a glance, though such a condition is severe, in fact, since iron starts to cause elastic deformation within such a pressure range, the area of the true contact face of the iron interface coming into contact with the oil film increases, and the substantial pressure becomes low. That is, within this region, so far as an elastic limit of iron or oil film breakage is not caused, the coefficient of friction does not increases, and it may be said that such a region is a "blessed region" for the sliding interface. Moreover, at the same time, in this region, an oil film made of a general lubricating oil such as mineral oils becomes high in viscosity by about 1,000 times that at the time of atmospheric pressure, but there may be the case where it becomes low in viscosity by only about 500 times depending upon a chemical structure of the raw material. Barus expressed this phenomenon relative to pressure dependency of the viscosity of liquid in terms of the following equation (VII) and exhibited that an increase rate α of viscosity which is inherent in the substance to pressure is related (Non-Patent Document 1).

$$\eta=\eta_0\exp(\alpha P) \quad \text{(VII)}$$

Here, $\alpha$ represents a viscosity-pressure modulus; and $\eta_0$ represents a viscosity at atmospheric pressure.

Moreover, Doolittle advocated a thought of a free volume model that a viscosity of liquid is determined by a ratio of an occupied volume of molecule occupied in a liquid volume and a free volume generated by thermal expansion (Non-Patent Document 2).

$$\eta = A\exp(BV_0/V_f) \quad \text{(VIII)}$$

Here, $\eta$ represents a viscosity; $V_0$ represents an occupied volume of molecule; and $V_f$ represents a free volume.

In comparison between the equation (VIII) of Doolittle and the equation (VII) of Barus, it is noted that the viscosity-pressure modulus $\alpha$ is in inverse proportion to the free volume of molecule. That is, what the viscosity-pressure modulus is small suggests that the free volume of molecule is large. In consequence, it is noted that it is possible to control the pressure dependency of the viscosity of liquid by optimizing a chemical structure of raw material, namely, it is possible to provide a raw material having a lower viscosity than oils constituting current lubricating oils under the same high-load and high-pressure conditions by optimizing the chemical structure. For example, assuming that an oil film of a true contact part is formed by a raw material having a viscosity-pressure modulus $\alpha$ of about a half of that of mineral oils or hydrocarbon based chemical synthetic oils such as poly-$\alpha$-olefins, which are usually used as a lubricating oil, this elastic fluid lubrication region is laid under a milder condition. That is, in usual lubricating oils, even under a high load which is classified into the boundary lubrication region, in view of the fact that a cooling effect by an oil film as well as low pressure and low viscosity of the true contact site is added due to the elastic deformation of the interface and the low-viscosity oil film under a high pressure, it is expected to substantially avoid the boundary lubrication region and realize an ideal lubrication mechanism made of only fluid lubrication.

In recent years, it is disclosed that discotic compounds having a plurality of radially arranged relatively long carbon chains and lubricating oils containing the same (namely, a metallic raw material-free lubricating oil) exhibit a low coefficient of friction in the elastic fluid lubrication region (for example, Patent Documents 2 to 4). Such a discotic compound has a discotic core and side chains radially extending from the discotic core, and it is expected that a sector-shaped free volume can be inevitably ensured in a highly arranged state, too. In consequence, discotic or tabular compounds having radially arranged side chains have many free volumes in common as compared with an occupied volume thereof, and therefore, they exhibit a small viscosity-pressure modulus. That is, it is expected that the viscosity is relatively small even under a high pressure, and lower viscosity and lower friction properties are revealed under a high pressure (Non-Patent Document 3).

However, what is common among these raw materials is the matter that the viscosity thereof is larger by one digit than that of mineral oils and chemical synthetic oils usually used for lubricating oils, and it is absolutely impossible to use a large amount of such a raw material inexpensively in place of low-viscosity base oils.

That is, though the viscosity under a high pressure is defined by the viscosity $\eta_0$ and the viscosity-pressure modulus $\alpha$ as expressed by the foregoing equation (VII), when a low-viscosity base oil is actually used, it already starts to be broken in an elastic fluid lubrication region, and it becomes in a viscosity-free state, namely an elasto-plastic body under a high pressure. It has been elucidated that easiness of breakage of this lubricating oil film is correlated with an agglomerated state of fluid molecules, namely a packing state of lubricating oil molecules and can be evaluated by a product $\alpha P$ of the viscosity-pressure modulus $\alpha$ and the pressure P (Non-patent Document 4).

In general, the lubricating oil film acts as a viscous fluid when the product $\alpha P$ is not more than 13, as a visco-elastic fluid when the product $\alpha P$ is between 13 and 25 and as an elasto-plastic body when the product $\alpha P$ is 25 or more, respectively. In the case where two kinds of lubricating oil films having the same viscosity $\eta$ under a certain pressure P, where a viscosity-pressure modulus is defined as $\alpha_1$ and $\alpha_2$, respectively, and also a normal pressure viscosity is defined as $\eta_1$ and $\eta_2$, respectively, the following equation is established.

$$\ln \eta = \ln \eta_1 + \alpha_1 \cdot P = \ln \eta_2 + \alpha_2 \cdot P$$

In the case of $18 = \alpha_1 \cdot P < \alpha_2 \cdot P = 24$, namely $\alpha_1/\alpha_2 = 18/24$, it is noted that when the pressure P is increased a little more, the film having a viscosity-pressure modulus $\alpha_2$ becomes an elasto-plastic body and is more easily broken even under the same pressure at the same viscosity.

In consequence, even when a base oil having a relatively large $\eta_0$ to such extent that it can be used even in a fluid lubrication region is utilized, since the viscosity-pressure modulus $\alpha$ of an chain hydrocarbon such as mineral oils constituting a base oil is large, there is eventually a tendency that the viscosity $\eta$ under a high pressure becomes large, and it has been considered that neither base oil having a visco-elastic fluid region nor organic compound, each of which has a low $\eta_0$ capable of imparting a low coefficient of friction under fluid lubrication and a low $\alpha$ capable of imparting a low coefficient of friction under elastic fluid lubrication at the same time, is present so far.

For the time being, even if a raw material capable of clearing the foregoing restrictions could be developed, taking into consideration necessary conditions of base oils requiring large-amount feed and low costs, it is difficult to provide a raw material satisfying all of them. Therefore, as for engine oils which are essential to be low in viscosity for the purpose of achieving low fuel consumption, it may be considered that there is a background wherein a concept itself for effectively utilizing elastic fluid lubrication was not recognized. It may be said that convergence of the raw material development to a combination of a current low-viscosity based oil and a trace chemical capable of forming a boundary lubricating film as described at the beginning was an inevitable result.

[Patent Document 1] JP-T-2005-516110
[Patent Document 2] JP-A-2006-328127
[Patent Document 3] JP-A-2007-92055
[Patent Document 4] JP-A-2006-257383
[Non-Patent Document 1] C. Barus, *Am. J. Sci.,* 45 (1893), page 87
[Non-Patent Document 2] A. K. Doolittle, *J. Appl. Phys.,* 22 (1951), 1471
[Non-Patent Document 3] Masanori HAMAGUCHI, Nobuyoshi OHNO, Kenji TATEISHI and Ken KAWATA, *Preprint of the International Tribology Conference* (Tokyo, 2005-11), page 175
[Non-Patent Document 4] Nobuyoshi OHNO, Noriyuki KUWANO and Fujio HIRANO, *Junkatsu* (Lubrication), 33, 12 (1988), 922; 929

DISCLOSURE OF THE INVENTION

Problems to be Resolved by the Invention

In response to such "unavoidable problems" of use of an environmentally hazardous element which is reactive with iron because it is concentrated in the vicinity of the iron surface and capable of realizing good lubricating properties, the invention provides a new lubricating composition capable of:

(i) concentrating a non-reactive material on not only iron but every hard interface and a friction-sliding surface; and (ii) making the non-reactive material function as a fluid film having lower viscosity than current raw materials under a high pressure.

Thus, it is expected that current lubricating oils are greatly improved with respect to performances such as environmental harmony, high durability due to non-reactivity/non-decomposability, low friction (constant) properties by a fluid (hence, wear resistance), cooling effect due to flowing of a fluid, etc., by largely changing a composition.

That is, one object of the invention is to provide a novel composition which is useful in various fields inclusive of technical fields of a lubricant, etc.

Means of Solving the Problems

The means for achieving the objects are as follows.

[1] A composition comprising an oily medium and at least one compound represented by following formula (Z):

$$A\text{-}L\text{-}\{D^1\text{-}(E)_q\text{-}D^2\text{-}(B)_m\text{—}Z^1\text{—}R\}_p \quad (Z)$$

wherein

A represents a p-valent chain or cyclic residue;

L represents a single bond, an oxy group, a substituted or non-substituted oxymethylene group represented by following formula (A-a), or a substituted or nonsubstituted oxyethyleneoxy group represented by following formula (A-b):

$$\text{—(O—C(Alk)}_2\text{)-} \quad (A\text{-}a)$$

$$\text{—(O—C(Alk)}_2\text{C(Alk)}_2\text{O)—} \quad (A\text{-}b)$$

Alk represents a hydrogen atom, a $C_1$-$C_6$ alkyl group or a cycloalkyl group;

p represents an integer of 2 or more;

$D^1$ represents a carbonyl group (—C(═O)—) or a sulfonyl group (—S(═O)$_2$—), and each $D^1$ may be the same as or different from every other $D^1$;

$D^2$ represents a carbonyl group (—C(═O)—), a sulfonyl group (—S(═O)$_2$—), a carboxyl group (—C(═O)O—), a sulfonyloxyl group (—S(═O)$_2$O—), a carbamoyl group (—C(═O)N(Alk)-) or a sulfamoyl group (—S(═O)$_2$N(Alk)-), and each $D^2$ may be the same as or different from every other $D^2$, wherein Alk represents a hydrogen atom, a $C_1$-$C_6$ alkyl group or a cycloalkyl group;

E represents a substituted or nonsubstituted alkylene group, cycloalkylene group, alkenylene group, alkynylene group or arylene group, a divalent heterocyclic aromatic ring group or heterocyclic non-aromatic ring group, a divalent group selected among an imino group, an alkylimino group, an oxy group, a sulfide group, a sulfenyl group, a sulfonyl group, a phosphoryl group and an alkyl-substituted silyl group, or a divalent group composed of a combination of two or more of these groups; q represents an integer of 0 or more; and when q is 2 or more, each E may be the same as or different from every other E;

R represents a hydrogen atom, a substituted or non-substituted $C_8$ or longer alkyl group, a perfluoroalkyl group or a trialkylsilyl group, and each R may be the same as or different from every other R;

B varies depending upon R;

in the case where R represents a hydrogen atom or a substituted or non-substituted $C_8$ or longer alkyl group, B represents a substituted or non-substituted oxyethylene group or a substituted or non-substituted oxypropylene group; plural Bs connecting to each other may be the same as or different from each other; and m represents a natural number of 1 or more;

in the case where R represents a perfluoroalkyl group, B represents an oxyperfluoromethylene group, an oxyperfluoroethylene group or an optionally branched oxyperfluoropropylene group; plural Bs connecting to each other may be the same as or different from each other; and m represents a natural number of 1 or more;

in the case where R represents a trialkylsilyl group, B represents a dialkylsiloxy group in which the alkyl group is selected among a methyl group, an ethyl group and an optionally branched propyl group; each B may be the same as or different from every other B; plural Bs connecting to each other may be the same as or different from each other; and m represents a natural number of 1 or more; and $Z^1$ represents a single bond, a divalent group selected among a carbonyl group, a sulfonyl group, a phosphoryl group, an oxy group, a substituted or non-substituted amino group, a sulfide group, an alkenylene group, an alkynylene group and an arylene group or a divalent group composed of a combination of two or more of these groups.

[2] The composition according to [1], wherein in the formula (Z), A is a residue of pentaerythritol, glycerol, oligopentaerythritol, xylitol, sorbitol, inositol, trimethylolpropane, ditrimethylpropane, neopentyl glycol or polyglycerin.

[3] The composition according to [1], wherein in formula (Z), A is a group represented by any of following formulae (AI) to (AIII):

(AI)

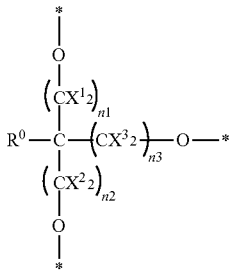

(AII)

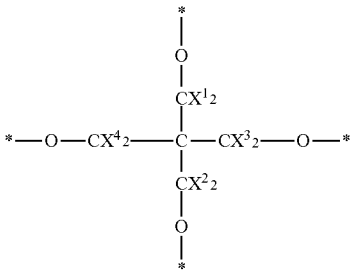

-continued (AIII)

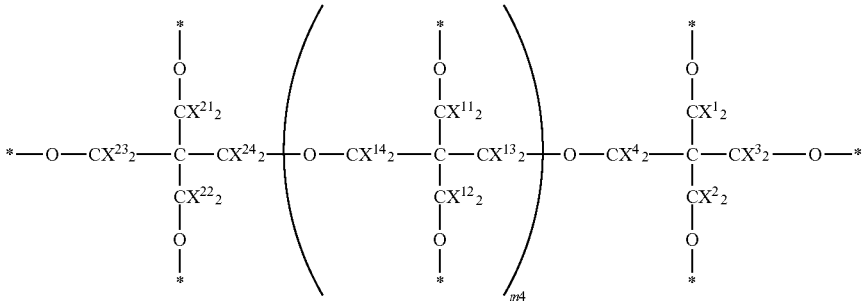

wherein

* means a bonding site to -L-$D^1$-$(E)_q$-$D^2$-$(B)_m$—$Z^1$—R; C represents a carbon atom; $R^0$ represents a hydrogen atom or a substituent; each of $X^1$ to $X^4$, $X^{11}$ to $X^{14}$ and $X^{21}$ to $X^{24}$ represents a hydrogen atom or a halogen atom and may be the same as or different from every other; each of n1 to n3 represents an integer of from 0 to 5; and m4 represents an integer of from 0 to 2.

[4] The composition according to [1], wherein in formula (Z), A is a residue of a polymer or an oligomer represented by any of following (AIV) to (AVIII):

(AIV)

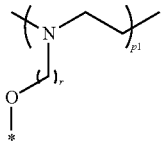

(AV)

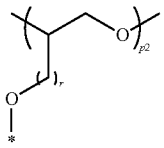

(AVI)

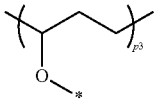

(AVII)

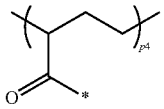

(AVIII)

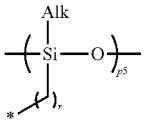

wherein

* means a bonding site to -L-$D^1$-$(E)_q$-$D^2$-$(B)_m$—$Z^1$—R; each of hydrogen atoms bonded to the respective carbon atoms in the formulae may be substituted with a $C_1$-$C_4$ alkyl group or a halogen atoms; in the case where two or more substituents are present, each of them may be the same as or different from every other; Alk represents a hydrogen atom, a $C_1$-$C_6$ alkyl group or a cycloalkyl group; each of p1 to p5 represents a number of 2 or more; and r represents an integer of from 1 to 3.

[5] The composition according to [1], wherein in formula (Z), A is a residue of dithiocarbamic acid or dithiophosphoric acid ionically bonded or coordinate bonded to zinc or molybdenum.

[6] The composition according to [1], containing at least one compound represented by following formula (Y) together with the at least one compound represented by formula (Z):

$$R—Z^1—(B)_m\text{-}D^1\text{-}(E)_q\text{-}D^2\text{-}(B)_m—Z^1—R \quad (Y)$$

wherein the symbols are synonymous with those in the formula (Z) according to [1], respectively.

[7] The composition according to any one of [1]-[6], wherein in the formula (Z) or formula (Y), each —$(B)_m$—$Z^1$—R is a group represented by following formula (ECa), and each —$(B)_m$—$Z^1$—R may be the same as or different from every other —$(B)_m$—$Z^1$—R:

$$-\!\!\left(\!(CX^{a1}X^{a2})_{na1}O\!\right)\!\!_{na2}-L^a-R^a \quad (ECa)$$

wherein in the formula (ECa), C represents a carbon atom; O represents an oxygen atom; $R^a$ corresponding to R in the formula (Z) represents a substituted or non-substituted $C_8$ or longer alkyl group; $L^a$ corresponding to $Z^1$ in the formula (Z) represents a single bond or a divalent connecting group; each of $X^{a1}$ and $X^{a2}$ represents a hydrogen atom or a halogen atom; na1 represents an integer of from 1 to 4; when na1 is 2 or more, plural $X^{a1}$s and $X^{a2}$s may be the same as or different from each other; and na2 represents a number of from 1 to 35.

[8] The composition according to [7], wherein in formula (Z) or formula (Y), $L^a$ corresponding to $Z^1$ is a single bond or a divalent connecting group composed of a combination of one or more members selected among a carbonyl group, a sulfonyl group, a phosphoryl group, an oxy group, a substituted or non-substituted amino group, a thio group, an alkylene group, an alkenylene group, an alkynylene group and an arylene group.

[9] The composition according to any one of [1]-[6], wherein in formula (Z) or formula (Y), each —$(B)_m$—$Z^1$—R is a group represented by following formula (ECb), and each —$(B)_m$—$Z^1$—R may be the same as or different from every other —$(B)_m$—$Z^1$—R:

$$-\left(\left(CX^{a1}X^{a2}\right)_{na1}O\right)_{na2}\left(C_nF_{2n}O\right)_{nc}-L^{a1}-C_mF_{2m+1} \quad \text{(ECb)}$$

wherein in the formula (ECb), the same symbols as those in the formula (ECa) according to [7] are synonymous, respectively; $L^{a1}$ corresponding to $Z^1$ in the formula (Z) represents a single bond; na2 represents a number of from 0 to 2; nc represents a number of from 1 to 10; m represents a number of from 1 to 12; and n represents a number of from 1 to 3.

[10] The composition according to any one of [1]-[6], wherein in formula (Z) or formula (Y), each $-(B)_m-Z^1-R$ is a group represented by following formula (ECc), and each $-(B)_m-Z^1-R$ may be the same as or different from every other $-(B)_m-Z^1-R$:

$$-\left(Si(Alk')_2O\right)_{nb}L^{a1}-Si(Alk')_3 \quad \text{(ECc)}$$

wherein in formula (ECc), the same symbols as those in formula (ECa) according to [7] are synonymous, respectively; each Alk' may be the same as or different from every other Alk' and represents a $C_1$-$C_4$ alkyl group; $L^{a1}$ corresponding to $Z^1$ in the formula (Z) represents a single bond; and nb represents a number of from 1 to 10.

[11] The composition according to any one of [1]-[6], wherein in formula (Z) or formula (Y), R is a group including a linear $C_{12}$ or longer alkyl group.

[12] The composition according to any one of [1]-[6], wherein in the formula (Z) or formula (Y), m of $(B)_m$ is from 7 to 12.

[13] The composition according to any one of [1]-[12], wherein the compound represented by the formula (Z) has a viscosity-pressure modulus at 40° C. of not more than 15 $GPa^{-1}$.

[14] The composition according to any one of [1]-[13], wherein the oily medium is a mineral oil, a poly-α-olefin, a polyol ester, (poly)phenyl ether, an ion fluid, a silicone oil or a fluorocarbon oil, or a mixture of two or more kinds selected among these materials.

[15] The composition according to [1], wherein each of constituent elements of all of the components is only one or more members selected among carbon, hydrogen, oxygen and nitrogen.

[16] The composition according to any one of [1]-[15], wherein the compound represented by formula (Z) or formula (Y) is a liquid crystalline compound.

[17] The composition according to any one of [1]-[16], having a viscosity at 40° C. of not more than 30 mPa·s.

[18] The composition according to any one of [1]-[17], wherein the compound represented by formula (Z) is a compound satisfying the following conditions (A) and (B):

(A) an average value of particle sizes of the compound dispersed in an oily medium at room temperature and measured by a dynamic light scattering method is not more than 1 μm, the compound is dispersed in a state close to a monodispersed state, and its clearing point is not higher than 55° C.; and (B) a melting point is not higher than 70° C.

[19] The composition according to any one of [1]-[18], wherein the compound represented by the formula (Z) is at least dispersed in the oily medium and satisfies the following condition (C):

(C) when passing through a gap between a steel ball having a diameter of 2 cm and a diamond plate and under a pressure of 100 MPa at a rate of 0.1 m/sec or more, a maximum optical density of an infrared absorption in a portion of 160 microns in square far from a center of a formed Newtonian ring by 300 μm is increased by 0.05 or more.

[20] The composition according to any one of [1]-[19], wherein the oily medium is an oily medium composed of at least one member selected among a mineral oil, a poly-α-olefin, a synthetic ester oil, a diphenyl ether oil, a fluorocarbon oil and a silicone oil.

[21] The composition according to any one of [1]-[14] and [1,6]-[20], further containing at least one member selected among an organic zinc compound, a molybdenum compound, an organic phosphorus compound and an organic sulfur compound.

[22] The composition according to any one of [1] to [21], which is used for lubrication of a sliding interface of inorganic materials or porous materials thereof, or resins or porous materials thereof.

[23] The composition according to any one of [1] to [22], which is a mold release agent.

[24] The composition according to any one of [1] to [22], wherein the oily medium is a fuel for combustion engine.

[25] The composition according to any one of [1] to [22], wherein the oily medium is an engine oil for internal combustion engine.

[26] The composition according to any one of [1]-[22], which is a bearing oil.

[27] The composition according to any one of [1]-[22], which is a grease oil.

[28] The composition according to any one of [1]-[22], which is a cutting oil.

[29] A method for forming a coating film comprising disposing the composition according to any one of [1]-[28] between two surfaces, and sliding the two surfaces, thereby forming a coating film composed of the composition on at least one of the surfaces.

Effect of the Invention

According to the invention, it is possible to provide a novel composition which is useful in various fields inclusive of technical fields of a lubricant, etc.

The composition of the invention exhibits a small friction coefficient under the temperature and the pressure falling within the wide range, and therefore, it is useful in various technical fields such as a lubricant technical field relating to friction or slide.

MODE FOR CARRYING OUT THE INVENTION

The invention is described in detail hereinunder. Note that, in this description, any numerical expressions in a style of "... to ..." will be used to indicate a range including the lower and upper limits represented by the numerals given before and after "to", respectively.

1. Compound Represented by Formula (Z)

One feature of the composition of the invention resides in comprising at least one compound represented by following formula (Z).

$$A\text{-}L\text{-}\{D^1\text{-}(E)_q\text{-}D^2\text{-}(B)_m-Z^1-R\}_p \quad \text{(Z)}$$

In the formula, A represents a p-valent chain or cyclic residue.

A preferred example of A is a residue containing a branched structure in which atoms within the third (γ-position) from the atom (α-position) in A bonding to -L are secondary or more. The compound represented by the formula (Z) containing such A belongs to a compound group expressed as a so-called "starburst shape" or "star shape", and an embodiment of the composition of the invention containing the subject compound exhibits preferred natures as a lubricant composition.

The compound "having a small increase rate of viscosity by pressure" as described previously is useful in a technical field of lubricant, and it is also described previously that Non-Patent Document 2 discloses that such a nature can be achieved by a compound "having a large free volume as far as possible". An example of the compound "having a large free volume as far as possible" is a compound in which the free volume of plural side chains present in the molecule is large.

When a triphenylene compound is taken as an example for the compound having a discotic structure, for example, in a triphenylene having long-chain alkoxy groups at 2-, 3-, 6-, 7-, 10- and 11-positions, side chains composed of such a long-chain alkoxy group naturally extend radially, and the farther the side chain is from the center starting from the oxygen atom in the alkoxy group, the larger the volume of a space where the side chain can freely move (free volume) is. Even when the subject compound is accumulated in a high density, or it takes a hexagonal closest packing structure of a columnar structure such as a liquid crystal phase or a crystal, a minimal space where the side chain can take a certain movement. This is a significant difference between a discotic molecule and a string-like molecule. When the string-like molecule is uniaxially oriented, the free volume is lost.

Next, a molecule having a structure in which side chains extend equally in four directions against the space centering an SP3 element in exactly a "starburst shape" or "star shape" as in methane, tetramethylsilane, trimethylamine, etc. is considered. In such a molecule, it may be considered that similar to the molecule having a discotic structure, it is theoretically possible to similarly ensure its free volume; however, the actual situation is considerably different. In the discotic molecule as described previously, a discotic nucleus itself ensures a space where a side chain can freely move until a distance of a certain degree from its center, from the first due to an incorruptible nucleus structure thereof, whereas in the "starburst-shaped" or "star-shaped" molecule, a structure in which carbon chains are extended centering the SP3 element directly from this element is taken; and therefore, there is a significant difference therebetween.

For example, in comparison between the position of oxygen of a hexaalkoxytriphenylene as the foregoing discotic compound and the position of oxygen of triethoxylate of trimethylolmethane as the "starburst-shaped" or star-shaped" compound, as schematically below, when approximated in terms of a length of the chain of SP3 carbon, the position of oxygen is corresponding to the position of carbon from approximately the fourth from SP3 carbon of the central nucleus, namely carbon of the epoxy group terminal. At a glance, the latter has a higher degree of freedom; however, when the density increases, and the molecules start to agglomerate, other side chain also comes into a space in the vicinity of each of the side chains, the respective side chains are bent, or the side chains become approximately in a rod-like shape in such a manner of closing an umbrella, thereby possibly reducing the free volume. It may be easily supposed that when the density is actually increased, the state of the side chains will change in such a way.

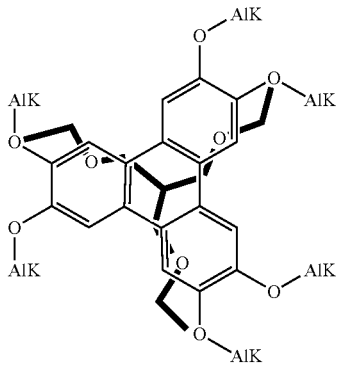

Even in molecules having a nucleus of a non-discotic structure, such as such an SP3 element-containing nucleus, etc., for the purpose of enabling a side chain thereof to ensure a large space volume similar to a side chain of a discotic molecule, the present inventor made extensive and intensive investigations on what structure of the side chain is suitable. As a result, the invention has been accomplished on the basis of the resulting knowledge.

Though the following acetoxytrimethylolmethane is one obtained by converting the triethoxylate of trimethylolmethane into an ester, this structure is a basic structure of fat and oil in the world of lubrication. The fat and oil as referred to herein is a polyol ester of a fatty acid and has a structure in which a lower viscosity-pressure modulus, namely a lower coefficient of friction under a high pressure than that of a mineral oil can be easily revealed.

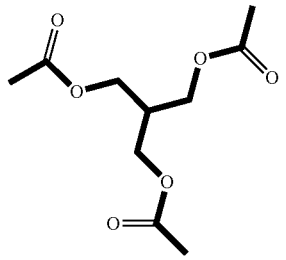

It may be presumed that reasons for this reside in the facts that the rotational barrier energy of C—O in the ester is smaller than that of C—C; and that since electron repulsion and steric repulsion between carbonyl groups are easy to open radially, the free volume can be largely ensured. Certainly, an ester of a polyol tends to be low in friction as compared with an ester of a polycarboxylic acid. It may be considered that this is related to the size of the free volume influencing the whole of side chains of the rotation of C—O.

But, current ester oils are low in friction as compared with mineral oils, a degree of which is, however, not conspicuous so much. Then, the present inventor has made extensive and intensive investigations regarding a lubricating effect of a compound having a carbonyl group in the tip of a further extended side chain and found that the following compound obtained by linking a residue corresponding to succinic acid to trimethylolmethane exhibits a conspicuous friction reducing effect.

This result is revealed in not only a 1,4-dicarbonyl group as in succinic acid but a 1,3-dicarbonyl group, a 1,5-dicarbonyl group interposing oxygen in a center thereof, etc. Moreover, a polyol ester of acylated sarcosinic acid also reveals the same friction reducing effect.

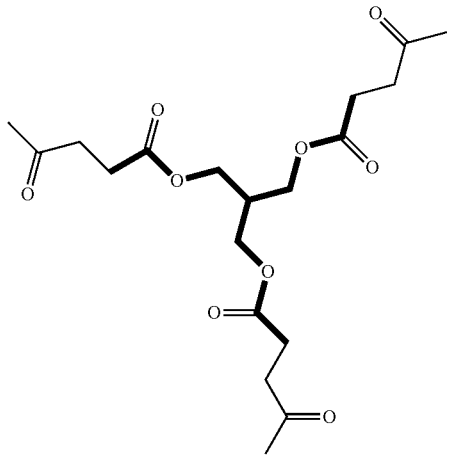

In consequence, the invention is concerned with a compound having a chain or cyclic chemical structure capable of radially arranging side chains and having radially extending side chains linked thereto, and it utilizes a compound capable of ensuring a larger free volume. In order that the side chains may ensure a large free volume, it is preferable to have a chemical structure designed such that the side chains are easy to freely rotate in the vicinity of a bonding site to a central nucleus and that the side chains cause repulsion each other. In this specification, the compound having the thus designed side chains is collectively expressed as a "starburst-shaped" or "star-shaped" compound.

While the compound having a central nucleus containing an SP3 carbon element and containing a branched structure formed thereby has been described, the structure of the central nucleus is not particularly limited so far as the side chains are able to ensure a large free volume. As a matter of course, the structure may be a cyclic structure. Moreover, in a compound obtained by connecting a side chain having a prescribed structure ($-D^1-(E)_q-D^2-(B)_m—Z^1—R$) which the compound represented by the foregoing formula (Z) has, to a central nucleus containing an element capable of becoming trivalent or polyvalent, such as nitrogen, silicon, boron, phosphorus, etc. and containing a branched structure formed thereby, the side chain is also able to ensure a large free volume and exhibits the same effect, and it can be utilized in the invention.

Moreover, the compound which is utilized in the invention may be either a polymer or an oligomer. More specifically, in a polymer or oligomer obtained by connecting the side chain having a prescribed structure ($-D^1-(E)_q-D^2-(B)_m—Z^1—R$) to a side chain of one or two or more kinds of repeating units constituting a principal chain thereof, the side chain is also able to ensure a large free volume and exhibits the same effect, and it can be utilized in the invention. The principal chain of the polymer or oligomer may be, for example, a simple structure as in a polyvinyl alcohol chain. Specifically, a polymer or oligomer obtained by substituting an acetyl group of polyvinyl acetate with the side chain having a prescribed structure ($-D^1-(E)_q-D^2-(B)_m—Z^1—R$) which the compound represented by the foregoing formula (Z) has can be utilized in the invention.

Among examples of the central nucleus structure bonding the foregoing side chain thereto, those of hydrocarbon chains include pentaerythritol, oligo-pentaerythritols inclusive of di-, tri- or tetraerythritol, groups obtained by connecting one hydroxyl group of pentaerythritol to other divalent group (for example, a substituted or non-substituted alkylene group, cycloalkylene group, alkenylene group, alkynylene group or arylene group, a divalent heterocyclic aromatic ring group or heterocyclic non-aromatic ring group, a divalent group selected among an imino group, an oxy group, a sulfide group, a sulfenyl group, a sulfonyl group, a phosphoryl group and an alkyl-substituted silyl group, or a divalent group composed of a combination of two or more of these groups); and residues of glycerol, xylitol, sorbitol, inositol, trimethylolpropane, ditrimethylpropane, neopentyl glycol or polyglycerin.

In the foregoing formula (Z), preferred examples of A are a group represented by any of following formulae (AI) to (AIII).

(AI)

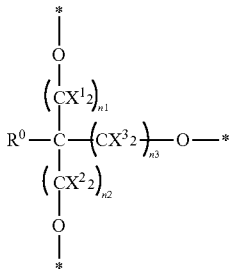

(AII)

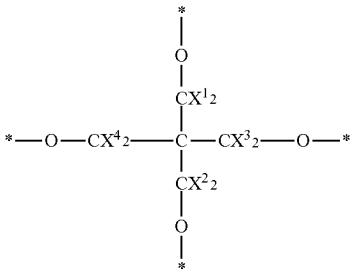

-continued (AIII)

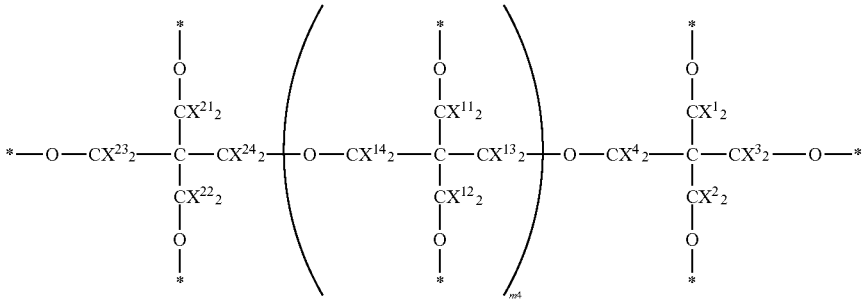

In the formulae, * means a bonding site to $-D^1-(E)_q-D^2-(B)_m—Z^1—R$; C represents a carbon atom; $R^0$ represents a hydrogen atom or a substituent; each of $X^1$ to $X^4$, $X^{11}$ to $X^{14}$ and $X^{21}$ to $X^{24}$ represents a hydrogen atom or a halogen atom (for example, a fluorine atom or a chlorine atom) and may be the same as or different from every other; each of n1 to n3 represents an integer of from 0 to 5 and preferably represents an integer of 1 or 2; and m4 represents an integer of from 0 to 8 and preferably represents an integer of 0 or 2.

In the foregoing formula (AI), examples of the substituent represented by $R^0$ include a substituted or non-substituted alkyl group having from 1 to 50 carbon atoms (for example, in addition to methyl and ethyl, linear or branched propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl or tetracosyl); an alkenyl group having from 2 to 35 carbon atoms (for example, propenyl, butenyl, pentenyl, hexenyl, heptenyl, octenyl, nonenyl, decenyl, undecenyl or dodecenyl); a cycloalkyl group having from 3 to 10 carbon atoms (for example, cyclopropyl, cyclobutyl, cyclopentyl, cyclohexyl or cycloheptyl); an aromatic ring group having from 6 to 30 carbon atoms (for example, phenyl, naphthyl, biphenyl, phenanthryl or anthracenyl); a heterocyclic group (preferably a residue of a heterocyclic ring containing at least one hetero atom selected among a nitrogen atom, an oxygen atom and a sulfur atom; for example, pyridyl, pyrimidyl, triazinyl, thienyl, furyl, pyrrolyl, pyrazolyl, imidazolyl, triazolyl, thiazolyl, imidazolyl, oxazolyl, thiadialyl, oxadiazolyl, quinolyl or isoquinolyl); and a group composed of a combination of these groups. If possible, such a substituent may further have one or more substituents, and examples of the substituent include an alkoxy group, an alkoxycarbonyl group, a halogen atom, an ether group, an alkyl carbonyl group, a cyano group, a thioether group, a sulfoxide group, a sulfonyl group, an amide group, etc.

Though all of the compounds having a group represented by any of the formulae (AI) to (AIII) as A are preferable, from the viewpoint of synthesis, compounds having a group presented by the formula (AII), namely pentaerythritol derivatives are preferable.

As described previously, A may contain an atom capable of becoming trivalent or polyvalent, such as nitrogen, silicon, boron, phosphorus, etc., and A may be a group containing a branched structure in view of the fact that it contains such an atom. Examples of nitrogen atom-containing A include residues of triethanolamine or N,N,N',N",N"-pentakis(2-hydroxypropyl)diethylenetriamine or the like. Examples of this triamine include one obtained by subjecting an imino group of polyamine to (methyl-substituted) hydroxyethylation. Examples of A also include residues of further hydroxyethylated or hydroxymethylated polyols. Moreover, examples of A include residues of silicic acid, boric acid or phosphoric acid.

Moreover, examples of A also include residues ionically bonded or coordinate bonded to a metal. Specific examples thereof include a dithiocarbamic acid residue and a dithiophosphoric acid residue of metal complexes of dithiocarbamic acid, dithiophosphoric acid, etc. That is, examples of A also include groups represented by following formula (AIX) or (AX-a) or (AX-b).

(AIX)

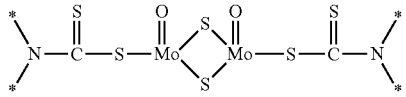

(AX-a)

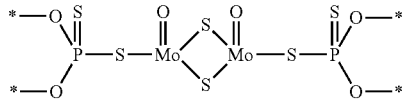

(AX-b)

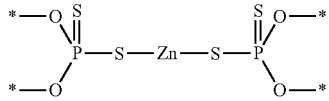

In the formulae, * means a bonding site to $-L-D^1-(E)_q-D^2-(B)_m—Z^1—R$.

Moreover, as described previously, A may be a residue of a polymer or oligomer. A structure thereof is not limited. Examples thereof include a chain or cyclic polyamine residue in which an oxyalkyl group is substituted at the N-position; a polyoxyethylene residue in which an oxyalkyl group is substituted at the C-position; a polyvinyl alcohol residue; a polyacrylate residue; and a dialkylsiloxy residue. A polymer or oligomer obtained by introducing the side chain portion in the foregoing formula (Z), namely $-L-D^1-(E)_q-D^2-(B)_m—Z^1—R$ as a substituent of a monomer and then polymerizing the resulting monomer may be used; or one obtained by polymerizing a monomer prior to introducing the subject substituent to obtain an oligomer or a polymer and then introducing the subject substituent into a side chain thereof may be used.

For example, a polymer or oligomer obtained by polymerizing a monomer which is an acrylate having $-L-D^1-(E)_q-D^2-(B)_m—Z^1—R$ in an ester portion thereof; or one obtained by modifying an oligomer or polymer having an acrylate polymerized therewith, with $-L-D^1-(E)_q-D^2-(B)_m—Z^1—R$ can be used. As the example of the polymer or oligomer represented by the foregoing formula (Z),

[acryloyl group] —O—$CH_2CH_2O$—[side chain portion other than A in the formula (Z)] is preferable, and

[acryloyl group] —O—$CH_2$— [side chain portion other than A in the formula (Z)] is more preferable.

Similarly, examples of A in the formula (Z) also include:

a residue of polyvinyl alcohol (inclusive of an oligomer) obtained by polymerizing a vinyloxy monomer or a vinyl ether;

a residue of polyethylene glycol (inclusive of an oligomer) having a methylol residue substituted therewith, which is obtained by polymerizing a glycidyloxy monomer; and a residue of a polysiloxane (inclusive of an oligomer) obtained by hydrosilylation of polymethylhydroxysiloxane and a vinyloxy monomer.

More specifically, examples of A include residues of polymers or oligomers represented by following formulae (AIV) to (AVIII).

(AIV)

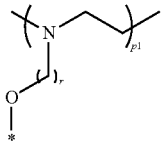

(AV)

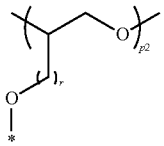

(AVI)

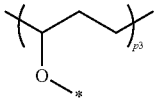

(AVII)

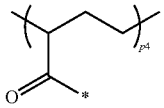

(AVIII)

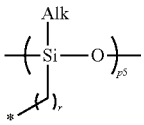

In the formulae, * means a bonding site to -L-$D^1$-$(E)_q$-$D^2$-$(B)_m$—$Z^1$—R; each of hydrogen atoms bonded to the respective carbon atoms in the formulae may be substituted with a $C_1$-$C_4$ alkyl group or a halogen atoms; in the case where two or more substituents are present, each of them may be the same as or different from every other; Alk represents a hydrogen atom, a $C_1$-$C_6$ alkyl group or a cycloalkyl group; each of p1 to p5 represents a number of 2 or more; r represents an integer of from 1 to 3; and each of p1 to p5 is preferably from 3 to 40, and more preferably from 5 to 20.

In the formula (Z), L represents a single bond, an oxy group, a substituted or non-substituted oxymethylene group represented by following formula (A-a), or a substituted or non-substituted oxyethyleneoxy group represented by following formula (A-b). In following formulae, Alk represents a hydrogen atom, a $C_1$-$C_6$ alkyl group or a cycloalkyl group.

—(O—C(Alk)$_2$)- (A-a)

—(O—C(Alk)$_2$C(Alk)$_2$O)— (A-b)

In the formula (Z), $D^1$ represents a carbonyl group (—C(═O)—) or a sulfonyl group (—S(═O)$_2$—), and each $D^1$ may be the same as or different from every other $D^1$; and $D^2$ represents a carbonyl group (—C(═O)—), a sulfonyl group (—S(═O)$_2$—), a carboxyl group (—C(═O)O—), a sulfonyloxyl group (—S(═O)$_2$O—), a carbamoyl group (—C(═O)N(Alk)-) or a sulfamoyl group (—S(═O)$_2$N(Alk)-). Alk represents a hydrogen atom, a $C_1$-$C_6$ alkyl group or a cycloalkyl group.

In the formula (Z), each E represents a single bond, a substituted or non-substituted alkylene group (preferably a $C_1$-$C_8$ alkylene group; for example, methylene, ethylene, propylene, butylene, pentylene, hexylene, heptylene or octylene), cycloalkylene group (preferably a $C_3$-$C_{15}$ cycloalkylene group; for example, cyclopropylene, cyclobutylene, cyclopentylene or cyclohexylene), alkenylene group (preferably a $C_2$-$C_8$ alkenylene group; for example, ethene, propene, butene or pentene), alkynylene group (preferably a $C_2$-$C_8$ alkynylene group; for example, ethyne, propyne, butyne or pentyne) or arylene group (preferably a $C_6$-$C_{10}$ arylene group; for example, phenylene), a divalent heterocyclic aromatic ring group or heterocyclic non-aromatic ring group, a divalent group selected among a substituted or non-substituted imino group, an oxy group, a sulfide group, a sulfenyl group, a sulfonyl group, a phosphoryl group and an alkyl-substituted silyl group, or a divalent group composed of a combination of two or more of these groups.

q represents an integer of 0 or more, and may be different from each other when q is 2 or more.

In the foregoing formula (Z), preferred examples of -$D^1$-$(E)_q$-$D^2$- include the following group.

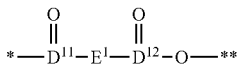

In the foregoing formula, * represents a site bonding to L in the formula; and ** represents a site bonding to B in the formula. Each of $D^{11}$ and $D^{12}$ represents a carbon atom or S(═O), and preferably a carbon atom. $E^1$ represents a single bond; a linear or branched, substituted or non-substituted $C_1$-$C_8$ alkylene group, $C_2$-$C_8$ alkenylene group or $C_2$-$C_8$ alkynylene group (provided that the carbon atom may be substituted with an oxygen atom); a substituted or non-substituted $C_3$-$C_{15}$ cycloalkylene group, cycloalkenylene group or cycloalkynylelene group; a substituted or non-substituted $C_6$-$C_{10}$ arylene group; a substituted or non-substituted aromatic or non-aromatic heterocyclic group; —NH—; or —NH-Alk"-NH— (wherein Alk" represents a $C_1$-$C_4$ alkylene group). Examples of the substituent of the alkylene group and the like include a halogen atom (for example, a fluorine atom or a chlorine atom). Preferred examples of $E^1$ include a single bond and a divalent group such as methylene, ethylene, propylene, methyleneoxymethylene, vinylene, imino, tetrafluoroethylene, iminohexyleneimino, etc.

In the formula (Z), R represents a hydrogen atom, a substituted or non-substituted $C_8$ or longer alkyl group, a perfluoroalkyl group or a trialkylsilyl group.

The $C_8$ or longer alkyl group represented by each R is preferably a $C_{12}$ or longer alkyl group. Moreover, the alkyl group is preferably a $C_{30}$ or shorter alkyl group, and more preferably a $C_{20}$ or shorter alkyl group. The alkyl group may be either linear or branched. Specific examples thereof include decyl, tridecyl, tetradecyl, pentadecyl, hexadecyl, heptadecyl, octadecyl, nonadecyl, eicosyl, heneicosyl, docosyl, tricosyl, octacosyl, triacontyl, pentatriacontyl, tetracontyl, pentacontyl, hexacontyl, octacontyl and decacontyl. Such an alkyl group may have one or more substituents. Examples of the substituent include a halogen atom (for example, a fluorine atom and a chlorine atom), a hydroxyl group, an amino group, an alkylamino group, a mercapto group, an alkylthio group, an alkoxy group, a cyano group, etc.

The perfluoroalkyl group represented by each R is preferably a $C_1$-$C_{10}$ perfluoroalkyl group, more preferably a $C_1$-$C_6$ perfluoroalkyl group, further preferably a $C_1$-$C_4$ perfluoroalkyl group, and especially preferably a $C_1$-$C_2$ perfluoroalkyl group. Examples thereof include a trifluoromethyl group, a perfluoroethyl group, a perfluoropropyl group, a perfluorobutyl group, a perfluoropentyl group, a perfluorohexyl group, a perfluoroheptyl group and a perfluorooctyl group.

The alkyl group bonding to Si of the trialkylsilyl group represented by each R is preferably a $C_1$-$C_4$ alkyl group such as methyl, ethyl, etc. Such an alkyl group may be branched.

In the formula (Z), B varies depending upon R; in the case where R represents a hydrogen atom or a substituted or non-substituted $C_8$ or longer alkyl group, B represents a substituted or non-substituted oxyethylene group or a substituted or non-substituted oxypropylene group; plural Bs connecting to each other may be the same as or different from each other; and m represents a natural number of 1 or more, preferably a number of from 4 to 20, and more preferably from 7 to 12.

Each B may be the same as or different from every other B, and for example, a plural kind of units B having a different chain length of the alkylene moiety from each other may be contained, and/or both a unit B in which the alkylene moiety is non-substituted and a unit B in which the alkylene moiety is substituted may be contained. The alkylene moiety of the alkyleneoxy group may have a substituent, and examples of the substituent include a halogen atom (for example, a fluorine atom or a chlorine atom). Moreover, the chain length of the substituted or non-substituted oxyethylene group or the substituted or non-substituted oxypropylene group may have distribution.

In the case where R represents a perfluoroalkyl group, B represents an oxyperfluoromethylene group, an oxyperfluoroethylene group or an optionally branched oxyperfluoropropylene group (examples of the branched oxyperfluoropropylene group include a perfluoroisopropylene group); plural Bs connecting to each other may be the same as or different from each other; and m represents a natural number of 1 or more, preferably a number of from 4 to 20, and more preferably from 7 to 12.

In the case where R represents a trialkylsilyl group, B represents a dialkylsiloxy group in which the alkyl group is selected among a methyl group, an ethyl group and an optionally branched propyl group (examples of the branched propyl group include an isopropyl group); each B may be the same as or different from every other B; plural Bs connecting to each other may be the same as or different from each other; and m represents a natural number of 1 or more, preferably a number of from 4 to 20, and more preferably from 7 to 12.

In the formula (Z), $Z^1$ represents a single bond, a divalent group selected among a carbonyl group, a sulfonyl group, a phosphoryl group, an oxy group, a substituted or non-substituted amino group, a sulfide group, an alkenylene group, an alkynylene group and an arylene group or a divalent group composed of a combination of two or more of these groups. As an example of the divalent connecting group, a divalent connecting group composed of a combination of one or more members selected among a carbonyl group, a sulfonyl group, a phosphoryl group, an oxy group, a substituted or non-substituted imino group, a sulfide group, a $C_1$-$C_6$ alkylene group, a $C_1$-$C_{16}$ cycloalkylene group, a $C_2$-$C_8$ alkenylene group, a $C_2$-$C_5$ alkynylene group, a $C_6$-$C_{10}$ arylene group and a $C_3$-$C_{10}$ heterocyclic group is preferable. Examples of the connecting group composed of a combination of plural groups include —CONH—, —CO-cyclohexylene-, —CO—Rh— (wherein Rh represents a phenylene group; hereinafter the same), —CO—C≡C-Ph-, —CO—CH=CH-Ph-, —CO-Ph-N=N-Ph-O—, —$C_nH_{2n}$—NR— (n represents from 1 to 4; R represents a hydrogen atom or a $C_1$-$C_4$ alkyl group; and the right side is bonded to the end side) and —N,N'-pyrazylene-.

As described previously, in the formula (Z), each R may be the same as or different from every other R and represents a substituted or non-substituted $C_8$ or longer alkyl group, a perfluoroalkyl group or a trialkylsilyl group. In more detail, as for —$(B)_m$—$Z^1$—R in the formula (Z), when R represents a substituted or non-substituted alkyl group having 8 or more carbon atoms, following formula (ECa) is preferable; when R represents a perfluoroalkyl group, following formula (ECb) is preferable; and when R represents a trialkylsilyl group, following formula (ECa) is preferable.

In the formula (Z), when R represents a substituted or non-substituted $C_8$ or longer alkyl group, —$(B)_m$—$Z^1$—R is preferably a group represented by following formula (ECa).

$$\left(\left(CX^{a1}X^{a2}\right)_{na1}O\right)_{na2}-L^a-R^a \quad \text{(ECa)}$$

In the formula (ECa), C represents a carbon atom; O represents an oxygen atom; $L^a$ (corresponding to $Z^1$ in the formula (Z)) represents a single bond or a divalent connecting group; each of $X^{a1}$ and $X^{a2}$ represents a hydrogen atom, a halogen atom or a substituent (preferably a hydrogen atom or a fluorine atom, and more preferably a hydrogen atom); na1 represents an integer of from 1 to 4; when na1 is 2 or more, plural $X^{a1}$s and $X^{a2}$s may be the same as or different from each other; na2 represents a number of from 1 to 35 (preferably from 4 to 20, and more preferably from 4 to 10); and $R^a$ (corresponding to R in the formula (Z)) represents a substituted or non-substituted $C_8$ or longer alkyl group (preferably $C_{12}$ or longer and also preferably $C_{30}$ or shorter, and more preferably $C_{24}$ or shorter).

$L^a$ is preferably a single bond or a divalent connecting group composed of a combination of one or more members selected among a carbonyl group, a sulfonyl group, a phosphoryl group, an oxy group, a substituted or non-substituted amino group, a thio group, an alkylene group, an alkenylene group, an alkynylene group and an arylene group.

In the formula (Z), when R represents a perfluoroalkyl group, —$(B)_m$—$Z^1$—R is preferably a group represented by following formula (ECb).

$$\left(\left(CX^{a1}X^{a2}\right)_{na1}O\right)_{na2}-\left(C_nF_{2n}O\right)_{nc}-L^{a1}-C_mF_{2m+1} \quad \text{(ECb)}$$

In the formula (ECb), the same symbols as those in the formula (ECa) are synonymous, respectively; $L^{a1}$ corresponding to $Z^1$ in the formula (Z) represents a single bond; na2 represents a number of from 0 to 2; nc represents a number of from 1 to 10; m represents a number of from 1 to 12; and n represents a number of from 1 to 6.

nc is preferably from 3 to 8. m is preferably a number of from 1 to 8, and more preferably from 1 to 4. n is preferably from 1 to 3.

Moreover, a preferred example of the formula (ECb) is a group represented by following formula (ECb').

(ECb')

$$-\left(\left(CX^{a1}X^{a2}\right)_{na1}O\right)_{na2}-(CH_nF_{2n}O)_{nc1}-(CF_2CF_2O)_{nc}-C_mF_{2m+1}$$

In the formula (ECb'), the same symbols as those in the formula (ECb) are synonymous, and preferred ranges thereof are also the same. nc1 is 1 or 2, and preferably 1.

In the formula (Z), when R represents a trialkylsilyl group, $-(B)_m-Z^1-R$ is preferably a group represented by following formula (ECc).

(ECc)

$$-(Si(Alk')_2O)_{nb}-L^{a1}-Si(Alk')_3$$

In the formula (ECc), the same symbols as those in the formula (ECa) are synonymous, respectively; each Alk' may be the same as or different from every other Alk' and represents a $C_1$-$C_8$ alkyl group; $L^{a1}$ (corresponding to $Z^1$ in the formula (Z)) represents a single bond; and nb represents a number of from 1 to 10. nb is preferably a number of from 2 to 20, and more preferably from 3 to 10.

In the foregoing formula (Z), p represents an integer of 2 or more, preferably 3 or more, and more preferably from 3 to 8. In view of the fact that the compound of the formula (Z) has plural side chains having a prescribed structure, it is able to achieve a low coefficient of friction.

On the other hand, even when a plurality of the side chains having a prescribed structure of $-D^1-(E)_q-D^2-(B)_m-Z^1-R$ do not exist in a molecule, a compound presented by following formula (Y) is expected to exhibit the same effect as that in the compound represented by the formula (Z). The invention is concerned with the foregoing composition containing at least one compound represented by following formula (Y) together with the at least one compound represented by the formula (Z).

$$R-Z^1-(B)_m-D^1-(E)_q-D^2-(B)_m-Z^1-R \quad (Y)$$

In the formula, the symbols are synonymous with those in the formula (Z), respectively, and preferred ranges and specific examples thereof are the same. By jointly using the compound of the formula (Y), the coefficient of friction is more reduced.

Examples of the compound represented by the formula (Z) are given below, but it should not be construed that the invention is limited thereto.

(AI)

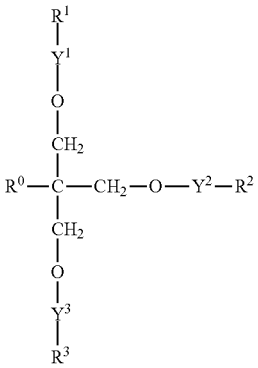

| Compound No. | $R^0$ | $Y^1=Y^2=Y^3$ | $R^1$ | $R^2$ | $R^3$ |
|---|---|---|---|---|---|
| AI-1 | $C_2H_5$ | $COC_2H_4CO_2$ | $(C_2H_4O)_{6.5}C_{22}H_{45}$-n | $(C_2H_4O)_{6.5}C_{22}H_{45}$-n | $(C_2H_4O)_{6.5}C_{22}H_{45}$-n |
| AI-2 | $C_2H_5$ | $COC_2H_4CO_2$ | $(C_2H_4O)_{6.5}C_{20}H_{41}$-n | $(C_2H_4O)_{6.5}C_{20}H_{41}$-n | $(C_2H_4O)_{6.5}C_{20}H_{41}$-n |
| AI-3 | $C_2H_5$ | $COC_2H_4CO_2$ | $(C_2H_4O)_{6.5}C_{18}H_{37}$-n | $(C_2H_4O)_{6.5}C_{18}H_{37}$-n | $(C_2H_4O)_{6.5}C_{18}H_{37}$-n |
| AI-4 | $C_2H_5$ | $COC_2H_4CO_2$ | $(C_2H_4O)_{6.5}C_{16}H_{33}$-n | $(C_2H_4O)_{6.5}C_{16}H_{33}$-n | $(C_2H_4O)_{6.5}C_{16}H_{33}$-n |
| AI-5 | $C_2H_5$ | $COC_2H_4CO_2$ | $(C_2H_4O)_{6.5}C_{14}H_{29}$-n | $(C_2H_4O)_{6.5}C_{14}H_{29}$-n | $(C_2H_4O)_{6.5}C_{14}H_{29}$-n |
| AI-6 | $C_2H_5$ | $COC_2H_4CO_2$ | $(C_2H_4O)_{6.5}C_{12}H_{25}$-n | $(C_2H_4O)_{6.5}C_{12}H_{25}$-n | $(C_2H_4O)_{6.5}C_{12}H_{25}$-n |
| AI-7 | $C_2H_5$ | $COC_2H_4CO_2$ | $(C_2H_4O)_{6.5}C_{25}H_{51}$-n | $(C_2H_4O)_{6.5}C_{25}H_{51}$-n | $(C_2H_4O)_{6.5}C_{25}H_{51}$-n |
| AI-8 | $CH_3$ | $COC_2H_4CO_2$ | $(C_2H_4O)_{6.5}C_{35}H_{71}$-n | $(C_2H_4O)_{6.5}C_{35}H_{71}$-n | $(C_2H_4O)_{6.5}C_{35}H_{71}$-n |
| AI-9 | $CH_3$ | $COC_2H_4CO_2$ | $(C_2H_4O)_{6.5}CH(C_6H_{13}$-n$)C_2H_{12}$-n | $(C_2H_4O)_{6.5}CH(C_6H_{13}$-n$)C_2H_{12}$-n | $(C_2H_4O)_{6.5}CH(C_6H_{13}$-n$)C_2H_{12}$-n |
| AI-10 | $CH_3$ | $COC_2H_4CO_2$ | $(C_2H_4O)_{6.5}CH(C_6H_{13}$-n$)C_2H_{12}$-n | $(C_2H_4O)_{6.5}C_{18}H_{37}$-n | $(C_2H_4O)_{6.5}C_{18}H_{37}$-n |
| AI-11 | $CH_3$ | $COC_2H_4CO_2$ | $(C_2H_4O)_4COC_{21}H_{43}$-n | $(C_2H_4O)_4COC_{21}H_{43}$-n | $(C_2H_4O)_4COC_{21}H_{43}$-n |
| AI-12 | $CH_3$ | $COC_2H_4CO_2$ | $(C_2H_4O)_{6.2}CONHC_{18}H_{37}$-n | $(C_2H_4O)_{6.5}CONHC_{18}H_{37}$-n | $(C_2H_4O)_{6.5}CONHC_{18}H_{37}$-n |
| AI-13 | $CH_3$ | $COC_2H_4CO_2$ | $(C_2H_4O)_{6.2}COC_2H_4C_{18}H_{37}$-n | $(C_2H_4O)_{6.2}COC_5H_4C_{18}H_{37}$-n | $(C_2H_4O)_{6.2}COC_5H_4C_{18}H_{37}$-n |
| AI-14 | $CH_3$ | $COC_2H_4CO_2$ | $(C_2H_4O)_4FO_2C_{21}H_{43}$-n | $(C_2H_4O)_4PO_2C_{21}H_{43}$-n | $(C_2H_4O)_4PO_2C_{21}H_{43}$-n |
| AI-15 | $CH_3$ | $COC_2H_4CO_2$ | $(C_2H_4O)_4SO_2C_{18}H_{37}$-n | $(C_2H_4O)_4SO_2C_{18}H_{37}$-n | $(C_2H_4O)_4SO_2C_{18}H_{37}$-n |
| AI-16 | $CH_3$ | $COC_2H_4CO_2$ | $(C_2H_4O)_{6.2}COC{=}CC_2H_4C_{18}H_{37}$-n | $(C_2H_4O)_{6.2}COC{=}CC_2H_4C_{18}H_{37}$-n | $(C_2H_4O)_{6.2}COC{=}CC_2H_4C_{18}H_{37}$-n |
| AI-17 | $CH_3$ | $COC_2H_4CO_2$ | $(C_2H_4O)_{6.2}COCH{=}CHC_2H_4C_{18}H_{37}$-n | $(C_2H_4O)_{6.2}COCH{=}CHC_2H_4C_{18}H_{37}$-n | $(C_2H_4O)_{6.2}COCH{=}CHC_2H_4C_{18}H_{37}$-n |
| AI-18 | $CH_3$ | $COC_2H_4CO_2$ | $(C_2H_4O)_{6.2}C_2H_4N(CH_3)C_{18}H_{37}$-n | $(C_2H_4O)_{6.2}C_2H_4N(CH_3)C_{18}H_{37}$-n | $(C_2H_4O)_{6.2}C_2H_4N(CH_3)C_{18}H_{37}$-n |
| AI-19 | $CH_3$ | $COC_2H_4CO_2$ | $(C_2H_4O)_5C_{16}H_{33}$-n | $(C_2H_4O)_5C_{16}H_{33}$-n | $(C_2H_4O)_5C_{16}H_{33}$-n |
| AI-20 | $CH_3$ | $COC_2H_4CO_2$ | $(C_2H_4O)_{32}(C_2H_4O)_4COO_{21}H_{43}$-n | $(C_2H_4O)_{32}(C_2H_4O)_4COO_{21}H_{43}$-n | $(C_2H_4O)_{32}(C_2H_4O)_4COO_{21}H_{43}$-n |
| AI-21 | $CH_3$ | $COC_2H_4CO_2$ | $(C_2H_4O)_{32}(C_2H_4O)_4C_{22}H_{45}$-n | $(C_2H_4O)_{32}(C_2H_4O)_4C_{22}H_{45}$-n | $(C_2H_4O)_{32}(C_2H_4O)_4C_{22}H_{45}$-n |

(AI)

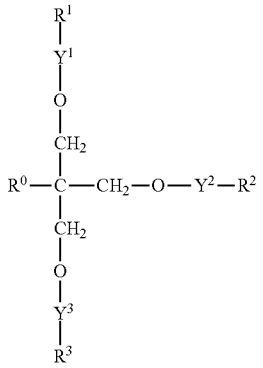

| Compound No. | $R^0$ | $Y^1{=}Y^2{=}Y^3$ | $R^1$ | $R^2$ | $R^3$ |
|---|---|---|---|---|---|
| AI-22 | $CH_3$ | $COCH_2CO_2$ | $(C_2H_4O)_{6.5}C_{22}H_{45}$-n | $(C_2H_4O)_{6.5}C_{22}H_{45}$-n | $(C_2H_4O)_{6.5}C_{22}H_{45}$-n |
| AI-23 | $CH_3$ | $COC_3H_6CO_2$ | $(C_2H_4O)_{6.5}C_{22}H_{45}$-n | $(C_2H_4O)_{6.5}C_{22}H_{45}$-n | $(C_2H_4O)_{6.5}C_{22}H_{45}$-n |
| AI-24 | $CH_3$ | $COC_4H_6CO_2$ | $(C_2H_4O)_{6.5}C_{22}H_{45}$-n | $(C_2H_4O)_{5.5}C_{22}H_{45}$-n | $(C_2H_4O)_{6.5}C_{22}H_{45}$-n |
| AI-25 | $CH_3$ | $COCH{=}CHCO_2$ | $(C_2H_4O)_{6.5}C_{22}H_{45}$-n | $(C_2H_4O)_{5.5}C_{22}H_{45}$-n | $(C_2H_4O)_{6.5}C_{22}H_{45}$-n |
| AI-26 | $CH_3$ | $COCH_2OCH_2CO_2$ | $(C_2H_4O)_{5.5}C_{22}H_{45}$-n | $(C_2H_4O)_{5.5}C_{22}H_{45}$-n | $(C_2H_4O)_{6.5}C_{22}H_{45}$-n |
| AI-27 | $CH_3$ | 1.2-$COC_6H_4CO_2$ | $(C_2H_4O)_{8.5}C_{22}H_{45}$-n | $(C_2H_4O)_{5.5}C_{22}H_{45}$-n | $(C_2H_4O)_{6.5}C_{22}H_{45}$-n |
| AI-28 | $C_6H_5$ | 1.4-$COC_6H_4CO_2$ | $(C_2H_4O)_{6.5}C_{22}H_{45}$-n | $(C_2H_4O)_{6.5}C_{22}H_{45}$-n | $(C_2H_4O)_{6.5}C_{22}H_{45}$-n |
| AI-29 | $C_6H_5$ | $COCH_2C(CH_3)_2CH_2CO_2$ | $(C_2H_4O)_{6.5}C_{22}H_{45}$-n | $(C_2H_4O)_{5.5}C_{22}H_{45}$-n | $(C_2H_4O)_{6.5}C_{22}H_{45}$-n |
| AI-30 | $C_2F_5$ | $COC_2F_4CO_2$ | $(C_2H_4O)_{5.5}C_{22}H_{45}$-n | $(C_2H_4O)_{5.5}C_{22}H_{45}$-n | $(C_2H_4O)_{6.5}C_{22}H_{45}$-n |
| AI-31 | $C_2F_5$ | 1.2-$COC_6F_4CO_2$ | $(C_2H_4O)_{6.5}C_{22}H_{45}$-n | $(C_2H_4O)_{5.5}C_{22}H_{45}$-n | $(C_2H_4O)_{6.5}C_{22}H_{45}$-n |
| AI-32 | $C_2F_5$ | $CONHCO_2$ | $(C_2H_4O)_{6.5}C_{22}H_{45}$-n | $(C_2H_4O)_{6.5}C_{22}H_{45}$-n | $(C_2H_4O)_{6.5}C_{22}H_{45}$-n |
| AI-33 | $C_2F_5$ | $CONHSO_3$ | $(C_2H_4O)_{5.5}C_{22}H_{45}$-n | $(C_2H_4O)_{6.5}C_{22}H_{45}$-n | $(C_2H_4O)_{6.5}C_{22}H_{45}$-n |
| AI-34 | $C_2F_5$ | SO2$NHCO_2$ | $(C_2H_4O)_{8.5}C_{22}H_{45}$-n | $(C_2H_4O)_{6.5}C_{22}H_{45}$- n | $(C_2H_4O)_{6.5}C_{22}H_{45}$-n |
| AI-36 | $C_2F_5$ | $COCO_2$ | $(C_2H_4O)_{6.5}C_{22}H_{45}$-n | $(C_2H_4O)_{5.5}C_{22}H_{45}$-n | $(C_2H_4O)_{6.5}C_{22}H_{45}$-n |
| AI-37 | $C_2F_5$ | $COC_2H_4CO_2$ | $(C_2H_4O)_{10.3}C_{22}H_{45}$-n | $(C_2H_4O)_{10.3}C_{22}H_{45}$-n | $(C_2H_4O)_{10.3}C_{22}H_{45}$-n |
| AI-38 | $C_2F_5$ | $COC_2H_4CO_2$ | $(C_2H_4O)_{19.7}C_{22}H_{45}$-n | $(C_2H_4O)_{19.7}C_{22}H_{45}$-n | $(C_2H_4O)_{19.7}C_{22}H_{45}$-n |
| AI-39 | $C_5H_4N$ | $COC_2H_4CO_2$ | $(C_2H_4O)_{35.2}C_{22}H_{45}$-n | $(C_2H_4O)_{35.2}C_{22}H_{45}$-n | $(C_2H_4O)_{35.2}C_{22}H_{45}$-n |

(AI)

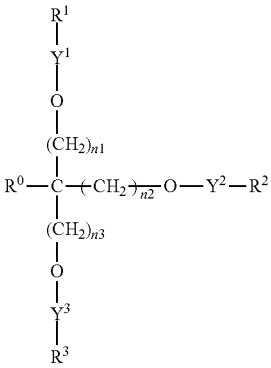

| Compound No. | $R^0$ | n1 | n2 | n3 | $Y^1{=}Y^2{=}Y^3$ | $R^1$ |
|---|---|---|---|---|---|---|
| AI-42 | $C_5H_4N$ | 4 | 4 | 4 | $COC_2H_4CO_2$ | $(C_2H_4O)_{5.5}C_{22}H_{45}$-n |
| AI-43 | H | 1 | 1 | 1 | $COC_2H_4CO_2$ | $(C_2H_4O)_{5.5}C_{22}H_{45}$-n |
| AI-44 | H | 1 | 1 | 1 | $COC_2H_4CO_2$ | $(C_2H_4O)_{5.5}CH(C_6H_{13}$-n$)C_9H_{19}$-n |
| AI-45 | H | 1 | 1 | 1 | $COC_2H_4CO_2$ | $(C_2H_4O)_{5.2}CONHC_{18}H_{37}$-n |
| AI-55 | $C_2H_5$ | 1 | 1 | 1 | $CONHC_5H_{12}NHCO_2$ | $(C_2H_4O)_{5.5}C_{22}H_{45}$-n |
| Al-56 | $C_2H_5$ | 1 | 1 | 1 | $CONHC_5H_{12}NHCO_2$ | $(C_2H_4O)_{5.5}C_{15}H_{31}$-n |
| AI-57 | $C_2H_5$ | 1 | 1 | 1 | $CONHC_5H_{12}NHCO_2$ | $(C_2H_4O)_{5.5}C_{26}H_{53}$-n |
| AI-58 | $C_2H_5$ | 1 | 1 | 1 | $CONHC_5H_{12}NHCO_2$ | $(C_2H_4O)_{5.5}CH(C_6H_{13}$-n$)C_9H_{19}$-n |
| AI-59 | $C_2H_5$ | 1 | 1 | 1 | $CONHC_5H_{12}NHCO_2$ | $(C_2H_4O)_4COC_{21}H_{43}$-n |

-continued (AI)

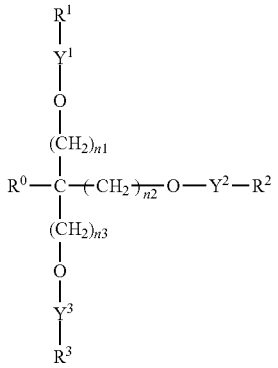

| | | | | | | |
|---|---|---|---|---|---|---|
| AI-60 | $C_2H_5$ | 1 | 1 | 1 | $CONHC_5H_{12}NHCO_2$ | $(C_2H_4O)_4COC_{21}H_{43}$-n |
| AI-61 | $C_2H_5$ | 1 | 1 | 0 | $CONHC_5H_{12}NHCO_2$ | $(C_2H_4O)_4COC_{21}H_{43}$-n |
| AI-62 | $C_2H_5$ | 1 | 0 | 0 | $CONHC_5H_{12}NHCO_2$ | $(C_2H_4O)_4COC_{21}H_{43}$-n |
| AI-63 | $C_2H_5$ | 0 | 0 | 0 | $CONHC_5H_{12}NHCO_2$ | $(C_2H_4O)_4COC_{21}H_{43}$-n |
| AI-64 | $C_2H_5$ | 1 | 1 | 0 | $COCH_2CO_2$ | $(C_2H_4O)_{5.5}C_{22}H_{45}$-n |
| AI-65 | $C_2H_5$ | 1 | 0 | 0 | $COCH_2CO_2$ | $(C_2H_4O)_{5.5}C_{22}H_{45}$-n |
| AI-66 | $C_2H_5$ | 0 | 0 | 0 | $COCH_2CO_2$ | $(C_2H_4O)_{5.5}C_{22}H_{45}$-n |

| Compound No. | $R^2$ | $R^3$ |
|---|---|---|
| AI-42 | $(C_2H_4O)_{65}COC_{22}H_{45}$-n | $(C_2H_4O)_{65}COC_{22}H_{45}$-n |
| AI-43 | $(C_2H_4O)_{65}COC_{22}H_{45}$-n | $(C_2H_4O)_{65}COC_{22}H_{45}$-n |
| AI-44 | $(C_2H_4O)_{65}CH(C_6H_{13}\text{-n})C_9H_{19}$-n | $(C_2H_4O)_{65}CH(C_6H_{13}\text{-n})C_9H_{19}$-n |
| AI-45 | $(C_2H_4O)_{52}CONHC_{15}H_{31}$-n | $(C_2H_4O)_{52}CONHC_{15}H_{31}$-n |
| AI-55 | $(C_2H_4O)_{65}C_{22}H_{45}$-n | $(C_2H_4O)_{65}C_{22}H_{45}$-n |
| AI-56 | $(C_2H_4O)_{65}C_{15}H_{31}$-n | $(C_2H_4O)_{65}C_{22}H_{45}$-n |
| AI-57 | $(C_2H_4O)_{65}C_{26}H_{53}$-n | $(C_2H_4O)_{65}C_{22}H_{45}$-n |
| AI-58 | $(C_2H_4O)_{65}CH(C_6H_{13}\text{-n})C_9H_{19}$-n | $(C_2H_4O)_{65}CH(C_6H_{13}\text{-n})C_9H_{19}$-n |
| AI-59 | $(C_2H_4O)_4COC_{21}H_{43}$-n | $(C_2H_4O)_4COC_{21}H_{43}$-n |
| AI-60 | $(C_2H_4O)_4COC_{21}H_{43}$-n | $(C_2H_4O)_4COC_{21}H_{43}$-n |
| AI-61 | $(C_2H_4O)_4COC_{21}H_{43}$-n | $(C_2H_4O)_4COC_{21}H_{43}$-n |
| AI-62 | $(C_2H_4O)_4COC_{21}H_{43}$-n | $(C_2H_4O)_4COC_{21}H_{43}$-n |
| AI-63 | $(C_2H_4O)_4COC_{21}H_{43}$-n | $(C_2H_4O)_4COC_{21}H_{43}$-n |
| AI-64 | $(C_2H_4O)_{65}C_{22}H_{45}$-n | $(C_2H_4O)_{65}C_{22}H_{45}$-n |
| AI-65 | $(C_2H_4O)_{65}C_{22}H_{45}$-n | $(C_2H_4O)_{65}C_{22}H_{45}$-n |
| AI-66 | $(C_2H_4O)_{65}C_{22}H_{45}$-n | $(C_2H_4O)_{65}C_{22}H_{45}$-n |

(AI)

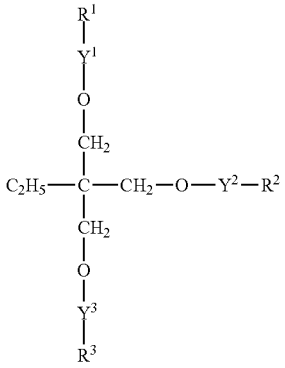

| Compound No. | $Y^1$ | $Y^2$ | $Y^3$ | $R^1$=$R^2$=$R^3$ |
|---|---|---|---|---|
| AI-67 | $COCH_2CO_2$ | $COC_2H_4CO_2$ | $COC_2H_4CO_2$ | $(C_2H_4O)_{10.3}C_8H_{17}$-n |
| AI-68 | $COCH_2CO_2$ | $COC_2H_4CO_2$ | $COC_2H_4CO_2$ | $(C_2H_4O)_{19.7}C_8H_{17}$-n |
| AI-69 | $COCH_2CO_2$ | $COC_2H_4CO_2$ | $COC_2H_4CO_2$ | $(C_2H_4O)_{15.2}C_8H_{17}$-n |
| AI-70 | $COCH_2CO_2$ | $COCH_2CO_2$ | $COCH_2CO_2$ | $(C_2H_4O)_{15.2}C_8H_{17}$-n |

-continued (AI)

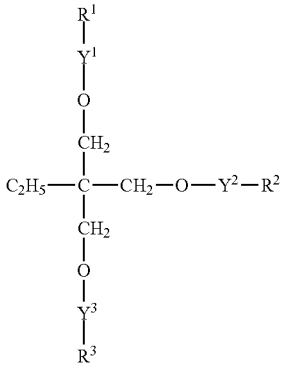

| Compound No. | $Y^1$ | $Y^2$ | $Y^3$ | $R^1$=$R^2$=$R^3$ |
|---|---|---|---|---|
| AI-71 | $CONHCO_2$ | $COC_2H_4CO_2$ | $COC_2H_4CO_2$ | $(C_2H_4O)_{15.2}CH_2CF_2O(C_2F_4O)_2C_2F_5$-n |
| AI-72 | $CONHSO_3$ | $COC_2H_4CO_2$ | $COC_2H_4CO_2$ | $(C_2H_4O)_{15.2}CH_2CF_2O(C_2F_4O)_2C_2F_5$-n |
| AI-73 | $SO_2NHCO_2$ | $COC_2H_4CO_2$ | $COC_2H_4CO_2$ | $(C_2H_4O)_{15.2}CH_2CF_2O(C_2F_4O)_2C_2F_5$-n |
| AI-74 | $CSNHCO_2$ | $COC_2H_4CO_2$ | $COC_2H_4CO_2$ | $(C_2H_4O)_{15.2}CH_2CF_2O(C_2F_4O)_2C_2F_5$-n |
| AI-75 | $COCO_2$ | $COC_2H_4CO_2$ | $COC_2H_4CO_2$ | $(C_2H_4O)_{15.2}CH_2CF_2O(C_2F_4O)_2C_2F_5$-n |
| AI-76 | $COC_2H_4CO_2$ | $COC_2H_4CO_2$ | $COC_2H_4CO_2$ | $(C_2H_4O)_{10.3}(SiMe_2O)_4SiMe_3$-n |
| AI-77 | $COCH_2CO_2$ | $COC_2H_4CO_2$ | $COC_2H_4CO_2$ | $(C_2H_4O)_{10.3}(SiMe_2O)_4SiMe_3$-n |
| AI-78 | $CONHCO_2$ | $COC_2H_4CO_2$ | $COC_2H_4CO_2$ | $(C_2H_4O)_{10.3}(SiMe_2O)_4SiMe_3$-n |
| AI-79 | $CONHSO_3$ | $COC_2H_4CO_2$ | $COC_2H_4CO_2$ | $(C_2H_4O)_{10.3}(SiMe_2O)_4SiMe_3$-n |

(A II)

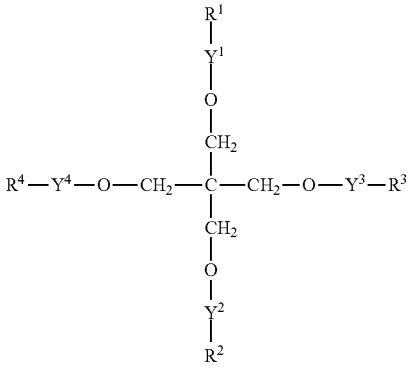

| Compound No. | $Y^l$=$Y^2$=$Y^3$=$Y^4$ | $R^1$=$R^2$=$R^3$=$R^4$ |
|---|---|---|
| AII-1 | $COC_2H_4CO_2$ | $(C_2H_4O)_{6.5}C_{22}H_{45}$-n |
| AII-2 | $COC_2H_4CO_2$ | $(C_2H_4O)_{4.0}C_{22}H_{45}$-n |
| AII-3 | $COC_2H_4CO_2$ | $(C_2H_4O)_{6.52}C_{20}H_{41}$-n |
| AII-4 | $COC_2H_4CO_2$ | $(C_2H_4O)_{6.55}C_{18}H_{37}$-n |
| AII-5 | $COC_2H_4CO_2$ | $(C_2H_4O)_4C_{18}H_{37}$-n |
| AII-6 | $COC_2H_4CO_2$ | $(C_2H_4O)_{6.42}C_{16}H_{33}$-n |
| AII-7 | $COC_2H_4CO_2$ | $(C_2H_4O)_{6.15}C_{14}H_{29}$-n |
| AII-8 | $COC_2H_4CO_2$ | $(C_2H_4O)_4C_{14}H_{29}$-n |
| AII-9 | $COC_2H_4CO_2$ | $(C_2H_4O)_{6.5}C_{12}H_{25}$-n |
| AII-10 | $COC_2H_4CO_2$ | $(C_2H_4O)_{6.5}C_{26}H_{53}$-n |
| AII-11 | $COC_2H_4CO_2$ | $(C_2H_4O)_{6.5}C_{35}H_{71}$-n |
| AII-12 | $COC_2H_4CO_2$ | $(C_2H_4O)_{3.0}C_{22}H_{45}$-n |
| AII-13 | $COC_2H_4CO_2$ | $(C_2H_4O)_{4.0}C_{22}H_{46}$-n |

-continued (A II)

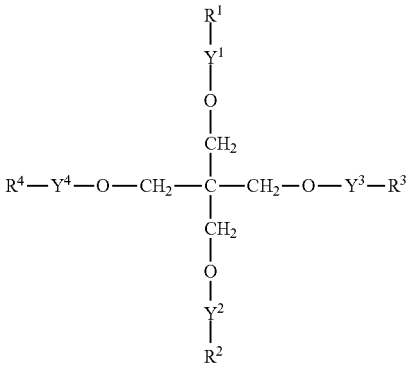

| Compound No. | $Y^l$=$Y^2$=$Y^3$=$Y^4$ | $R^1$=$R^2$=$R^3$=$R^4$ |
|---|---|---|
| AII-14 | $COC_2H_4CO_2$ | $(C_2H_4O)_{6.18}C_{22}H_{45}$-n |
| AII-15 | $COC_2H_4CO_2$ | $(C_2H_4O)_{7.8}C_{22}H_{46}$-n |
| AII-16 | $COC_2H_4CO_2$ | $(C_2H_4O)_{8.4}C_{22}H_{47}$-n |
| AII-17 | $COC_2H_4CO_2$ | $(C_2H_4O)_{10.3}C_{22}H_{48}$-n |
| AII-18 | $COC_2H_4CO_2$ | $(C_2H_4O)_{19.0}C_{22}H_{49}$-n |
| AII-19 | $COC_2H_4CO_2$ | $(C_2H_4O)_{27.7}C_{22}H_{50}$-n |
| AII-20 | $COC_2H_4CO_2$ | $(C_2H_4O)_{6.5}CH_2CH(C_6H_{13}$-n$)C_9H_{19}$-n |

(A II)

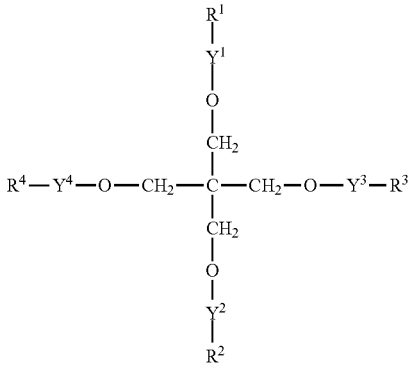

| Compound No. | $Y^1$=$Y^2$=$Y^3$=$Y^4$ | $R^1$ | $R^2$ | $R^3$ | $R^4$ |
|---|---|---|---|---|---|
| AII-21 | $COC_2H_4CO_2$ | $(C_2H_4O)_{6.5}CH_2OH(C_6H_{18}\text{-n})C_9H_{19}\text{-n}$ | $(C_2H_4O)_{6.5}C_{18}H_{37}\text{-n}$ | $(C_2H_4O)_{6.5}C_{20}H_{41}\text{-n}$ | $(C_2H_4O)_{6.5}C_{20}H_{41}\text{-n}$ |

(A II)

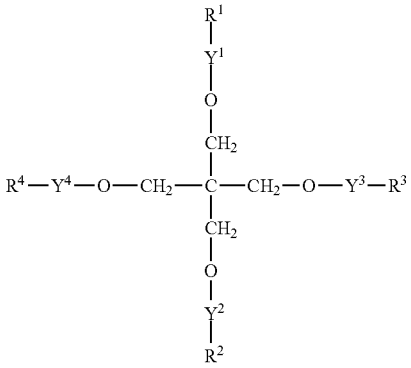

| Com-pound No. | $Y^1$=$Y^2$=$Y^3$=$Y^4$ | $R^1$=$R^2$= $R^3$=$R^4$ |
|---|---|---|
| AII-22 | $COC_2H_4CO_2$ | $(C_2H_4O)_4COC_{21}H_{43}\text{-n}$ |
| AII-23 | $COC_2H_4CO_2$ | $(C_2H_4O)_{6.2}CONHC_{18}H_{37}\text{-n}$ |
| AII-24 | $COC_2H_4CO_2$ | $(C_2H_4O)_{6.2}COC_6H_4C_{18}H_{37}\text{-n}$ |
| AII-25 | $COC_2H_4CO_2$ | $(C_2H_4O)_4PO_2C_{21}H_{43}\text{-n}$ |
| AII-26 | $COC_2H_4CO_2$ | $(C_2H_4O)_4SO_2C_{18}H_{37}\text{-n}$ |
| AII-27 | $COC_2H_4CO_2$ | $(C_2H_4O)_{6.2}COC{=}CC_6H_4C_{18}H_{37}\text{-n}$ |
| AII-28 | $COC_2H_4CO_2$ | $(C_2H_4O)_{6.2}COCH{=}CHC_6H_4C_{18}H_{37}\text{-n}$ |
| AII-29 | $COC_2H_4CO_2$ | $(C_2H_4O)_{6.2}C_2H_4N(CH_3)C_{18}H_{37}\text{-n}$ |
| AII-30 | $COC_2H_4CO_2$ | $(C_3H_6O)_5C_{16}H_{33}\text{-n}$ |
| AII-31 | $COC_2H_4CO_2$ | $(C_3H_6O)_{5.2}(C_2H_4O)_4COC_{21}H_{43}\text{-n}$ |
| AII-32 | $COC_2H_4CO_2$ | $(C_3H_6O)_{6.2}(C_2H_4O)_4C_{22}H_{45}\text{-n}$ |
| AII-33 | $COCH_2CO_2$ | $(C_2H_4O)_{6.18}C_{22}H_{45}\text{-n}$ |
| AII-34 | $COC_3H_6CO_2$ | $(C_2H_4O)_{6.18}C_{22}H_{45}\text{-n}$ |
| AII-35 | $COC_4H_8CO_2$ | $(C_2H_4O)_{6.18}C_{22}H_{45}\text{-n}$ |
| AII-36 | $COCH{=}CHCO_2$ | $(C_2H_4O)_{6.18}C_{22}H_{45}\text{-n}$ |
| AII-37 | $COCH_2OCH_2CO_2$ | $(C_2H_4O)_{6.18}C_{22}H_{45}\text{-n}$ |
| AII-38 | 1.2-$COC_6H_4CO_2$ | $(C_2H_4O)_{6.18}C_{22}H_{45}\text{-n}$ |
| AII-39 | 1.4-$COC_6H_4CO_2$ | $(C_2H_4O)_{6.18}C_{22}H_{45}\text{-n}$ |
| AII-40 | $COCH_2C(CH_3)_2CH_2CO_2$ | $(C_2H_4O)_{6.18}C_{22}H_{45}\text{-n}$ |
| AII-41 | $COC_2F_4CO_2$ | $(C_2H_4O)_{6.18}C_{22}H_{45}\text{-n}$ |

(A II)

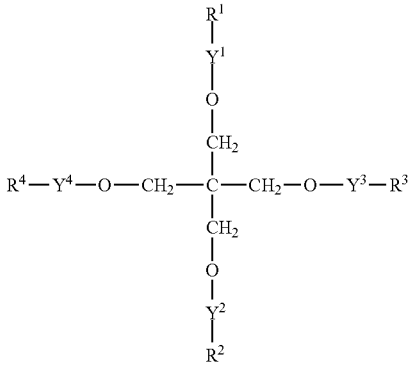

| Compound No. | $Y^1$=$Y^2$=$Y^3$=$Y^4$ | $R^1$=$R^2$=$R^3$=$R^4$ |
|---|---|---|
| AII-43 | 1.2-$COC_6F_4CO_2$ | $(C_2H_4O)_{6.18}C_{22}H_{45}\text{-n}$ |
| AII-44 | $COCH_2OCH_2CO_2$ | $(C_2H_4O)_{6.18}C_{22}H_{45}\text{-n}$ |
| AII-46 | $COCH_2OCH_2CO_2$ | $(C_2H_4O)_4COC_{21}H_{43}\text{-n}$ |
| AII-47 | $COC_2H_4CO_2$ | $(C_2H_4O)_{6.5}C_{22}H_{45}\text{-n}$ |
| AII-48 | $COC_2H_4CO_2$ | $(C_2H_4O)_{4.9}C_{22}H_{45}\text{-n}$ |
| AII-49 | $COC_2H_4CO_2$ | $(C_2H_4O)_{6.39}CH_2CH(C_7H_{15}\text{-n})C_9H_{19}\text{-n}$ |
| AII-50 | $COC_2H_4CO_2$ | $(C_2H_4O)_{6.2}CONHC_{18}H_{37}\text{-n}$ |
| AII-51 | $COC(CH_3)_2CO_2$ | $(C_2H_4O)_{6.5}C_{22}H_{45}\text{-n}$ |
| AII-52 | $COC(CH_3)_2CO_2$ | $(C_2H_4O)_{6.5}CH(C_6H_{13}\text{-n})C_9H_{19}\text{-n}$ |
| AII-53 | $COC(CH_3)_2CO_2$ | $(C_2H_4O)_4COC_{21}H_{43}\text{-n}$ |
| AII-54 | $COCH{=}CHCO_2$ | $(C_2H_4O)_{6.5}C_{22}H_{45}\text{-n}$ |
| AII-55 | $COCH{=}CHCO_2$ | $(C_2H_4O)_{6.5}C_{18}H_{37}\text{-n}$ |
| AII-56 | $COCH{=}CHCO_2$ | $(C_2H_4O)_4COC_{21}H_{43}\text{-n}$ |
| AII-57 | $COCH{=}CHCO_2$ | $(C_2H_4O)_{6.5}C_{22}H_{45}\text{-n}$ |
| AII-59 | $COCH_2NCH_3CO_2$ | $(C_2H_4O)_{6.5}C_{22}H_{45}\text{-n}$ |
| AII-60 | $CONHC_6H_{12}NHCO_2$ | $(C_2H_4O)_{6.5}C_{22}H_{45}\text{-n}$ |
| AII-61 | $CONHC_6H_{12}NHCO_2$ | $(C_2H_4O)_{6.55}C_{18}H_{37}\text{-n}$ |
| AII-62 | $CONHC_6H_{12}NHCO_2$ | $(C_2H_4O)_{6.5}C_{26}H_{53}\text{-n}$ |
| AII-63 | $CONHC_6H_{12}NHCO_2$ | $(C_2H_4O)_{6.5}CH_2CH(C_6H_{13}\text{-n})C_9H_{19}\text{-n}$ |
| AII-64 | $CONHC_6H_{12}NHCO_2$ | $(C_2H_4O)_4COC_{21}H_{43}\text{-n}$ |

(A II)

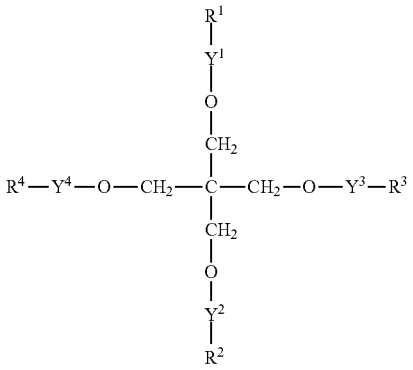

| Compound No. | $Y^1$=$Y^2$=$Y^3$=$Y^4$ | $R^1$=$R^2$=$R^3$=$R^4$ |
|---|---|---|
| AII-65 | $COC_2H_4CO_2$ | A: $(C_2H_4O)_{6.5}C_{22}H_{45}$-n<br>B: $(C_2H_4O)_{6.39}CH_2CH\{C_2H_4CH(CH_3)C_3H_7\text{-n}\}C_4H_8CH(CH_3)C_3H_7$-n<br>A:B = 0:100 |
| AII-66 | $COC_2H_4CO_2$ | A: $(C_2H_4O)_{6.5}C_{22}H_{45}$-n<br>B: $(C_2H_4O)_{6.39}CH_2CH\{C_2H_4CH(CH_3)C_3H_7\text{-n}\}C_4H_8CH(CH_3)C_3H_7$-n<br>A:B = 99:1 |
| AII-67 | $COC_2H_4CO_2$ | A: $(C_2H_4O)_{6.5}C_{22}H_{45}$-n<br>B: $(C_2H_4O)_{6.39}CH_2CH\{C_2H_4CH(CH_3)C_3H_7\text{-n}\}C_4H_8CH(CH_3)C_3H_7$-n<br>A:B = 95:5 |
| AII-68 | $COC_2H_4CO_2$ | A: $(C_2H_4O)_{6.5}C_{22}H_{45}$-n<br>B: $(C_2H_4O)_{6.39}CH_2CH\{C_2H_4CH(CH_3)C_3H_7\text{-n}\}C_4H_8CH(CH_3)C_3H_7$-n<br>A:B = 90:10 |
| AII-69 | $COC_2H_4CO_2$ | A: $(C_2H_4O)_{6.5}C_{22}H_{45}$-n<br>B: $(C_2H_4O)_{6.39}CH_2CH\{C_2H_4CH(CH_3)C_3H_7\text{-n}\}C_4H_8CH(CH_3)C_3H_7$-n<br>A:B = 80:20 |

(A II)

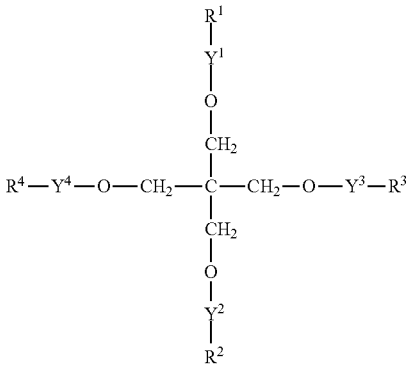

| Compound No. | $Y^1$=$Y^2$=$Y^3$=$Y^4$ | $R^1$=$R^2$=$R^3$=$R^4$ |
|---|---|---|
| AII-70 | $CONHCO_2$ | $(C_2H_4O)_{6.5}C_{22}H_{45}$-n |
| AII-71 | $CONHSO_3$ | $(C_2H_4O)_{6.5}C_{22}H_{45}$-n |
| AII-72 | $SO2NHCO_2$ | $(C_2H_4O)_{6.5}C_{22}H_{45}$-n |
| AII-74 | $COCO_2$ | $(C_2H_4O)_{6.5}C_{22}H_{45}$-n |
| AII-75 | $COC_2H_4CO_2$ | $(C_2H_4O)_{10.3}C_8H_{17}$-n |
| AII-76 | $COC_2H_4CO_2$ | $(C_2H_4O)_{19.7}C_8H_{17}$-n |
| AII-77 | $COC_2H_4CO_2$ | $(C_2H_4O)_{15.2}C_8H_{17}$-n |
| AII-78 | $COCH_2CO_2$ | $(C_2H_4O)_{15.2}C_8H_{17}$-n |
| AII-79 | $CONHCO_2$ | $(C_2H_4O)_{15.2}CH_2CF_2O(C_2F_4O)_2C_2F_5$-n |
| AII-80 | $CONHSO_3$ | $(C_2H_4O)_{15.2}CH_2CF_2O(C_2F_4O)_2C_2F_5$-n |
| AII-81 | $SO2NHCO_2$ | $(C_2H_4O)_{15.2}CH_2CF_2O(C_2F_4O)_2C_2F_5$-n |
| AII-83 | $COCO_2$ | $(C_2H_4O)_{15.2}CH_2CF_2O(C_2F_4O)_2C_2F_5$-n |

-continued (A II)

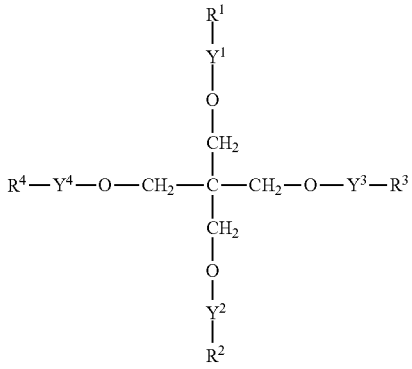

| Compound No. | $Y^1$=$Y^2$=$Y^3$=$Y^4$ | $R^1$=$R^2$=$R^3$=$R^4$ |
|---|---|---|
| AII-84 | $COC_2H_4CO_2$ | $(C_2H_4O)_{10.3}(SiMe_2O)_4SiMe_3$-n |
| AII-85 | $COCH_2CO_2$ | $(C_2H_4O)_{10.3}(SiMe_2O)_4SiMe_3$-n |
| AII-86 | $CONHCO_2$ | $(C_2H_4O)_{10.3}(SiMe_2O)_4SiMe_3$-n |
| AII-87 | $CONHSO_3$ | $(C_2H_4O)_{10.3}(SiMe_2O)_4SiMe_3$-n |
| AII-88 | $COC_2H_4CO_2$ | $(C_2H_4O)_{10.0}C_{18}H_{37}$-n |
| AII-89 | $COC_2H_4CO_2$ | $(C_2H_4O)_{10.0}C_{12}H_{25}$-n |
| AII-90 | $COC_2H_4CO_2$ | $(C_2H_4O)_{10.0}C_{22}H_{45}$-n |

(A III)

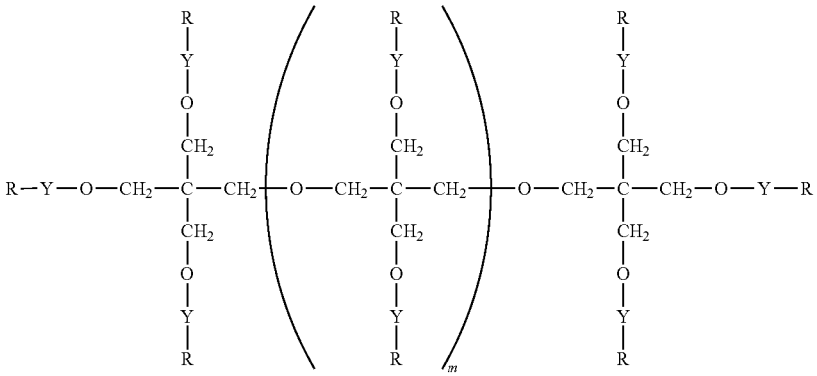

| Compound No. | m | Y | R |
|---|---|---|---|
| AIII-1 | 0 | $COC_2H_4CO_2$ | $(C_2H_4O)_{6.5}C_{22}H_{45}$-n |
| AIII-2 | 1 | $COC_2H_4CO_2$ | $(C_2H_4O)_{6.5}C_{22}H_{45}$-n |
| AIII-3 | 2 | $COC_2H_4CO_2$ | $(C_2H_4O)_{6.5}C_{22}H_{45}$-n |
| AIII-4 | 3 | $COC_2H_4CO_2$ | $(C_2H_4O)_{6.5}C_{22}H_{45}$-n |
| AIII-5 | 0 | $COC_2H_4CO_2$ | $(C_2H_4O)_4COC_{21}H_{43}$-n |
| AIII-6 | 0 | $COC_2H_4CO_2$ | A: $(C_2H_4O)_{6.5}C_{22}H_{45}$-n<br>B: $(C_2H_4O)_{6.5}CH\{C_2H_4CH(CH_3)C_3H_7\text{-n}\}C_4H_8CH(CH_3)C_3H_7$-n<br>A:B = 95:5 |
| AIII-7 | 2 | $COCH_2OCH_2CO_2$ | $(C_2H_4O)_{6.5}C_{22}H_{45}$-n |
| AIII-8 | 0 | $CONHC_6H_{12}NHCO_2$ | $(C_2H_4O)_{6.5}C_{22}H_{45}$-n |
| AIII-9 | 3 | $CONHC_6H_{12}NHCO_2$ | $(C_2H_4O)_{6.5}C_{20}H_{41}$-n |
| AIII-10 | 1 | $CONHC_6H_{12}NHCO_2$ | $(C_2H_4O)_{6.5}C_{18}H_{37}$-n |
| AIII-11 | 1 | $CONHC_6H_{12}NHCO_2$ | $(C_2H_4O)_4C_{18}H_{37}$-n |
| AIII-12 | 2 | $CONHC_6H_{12}NHCO_2$ | $(C_2H_4O)_{6.5}C_{16}H_{33}$-n |
| AIII-13 | 2 | $CONHC_6H_{12}NHCO_2$ | $(C_2H_4O)_{6.5}C_{14}H_{29}$-n |
| AIII-14 | 3 | $CONHC_6H_{12}NHCO_2$ | $(C_2H_4O)_4C_{14}H_{29}$-n |
| AIII-15 | 3 | $CONHC_6H_{12}NHCO_2$ | $(C_2H_4O)_{6.5}C_{12}H_{25}$-n |
| AIII-16 | 3 | $COCH_2CO_2$ | $(C_2H_4O)_{6.5}C_{22}H_{45}$-n |
| AIII-17 | 3 | $CONHCO_2$ | $(C_2H_4O)_{6.5}C_{22}H_{45}$-n |
| AIII-18 | 3 | $CONHSO_3$ | $(C_2H_4O)_{6.5}C_{22}H_{45}$-n |
| AIII-19 | 3 | $SO_2NHCO_2$ | $(C_2H_4O)_{6.5}C_{22}H_{45}$-n |

(A III)

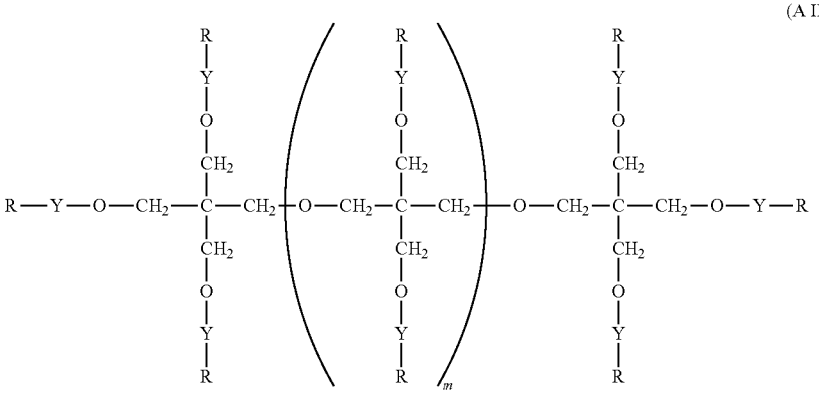

| Compound No. | m | Y | R |
|---|---|---|---|
| AIII-21 | 3 | $COCO_2$ | $(C_2H_4O)_{6.5}C_{22}H_{45}$-n |
| AIII-22 | 3 | $COC_2H_4CO_2$ | $(C_2H_4O)_{10.3}C_{22}H_{45}$-n |
| AIII-23 | 3 | $COC_2H_4CO_2$ | $(C_2H_4O)_{19.7}C_{22}H_{45}$-n |
| AIII-24 | 3 | $COC_2H_4CO_2$ | $(C_2H_4O)_{15.2}C_{22}H_{45}$-n |
| AIII-25 | 3 | $COC_2H_4CO_2$ | $(C_2H_4O)_{10.3}C_8H_{17}$-n |
| AIII-26 | 3 | $COC_2H_4CO_2$ | $(C_2H_4O)_{19.7}C_8H_{17}$-n |
| AIII-27 | 3 | $COC_2H_4CO_2$ | $(C_2H_4O)_{15.2}C_8H_{17}$-n |
| AIII-28 | 3 | $COCH_2CO_2$ | $(C_2H_4O)_{15.2}C_8H_{17}$-n |

-continued (A III)

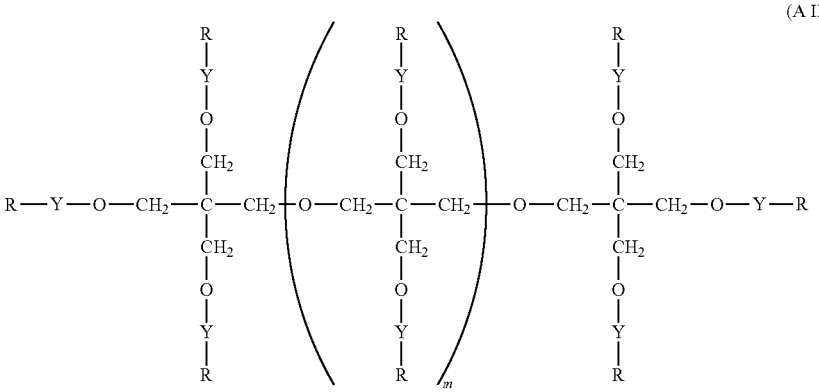

| Compound No. | m | Y | R |
|---|---|---|---|
| AIII-29 | 3 | $CONHCO_2$ | $(C_2H_4O)_{15.2}CH_2CF_2O(C_2F_4O)_2C_2F_5$-n |
| AIII-30 | 3 | $CONHSO_3$ | $(C_2H_4O)_{15.2}CH_2CF_2O(C_2F_4O)_2C_2F_5$-n |
| AIII-31 | 3 | SO2NHCO$_2$ | $(C_2H_4O)_{15.2}CH_2CF_2O(C_2F_4O)_2C_2F_5$-n |
| AIII-33 | 3 | $COCO_2$ | $(C_2H_4O)_{15.2}CH_2CF_2O(C_2F_4O)_2C_2F_5$-n |
| AIII-34 | 3 | $COC_2H_4CO_2$ | $(C_2H_4O)_{10.3}(SiMe_2O)_4SiMe_3$-n |
| AIII-35 | 3 | $COCH_2CO_2$ | $(C_2H_4O)_{10.3}(SiMe_2O)_4SiMe_3$-n |
| AIII-36 | 3 | $CONHCO_2$ | $(C_2H_4O)_{10.3}(SiMe_2O)_4SiMe_3$-n |
| AIII-37 | 3 | $CONHSO_3$ | $(C_2H_4O)_{10.3}(SiMe_2O)_4SiMe_3$-n |

(A IV)

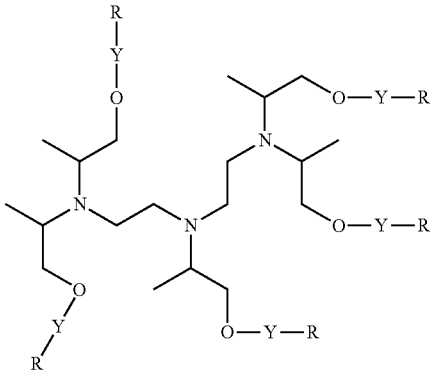

| Compound No. | Y | R |
|---|---|---|
| AIV-1 | $COC_2H_4CO$ | $O(C_2H_4O)_{10}C_{18}H_{37}$ |
| AIV-2 | $COC_2H_4CO$ | $O(C_2H_4O)_8C_{16}H_{33}$ |
| AIV-3 | $COC_2H_4CO$ | $O(C_2H_4O)_{14}C_{14}H_{29}$ |
| AIV-4 | $COCH_2CO$ | $O(SiMe_2O)_6SiMe_3$ |
| AIV-5 | $COCH_2N(CH_3)CO$ | $O(C_2H_4O)_{10}C_{12}H_{35}$ |
| AIV-6 | $COC_2H_4CO$ | $O(C_2H_4O)_3C_{18}H_{37}$ |
| AIV-7 | COCH═CHCO | $O(C_2H_4O)_{15.5}C_{19}H_{39}$ |
| AIV-8 | $COC_2H_4CO$ | $OCH_2CF_2O(C_2F_4O)_3C_4F_9$ |
| AIV-9 | COCO | $O(C_2H_4O)_4C_{18}H_{37}$ |
| AIV-10 | $COC_2H_4CO$ | $O(C_2H_4O)_{6.65}C_{22}H_{45}$ |

(A V)

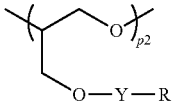

| Compound No. | P2 | Y | R |
|---|---|---|---|
| AV-1 | 4 | $COC_2H_4CO$ | $O(C_2H_4O)_{6.65}C_{22}H_{45}$ |
| AV-2 | 8 | $COC_2H_4CO$ | $O(C_2H_4O)_8C_8H_{17}$ |
| AV-3 | 20 | $COC_2H_4CO$ | $O(C_2H_4O)_6C_{21}H_{43}$ |
| AV-4 | 6.7 | $COC_2H_4CO$ | $O(SiMe_2O)_6SiMe_3$ |
| AV-5 | 9.6 | $COCH_2N(CH_3)CO$ | $O(C_2H_4O)_{18}C_{22}H_{45}$ |
| AV-6 | 15 | $COC_2H_4CO$ | $O(C_2H_4O)_{8.6}C_{15}H_{31}$ |
| AV-7 | 6.8 | $COC_2H_4CO$ | $O(C_2H_4O)_{15.5}C_{12}H_{25}$ |
| AV-8 | 2 | $COC_2H_4CO$ | $OCH_2CF_2O(C_2F_4O)_3C_4F_9$ |

(A VI)

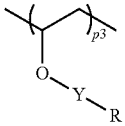

| Compound No. | p3 | Y | R |
|---|---|---|---|
| AVI-1 | 3.5 | $COC_2H_4CO$ | $O(C_2H_4O)_{12}C_{18}H_{37}$ |
| AVI-2 | 5.8 | $COC_2H_4CO$ | $O(C_2H_4O)_3C_{12}H_{25}$ |
| AVI-3 | 14.1 | $COC_2H_4CO$ | $O(C_2H_4O)_3C_{19}H_{39}$ |
| AVI-4 | 3.5 | $COC_2H_4CO$ | $O(SiMe_2O)_6SiMe_3$ |
| AVI-5 | 6.2 | $COCH_2N(CH_3)CO$ | $O(C_2H_4O)_{15}C_{10}H_{21}$ |
| AVI-6 | 3.7 | $COC_2H_4CO$ | $O(C_2H_4O)_{8.6}HC_{25}H_{51}$ |
| AVI-7 | 8.5 | $COC_2H_4CO$ | $O(C_2H_4O)_{15.5}C_{16}H_{33}$ |
| AVI-8 | 11.8 | $COC_2H_4CO$ | $OCH_2CF_2O(C_2F_4O)_3C_4F_9$ |

(VII)

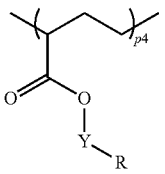

| Compound No. | p4 | Y | R |
|---|---|---|---|
| AVII-1 | 6 | $COC_2H_4CO$ | $O(C_2H_4O)_{10}C_{20}H_{41}$ |
| AVII-2 | 5 | $COC_2H_4CO$ | $O(C_2H_4O)_3C_8H_{17}$ |
| AVII-3 | 9.3 | $COC_2H_4CO$ | $O(C_2H_4O)_{13}C_{18}H_{37}$ |
| AVII-4 | 13 | $C_2H_4OCOC_2H_4CO$ | $O(SiMe_2O)_6SiMe_3$ |
| AVII-5 | 8 | $COCH_2N(CH_3)CO$ | $O(C_2H_4O)_5C_{12}H_{25}$ |
| AVII-6 | 5 | $COC_2H_4CO$ | $O(C_2H_4O)_{8.6}H$ |
| AVII-7 | 6 | $COC_2H_4CO$ | $O(C_2H_4O)_{15.5}C_{22}H_{45}$ |
| AVII-8 | 3 | $COC_2H_4CO$ | $OCH_2CF_2O(C_2F_4O)_3C_4F_9$ |
| AVII-9 | 12 | $COC_2H_4CO$ | $O(C_2H_4O)_7C_{22}H_{45}$ |
| AVII-10 | 5 | $C_2H_4OCOC_2H_4CO$ | $O(C_2H_4O)_{18.9}C_{22}H_{45}$ |
| AVII-11 | 20 | $C_2H_4OCOC_3H_6CO$ | $O(C_2H_4O)_{8.6}C_{22}H_{45}$ |
| AVII-12 | 8 | COCH═CHCO | $O(C_2H_4O)_{8.6}C_{22}H_{45}$ |
| AVII-13 | 4 | $COCH_2OCH_2CO$ | $O(C_2H_4O)_{8.6}C_{22}H_{45}$ |

(VIII)

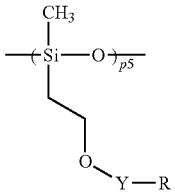

| Compound No. | P5 | Y | R |
|---|---|---|---|
| AVIII-1 | 22.5 | $COC_2H_4CO$ | $O(C_2H_4O)_{4.7}C_{12}H_{25}$ |
| AVIII-2 | 22.5 | $COC_2H_4CO$ | $O(C_2H_4O)_{7.5}C_{18}H_{37}$ |
| AVIII-3 | 22.5 | $COC_2H_4CO$ | $O(C_2H_4O)_{10.4}C_{22}H_{45}$ |
| AVIII-4 | 22.5 | $COC_2H_4CO$ | $O(SiMe_2O)_6SiMe_3$ |

Examples of the compounds represented by the formulae (AIX), (AXa) and (AXb) are given below, but it should not be construed that the invention is limited thereto.

(AIX)

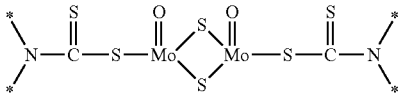

(AXa)

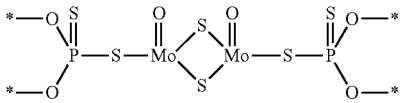

(AXb)

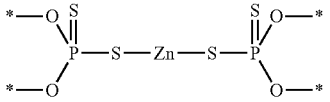

The partial structures corresponding to * in the foregoing formulae are expressed in terms of —Y—R.

| Compound No. | Structure of A | Y | R |
|---|---|---|---|
| AIX-1 | AIX | $COC_2H_4CO$ | $O(C_2H_4O)_{12}C_{18}H_{37}$ |
| AIX-2 | AIX | $COC_2H_4CO$ | $O(C_2H_4O)_3C_{12}H_{25}$ |
| AIX-3 | AIX | $COC_2H_4CO$ | $O(C_2H_4O)_3C_{19}H_{39}$ |
| AIXa-1 | AXa | $COC_2H_4CO$ | $O(SiMe_2O)_6SiMe_3$ |
| AIXa-2 | AXa | $COCH_2N(CH_3)CO$ | $O(C_2H_4O)_{15}C_{10}H_{21}$ |
| AIXa-3 | AXa | $COC_2H_4CO$ | $O(C_2H_4O)_4C_{12}H_{25}$ |
| AIXb-1 | AXb | $COC_2H_4CO$ | $O(C_2H_4O)_{5.5}C_{16}H_{33}$ |
| AIXb-2 | AXb | $COC_2H_4CO$ | $OCH_2CF_2O(C_2F_4O)_3C_4F_9$ |

Examples of the compound represented by the formula (Y) are given below, but it should not be construed that the invention is limited thereto.

Formula 35

R—Y—R (Y)

| Compound No. | Y | R |
|---|---|---|
| Y-1 | $COC_2H_4CO$ | $O(C_2H_4O)_6C_{18}H_{37}$ |
| Y-2 | $COC_2H_4CO$ | $O(C_2H_4O)_8C_{16}H_{33}$ |
| Y-3 | $COC_2H_4CO$ | $O(C_2H_4O)_{14}C_{14}H_{29}$ |
| Y-4 | $COCH_2CO$ | $O(SiMe_2O)_6SiMe_3$ |
| Y-5 | $COCH_2N(CH_3)CO$ | $O(C_2H_4O)_{10}C_{16}H_{33}$ |
| Y-6 | $COC_2H_4CO$ | $O(C_2H_4O)_3C_{18}H_{37}$ |
| Y-7 | COCH═CHCO | $O(C_2H_4O)_{15.5}C_{19}H_{39}$ |
| Y-8 | $COC_2F_4CO$ | $OCH_2CF_2O(C_2F_4O)_3C_4F_9$ |
| Y-9 | COCO | $O(C_2H_4O)_4C_{18}H_{37}$ |
| Y-10 | $COC_2H_4CO$ | $O(C_2H_4O)_{10.0}C_{18}H_{37}$ |

The compounds represented by the foregoing formulae (Z) and (Y) can be produced by utilizing various organic synthesis reactions. For example, in the formula (Z), the compound in which A is a group represented by any of the formulae (AI) to (AIII) is basically formed through connection between a polyhydric alcohol such as glycerol, pentaerythritol, etc. and a side chain structure, but in general, an esterification reaction is frequently adopted. For example, the compound can be produced by a condensation reaction between a polyhydric alcohol and an acid chloride of a side chain carboxylic acid, an isocyanate having a side chain structure or an alkyl halide having a side chain structure, or a combination of various reactions of open-ring type esterification of a polyhydric alcohol and succinic anhydride or Meldrum's acid to form a carboxylic acid and esterification of an acid chloride thereof and an alcohol having a side chain structure, or the like. Moreover, the side chain structure portion can be easily produced by using a long-chain alkyl alcohol or an alcohol obtained by adding an ethylene oxide gas to a carboxylic acid, or further using succinic acid, Meldrum's acid or a halocarboxylic acid.

The smaller the viscosity-pressure modulus of the compound represented by the foregoing formula (Z), the smaller the viscosity under a high pressure is relatively. The viscosity-pressure modulus of the foregoing compound at 40° C. is preferably not more than 20 $GPa^{-1}$, more preferably not more than 15 $GPa^{-1}$, and especially preferably not more than 10 $GPa^{-1}$. Though it is preferable that the viscosity-pressure modulus is small as far as possible, it has been elucidated that the viscosity-pressure modulus is correlative to the free volume of the molecule, and it may be conjectured that a lower limit value of the viscosity-pressure modulus of the organic compound under the foregoing condition is about 5 $GPa^{-1}$.

The compounds represented by the following formula (Z1) have common structure-characteristics with the compounds represented by the formula (Z) in terms of some physical properties described below.

$$A\text{-}\{(D)\text{-}(E)_q\text{-}(B)_m\text{—}Z^2\text{—}R\}_p \quad (Z1)$$

A represents a p-valent alcoholic residue having p number of sides chains. p represents an integer of 2 or more. Examples of A include pentaerythritol, glycerol, oligo-pentaerythritol, xylitol, sorbitol, trimethylolpropane, ditrimethylpropane, neopentyl glycol and polyglycerin.

D represents carbonyl or sulfonyl respectively.

E represents a substituted or non-substituted alkyl group (preferably $C_{1-10}$ alkyl group such as methylene, ethylene, propylene, butylene, pentylene, hexylene, heptylene and octylene), cycloalkylene group (preferably $C_3$-$C_8$ cycloalkylene group such as cyclopropylene, cyclobutylene, cyclopentylene or cyclohexylene), alkenylene group (preferably $C_2$-$C_7$ alkenylene group such as ethene, propene, butene or pentene), alkynylene group (preferably $C_2$-$C_8$ alkynylene group such as ethyne, propyne, butyne or pentyne) or arylene group (preferably $C_6$-$C_{10}$ arylene group; such as phenylene), a divalent heterocyclic aromatic ring group or heterocyclic non-aromatic ring group, a divalent group selected among a substituted or non-substituted imino group, an oxy group, a sulfide group, a sulfenyl group, a sulfonyl group, a phosphoryl group and an alkyl-substituted silyl group, or a divalent group composed of a combination of two or more of these groups.

q represents an integer of equal to or more than 0, and when q is equal to or more than 2, they may be same or different from each other.

B represents a substituted or non-substituted alkyleneoxy group such as methyleneoxy, ethyleneoxy, propyleneoxy and butyleneoxy, and plural linking B may be same or different from each other. Examples of the substituent include halogen atoms (for example, fluorine and chlorine atoms).

m represents a natural number of equal to or more than 1.

R represents a substituted or non-substituted $C_8$ or longer alkyl group, a perfluoroalkyl group or a trialkylsilyl group. Preferable examples thereof are same as those among the organic groups represented respectively by $R^1$-$R^4$, $R^{11}$, $R^{12}$ and $R^{21}$-$R^{23}$ in the formula (AI)-(AIII).

$Z^2$ represents a single bond or a divalent connecting group composed of a combination of one or more members selected among a carbonyl group, a sulfonyl group, a phosphoryl group, an oxy group, a substituted or non-substituted amino group, a thio group, an alkynylene group, an alkenylene group, an arylene group.

2. Formation of a Coating Film in Sliding Part:

When the compound of the foregoing formula (Z) is dispersed in an oily medium, it forms a coating film in the process in which it is gradually segregated at a high load under a high pressure in a high shear field due to a characteristic feature on the common chemical structure and made high in a concentration, and as compared with the conventional raw materials, it exhibits relatively low friction properties in an elastic fluid lubrication region because of a low viscosity-pressure modulus (low $\alpha$). In addition, for the same reason (low $\alpha$), it may be conjectured that such a compound has a wide pressure range for keeping a visco-elastic film and can be prevented from occurrence of the contact with a sliding surface, and as a result, wear resistance is realized. The composition of the invention is excellent in film forming properties for forming a film on the surface, in particular, two sliding surfaces. An example of the film forming method utilizing the composition of the invention is a coating film forming method including disposing a composition between two surfaces and sliding the two surfaces, thereby forming a coating film composed of the foregoing composition on at least one of the surfaces. It is preferable to slide two surfaces while changing a temperature of the foregoing composition within a temperature range of from $T_1$ to $T_2$ satisfying ($T_1<T_x<T_2$) in relation to its clearing point $T_x$ (° C.), thereby forming a coating film composed of the foregoing composition on at least one of the surfaces. For example, the composition is regulated at a temperature $T_1$ which is lower than by from about 15 to 5° C. than its clearing point $T_x$; and subsequently, the temperature is gradually increased while sliding the two surfaces, thereby regulating it at a temperature $T_2$ which is higher by from about 3 to 10° C. than T. In this way, by forming a film at the sliding interface, an efficiently thick coating film is obtained, a low coefficient of friction is obtained, and wear resistance is obtained; and thus, such is preferable.

As for this phenomenon, the present inventor spectrally observed a neighborhood of a point-contacting portion of an instrument named a point contact EHL evaluation apparatus for evaluating an elastic fluid lubrication region in the field of tribology and succeeded in quantitatively grasping a change of material concentration at a high load in a high shear field. Specifically, the observation was carried out in the following manner. First of all, the foregoing compound is dispersed in an oily medium to prepare a sample. Separately, a rotating steel ball is placed on a diamond (hard plane) plate while making its rotation axis parallel, and a load is applied to the axis, thereby bringing them into press contact with each other. The prepared sample is fed and flown in a gap between the rotating steel ball and the diamond plate and its neighborhood.

Though a Newtonian ring which is an optical interference pattern is formed in a portion where the steel ball comes into point contact with the diamond plate, by irradiating infrared rays from the opposite side to the steel ball via the diamond plate and reflecting them on the steel ball, an IR spectrum of a thin film of the sample in the vicinity of the Newtonian ring can be measured. This method is an analysis method of a minute portion in the tribology field described in Junichi ISHIKAWA, Hidetaka NANAO, Ichiro MINAMI and Shigeyuki MORI, *Preprint of the International Tribology Conference* (Tottori, 2004-11), page 243 and is not special. However, according to this method, by changing a rotation speed of the steel ball, a load to the rotation axis and a temperature of the sample, the behavior under various elastic fluid lubrication conditions can be observed on the spot, and this method is an effective method.

When a mineral oil or a poly-$\alpha$-olefin is used as the oily medium which is used for the preparation of a sample used for the measurement, since such a compound is a hydrocarbon, it is free from characteristic absorption other than C—C and C—H. In consequence, when the foregoing compound has a functional group exhibiting a distinct high-intensity characteristic absorption band, such as a carbonyl group of an ester bond, a cyano group, an ethynyl group, a perfluoroalkyl group, a siloxane group, etc., a change in the concentration can be quantitatively detected from the intensity of the characteristic absorption band.

As a result of observation using the foregoing apparatus, it was noted that in a so-called Hertzian area under a high pressure in a high shear field, where a Newtonian ring is formed, the foregoing compound is gradually segregated in a form of a candle flame formed by partition of a flow of the sample in, for example, a region of from 20 to 400 μm backward. In many cases, the concentration becomes substantially constant for about 5 minutes to 2 hours under a condition at a measurement temperature of 40° C. at a linear velocity of 0.15 m/sec under a Hertzian pressure of 0.3 GPa, an aspect of which is, however, different depending upon a condition such as a temperature, etc.

The foregoing point contact EHL evaluation apparatus is a model of the Hertzian contact area under a high-pressure and high-shear condition, namely a true contact site, and the actual friction contact area is an area where such true contact areas are crowded. Therefore, it may be considered that the composition of the invention containing the foregoing compound in the oily medium accumulates the foregoing compound in the vicinity of a number of true contact areas of such a friction contact area.

In consequence, the foregoing high-viscosity compound is segregated in a sliding part by the oily medium, and a smooth film is formed by a high shear force, whereby its gap becomes narrower than the usual. Therefore, such a low-viscosity oily medium is formed into a thinner film, thereby contributing to low friction of fluid lubrication, and in a fluid lubrication region, a driving machine thereof drives with high efficiency from the energy standpoint. And in a high-load and high-pressure field, it is probable that the foregoing compound is gradually accumulated before the low-viscosity oily medium is broken from the elasto-plastic body film, and therefore, in the case where the viscosity-pressure modulus $\alpha$ of the foregoing compound having been dispersed in the low-viscosity oily medium is small, the viscosity becomes relatively low, and in the contact site, a low coefficient of friction is revealed by a low-viscosity elastic fluid lubricating film made of the subject compound. Under such a high-load condition, the contact area is increased due to an elastic strain of the interface raw material, and a pressure in that portion is lowered. Therefore, a much more mild condition is realized; and even under a condition under which current lubricating oils already come into a boundary lubrication region, a favorable lubrication region where the both interfaces do not substantially come into contact with each other due to the low-viscosity elastic fluid lubricating film of the foregoing compound is kept. As a result, fuel saving is achieved.

Recent fuel-saving type engine oils containing a molybdenum based organometallic complex exhibit low viscosity such that a viscosity at 40° C. is not more than 30 mPa·s and are marketed as a multi-grade low-viscosity oil such as 0 W-20 or the like. However, as described previously, in the composition of the invention, in view of the fact that an elastic fluid lubricating film is formed before the low-viscosity based oil is broken, the foregoing compound is able to reveal the same effects of low friction and wear resistance under a high-pressure and high-shear condition at a high temperature. Moreover, substantial low viscosity is revealed by the elastic fluid film even under such a severe condition, and the low-viscosity base oil preferentially functions under a mild condition; and therefore, an increase of the viscosity at middle to low temperatures to be caused due to a viscosity index improver as in current lubricants does not occur.

Moreover, since the composition of the invention does not basically utilize a reaction with the interface, the film forming properties thereof are not restricted by the material quality of the interface. In addition, since the foregoing compound is basically strong against heat and chemically stable, it is relatively conspicuously high in durability. Moreover, the friction portion disappears under a high-load condition, and when the temperature is high, the compound of the invention is again dispersed in the oily medium, whereby the total amount is always kept. When needed, a necessary amount of the compound is accumulated to reveal low friction, and when not needed, the compound is again dispersed; and thus, the composition of the invention is an extremely intelligent lubricant composition.

On the other hand, in the case where the foregoing compound exhibits high $\alpha$, the composition effectively functions as a traction oil which is used in a site of, for example, transmitting a power by friction of a clutch, etc. In conventional high-function traction oils, hydrocarbons having an incorruptible structure, all of which have a high viscosity-pressure modulus, have been used; however, a defect thereof resides in a point that an atmospheric viscosity of the oil itself must become relatively high. This matter decreases a driving efficiency in a normal state. However, a composition in which a raw material having a high viscosity-pressure modulus among the foregoing compounds is dispersed in a low-viscosity oily medium enables one to make both fuel consumption efficiency and effective transmission of a power compatible with each other. The low-viscosity oily medium occupying the majority of the transmission oil is able to effectively reduce a friction loss due to viscosity in a region other than a driving power transmitting portion. Since the material capable of revealing a high coefficient of friction is accumulated only in a contacting portion, it is possible to reveal various combinations of an oily medium with physical properties of the compound of the invention, and it is possible to inexpensively provide a combination satisfying many requirements of a transmission.

3. Oily Medium:

Next, the oily medium constituting the composition of the invention is described. The "oily medium" as referred to in the invention means all of media generally called "oil". However, it is not required that the medium is liquid at room temperature or a temperature at which it is used, and in addition to liquids, materials in any form including a solid, a gel, etc. can be used. The oily medium which is utilized in the invention is not particularly limited and can be selected among various oils depending upon an application. More specifically, the oily medium can be selected among various oils, for example, mineral oils to be used as a base oil of lubricating oils or animal or vegetable fat and oil compounds including cooking oils; various chemical synthetic oils such as polyolefin oils, alkylbenzene oils, alkylnaphthalene oils, biphenyl oils, diphenylalkane oils, di(alkylphenyl)alkane oils, ester oils, polyglycol oils, polyphenyl ether oils, fluorocarbon compounds (for example, perfluoro polyethers, fluorinated polyolefins, etc.), silicone oils, ion fluids, etc.; and the like, In an embodiment in which the composition of the invention is used as a substitute of the lubricating oil, mineral oils, polyolefin oils and silicone oils are preferably used from the standpoint of a frictional characteristic.

The respective oily media are hereunder described in detail.

As the mineral oil, mineral oils obtained by a method which is usually adopted in a lubricating oil manufacturing process in the petroleum refining industry can be utilized. More specifically, paraffin based, naphthene based or other based mineral oils obtained by refining a lubricating oil fraction obtained by subjecting a crude oil to atmospheric distillation and vacuum distillation by properly combining one or two or more techniques selected among solvent deasphalting, solvent extraction, hydrocracking, solvent dewaxing, catalytic dewaxing, hydrogenation refining, sulfuric acid washing, clay treatment, etc. can be used.

Moreover, as the fat and oil, for example, beef tallow, lard, sunflower oil, soybean oil, rapeseed oil, rice-bran oil, coconut oil, palm oil, palm kernel oil and hydrogenated products thereof, etc. can be used.

As the biodegradable oil, for example, various biodegradable vegetable oils extracted from fruits, seeds or the like of plants, such as rapeseed oil, sunflower oil, soybean oil, etc. or synthetic oils can be utilized. Moreover, polyol ester oils disclosed in JP-A-6-1989 are suitably used. Even among synthetic oils, those exhibiting biodegradability such that a biodegradation rate after a lapse of 21 days is in general 67% or more (preferably 80% or more) in conformity with a method stipulated in the CEC (Coordinating European Council) Standards, L-33-T82 as an evaluation method of biodegradability, can be utilized as the biodegradable oil.

Moreover, it is preferable that the polyolefin oil is selected among those obtained by polymerizing one or two or more olefins having 2 to 12 carbon atoms. Moreover, those obtained by polymerizing one or two or more members of ethylene, propylene, 1-butene, 2-butene, isobutene and a linear terminal olefin (hereinafter referred to as "α-olefin") having from 5 to 12 carbon atoms are more preferable.

Of these, a copolymer of ethylene and propylene; a copolymer of ethylene and an α-olefin having from 5 to 12 carbon atoms; and polybutene, polyisobutene or a polymer of an α-olefin having from 5 to 12 carbon atoms are preferable; and a copolymer of ethylene and an α-olefin having from 5 to 12 carbon atoms and a polymer of an α-olefin having from 5 to 12 carbon atoms are more preferable. In this specification, the "copolymer of ethylene and an α-olefin having from 5 to 12 carbon atoms" refers to a copolymer obtained by polymerizing ethylene and one or two or more α-olefins having from 5 to 12 carbon atoms; and the "polymer of an α-olefin having from 5 to 12 carbon atoms" refers to a homopolymer obtained by polymerizing one α-olefin having from 5 to 12 carbon atoms or a copolymer obtained by polymerizing two or more α-olefins having from 5 to 12 carbon atoms.

An average molecular weight of each of the foregoing copolymer of ethylene and an α-olefin having from 5 to 12 carbon atoms and polymer of an α-olefin having from 5 to 12 carbon atoms is preferably from 500 to 4,000.

Moreover, the silicone oil can be selected among various organic polysiloxanes. Examples of the organic polysiloxane which can be used as the silicone oil include a polymer having a repeating unit represented by the following general formula:

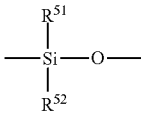

(in the formula, each of $R^{51}$ and $R^{52}$ represents an alkyl group, an aryl group or an aralkyl group, and $R^1$ and $R^2$ may be the same as or different from each other). The organic polysiloxane may be a so-called homopolymer type organic polysiloxane composed of only the subject repeating unit or may be a random type, block type or graft type organic polysiloxane composed of a combination of two or more of these repeating units. The silicone oil is preferably selected among linear polysiloxanes which are liquid or pasty at ordinary temperature, for example, methyl polysiloxane, methyl phenyl polysiloxane, ethyl polysiloxane, ethyl methyl polysiloxane, ethyl phenyl polysiloxane, hydroxymethyl polysiloxane and alkyl polydimethylsiloxanes; cyclic polysiloxanes, for example, octamethyl cyclopentasiloxane and decamethyl cyclopentasiloxane; and mixtures of these compounds.

The perfluoro polyether oil can be selected among compounds obtained by substituting a hydrogen atom of an aliphatic hydrocarbon polyether with a fluorine atom. Examples of such a perfluoro polyether oil include side chain-containing perfluoro polyethers represented by any of following formulae (Z) and (XI); and linear perfluoro polyethers represented by any of following formulae (XII) to (XIV). These compounds can be used singly or in admixture of two or more kinds thereof. In following formulae, each of m and n represents an integer.

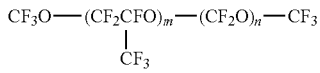

(X) m/n > 40

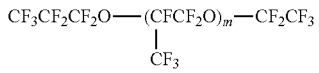

(XI)

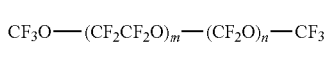

(XII) m/n < 1

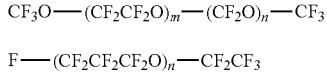

(XIII) m/n > 1

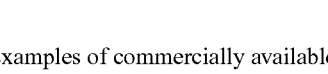

(XIV)

Examples of commercially available products of the foregoing formula (Z) include FOMBLIN Y (a trade name of Montedison); examples of commercially available products of (XI) include KRYTOX (a trade name of Du Pont) and BARRIERTA J OIL (a trade name of Kluber Inc.); examples of commercially available products of (XII) include FOMBLIN Z (a trade name of Montedison); examples of commercially available products of (XIII) include FOMBLIN M (a trade name of Montedison); and examples of commercially available products of (XIV) include DEMNUM (a trade name of Daikin Industries, Ltd,), etc.

The aromatic ester oil is preferably selected among trimellitic acid ester oils represented by the following general formula (XV).

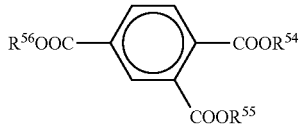

(XV)

In the formula, each of $R^{54}$, $R^{55}$ and $R^{56}$ represents a hydrocarbon group having from 6 to 10 carbon atoms, and $R^{54}$, $R^{55}$ and $R^{56}$ may be the same as or different from each other. In this connection, the "hydrocarbon group" means a saturated or unsaturated, linear or branched alkyl group.

Moreover, the aromatic ester oil is preferably selected among pyromellitic acid ester oils represented by the following general formula (XVI).

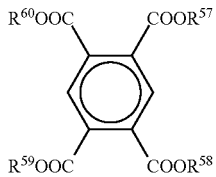

(XVI)

In the formula, each of $R^{57}$, $R^{58}$, $R^{59}$ and $R^{60}$ represents a hydrocarbon group having from 6 to 15 carbon atoms, and $R^{57}$, $R^{58}$, $R^{59}$ and $R^{60}$ may be the same as or different from each other. In this connection, the "hydrocarbon group" means a saturated or unsaturated, linear or branched alkyl group.

As the base oil with excellent heat resistance, though there are known a polyphenyl ether oil, a silicone oil, a fluorocarbon oil and the like, a polyphenyl ether oil, a fluorocarbon oil and a silicone oil are expensive, and a fluorocarbon oil and a silicone oil are generally poor in lubricating properties. On the other hand, the foregoing aromatic ester oil such as a trimellitic acid ester oil and pyromellitic acid ester oil has excellent characteristics in heat resistance, oxidation resistance and wear resistance. In particular, since the aromatic ester oil represented by the foregoing general formula (XV) or (XVI) is low in a pour point and high in a viscosity index, it is suitably used for rolling bearings for automotive electrical equipment auxiliary device, requiring a use environment of from a very low temperature to a high temperature. The aromatic ester oil is inexpensive and easily available.

As such a trimellitic acid ester, "TRIMEX T-08" and "TRIMEX N-08", all of which are manufactured by Kao Corporation; "ADEKA PROVER T-45", "ADEKA PROVER T-90" and "ADEKA PROVER PT-50", all of which are manufactured by Denka Corporation; "UNIQEMA EMKARATE 8130", "UNIQEMA EMKARATE 9130" and "UNIQEMA EMKARATE 1320"; and the like are available from the market. Moreover, as the pyromellitic acid ester, "ADEKA PROVER T-45", "ADEKA PROVER LX-1891" and "ADEKA PROVER LX-1892", all of which are manufactured by Denka Corporation; "BISOLUBETOPM", manufactured by Cognis; and the like are available from the market. These are low in a pour point and can be suitably used in the invention.

Diphenyl ether oils represented by following formulae are also preferable. By using such a diphenyl ether oil, it is possible to prepare a lubricant composition having excellent heat resistance and durability (for example, excellent lubricating properties can be kept over a long period of time even at a high temperature exceeding 160° C.). In particular, it can be suitably used in a site to be used at a high temperature and a high speed, such as components of automotive electrical equipment, automotive engine auxiliary devices, etc.

(XVII)

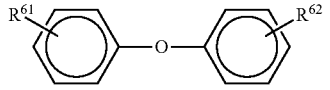

(XVIII)

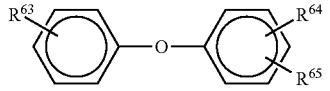

In the foregoing formulae, $R^{61}$ and $R^{62}$ may be the same as or different from each other and each represents a linear or branched perfluoroalkyl group or a partial substitute thereof. The partial substitute of a perfluoroalkyl group as referred to herein means those in which a part of fluorine atoms or hydrogen atoms is substituted with a substituent such as a halogen atom such as a chlorine atom, a bromine atom, an iodine atom, etc., a hydroxyl group, a thiol group, an alkoxy group, an ether group, an amino group, a nitrile group, a nitro group, a sulfonyl group, a sulfinyl group, or a carbonyl-containing group such as an ester group, an amino group, an acyl group, an amide group, a carboxyl group, etc.; or the like, or having an ether structure in a part of the principal chain thereof.

Moreover, the carbon atom number in each of $R^{61}$ and $R^{62}$ is from 1 to 25, preferably from 1 to 10, and more preferably from 1 to 3. When the carbon atom number is more than 25, availability or synthesis of the raw material becomes difficult.

In addition, a (fluorine atom number)/(carbon atom number) ratio in each of $R^{61}$ and $R^{62}$ is from 0.6 to 3, preferably 1 to 3, and more preferably from 1.5 to 3.

In the foregoing formulae, one of $R^{63}$, $R^{64}$ and $R^{65}$ represents a hydrogen atom, and the remaining two represent the same or different branched alkyl group. Moreover, the carbon atom number is from 10 to 26, and preferably from 12 to 24. When the carbon atom number is less than 10, the amount of evaporation becomes large, whereas when it is more than 26, the fluidity at a low temperature is poor, resulting in a problem in the use. Specific examples thereof include a decyl group, an undecyl group, a dodecyl group, a tridecyl group, a tetradecyl group, a pentadecyl group, a hexadecyl group, a heptadecyl group, an octadecyl group, a nanodecyl group, an eicosyl group, etc. These may be branched.

The diphenyl ether oil represented by any of the foregoing formulae may be utilized in an amount of from 50 to 100% by mass and may be utilized in an amount of from 60 to 80% by mass in the oily medium. Within the foregoing range, the heat resistance is more improved. As an oil which is used jointly with the diphenyl ether oil, an ester based synthetic oil and a poly-α-olefin oil are preferable.

A material which is utilized as a base oil for traction oil can be utilized as the oily medium. The base oil for traction oil is usually selected among hydrocarbons. Hydrocarbons having a cyclic structure such as a cyclohexane ring, a decalin ring, a bicycloheptane ring, a bicyclooctane ring, etc. in a molecule thereof are preferable (see JP-A-2000-109871).

For example, examples of a saturated hydrocarbon compound having a cyclohexane ring include compounds disclosed in JP-B-3-80191, JP-B-2-52958, JP-B-6-39419, JP-B-6-92323, etc.; examples of a saturated hydrocarbon compound having a decalin ring include compounds disclosed in JP-B-60-43392 and JP-B-6-51874; and examples of a saturated hydrocarbon compound having a bicycloheptane ring include compounds disclosed in JP-B-5-31914, JP-B-7-103387, etc. More specifically, there are included 1-(1-decalyl)-2-cyclohexylpropane, 1-cyclohexyl-1-decalylethane, 1,3-dicyclohexyl-3-methylbutane, 2,4-dicyclohexylpentane; 1,2-bis(methylcyclohexyl)-2-methylpropane, 1,1-bis(methylcyclohexyl)-2-methylpropane and 2,4-dicyclohexyl-2-methylpentane. Moreover, examples of a saturated hydrocarbon compound having a bicyclooctane ring include compounds disclosed in JP-A-5-9134, etc.

An ionic liquid (ion liquid) has properties such as flame retardancy, nonvolatility, high polarity, high ion conductivity, high heat resistance, etc. In view of such properties, the ionic liquid is expected to be applied as a reaction solvent for green chemistry which is environmentally friendly or a next-generation electrolyte which is safe and high in performances. In the invention, the subject ionic liquid can be utilized as the oily medium. The ionic liquid (ion liquid) includes various kinds, and examples thereof include quaternary salts of a nitrogen-containing heterocyclic compound such as ammonium salts, choline salts, phosphoric acid salts, pyrazoline salts, pyrrolidine salts, imidazolium salts, pyridine salts, etc., sulfonium salts and the like.

As the oily medium which is used in the invention, petroleum hydrocarbons which are in general useful for the use as a fuel, for example, gasoline in the case of an internal combustion engine, etc. can be used. Such a fuel is typically a mixture of various kinds of hydrocarbons, and examples of components thereof include linear or branched paraffins and olefins, aromatic or naphthene based hydrocarbons and other liquid hydrocarbon based materials which are suitable for the use in a spark ignition gasoline engine.

Such a composition is supplied as every grade, for example, unleaded gasoline, leaded gasoline, etc., and typically, it is derived from a petroleum crude oil utilizing usual refining method and blending method, for example, straight fractional distillation, thermal cracking, hydrocracking, catalytic cracking and various modification methods. Gasoline will be defined as a liquid hydrocarbon or a mixture of hydrocarbon/oxygenate having an initial boiling point in the range of from about 20 to 60° C. and a final boiling point in the range of from about 150 to 230° C. when measured by the distillation method of ASTM D86. Examples of this oxygenate include alcohols such as methanol, ethanol, isopropanol, t-butanol, a $C_1$ to $C_5$ mixed alcohol, etc.; ethers such as methyl t-butyl ether, t-amyl ethyl ether, ethyl t-butyl ether, a mixed ether, etc.; and ketones such as acetone, etc.

In the invention, the above-exemplified oils may be used singly or in admixture of two or more different kinds thereof as the oily medium.

Moreover, there may be the case where the mineral oil is insufficient in wettability against a resin-made member, and from the viewpoint of lubricating properties or low friction properties against a resin-made member, or the like, it is preferable to use other oils than the mineral oil as the oily medium. Specifically, a polyolefin oil, a silicone oil, an ester oil, a polyglycol oil and a polyphenyl ether oil are preferable.

Moreover, there may be the case where the ester oil adversely influences a resin-made member or a rubber-made member, and from the viewpoint of preventing adverse influences against a resin-made member or a rubber-made member, it is preferable to use other oil than the ester oil. Specifically, a mineral oil, a polyolefin oil, a silicone oil, a polyglycol oil and a polyphenyl ether oil are preferable.

From the both viewpoints, polyolefins are preferable. Of these, a copolymer of ethylene and propylene; a copolymer of ethylene and an α-olefin having from 5 to 12 carbon atoms; and polybutene, polyisobutene or a polymer of an α-olefin having from 5 to 12 carbon atoms are more preferable, with a copolymer of ethylene and an α-olefin having from 5 to 12 carbon atoms and a polymer of an α-olefin having from 5 to 12 carbon atoms being further preferable.

4. Preparation Method of the Composition of the Invention:

The composition of the invention can be prepared by adding the compound represented by the foregoing formula (Z) into an oily medium and dissolving and/or dispersing it therein. The dissolution and/or dispersion may be carried out under heating. An addition amount of the compound represented by the foregoing formula (Z) is preferably from about 0.1 to 10% by mass relative to the mass of the oily medium. But, it should not be construed that the addition amount of the compound represented by the foregoing formula (Z) is limited to this range. So far as the addition amount is sufficient so that the foregoing compound exhibits a friction reducing effect, as a matter of course, a range other than the foregoing range may be applied.

An embodiment of the composition of the invention is a composition containing an oily medium composed of at least one member selected among a mineral oil, a poly-α-olefin, a synthetic ester oil, a diphenyl ether oil, a fluorocarbon oil and a silicone oil and containing less than 3% by mass of the compound represented by the formula (Z).

The composition of the invention may contain at least one additive together with the compound of the foregoing formula (Z) and the oily medium within the range where the effect of the invention is not impaired. Examples of the additive include a dispersant, a cleaning agent, an antioxidant, a carrier fluid, a metal deactivator, a dye, a marker, a corrosion inhibitor, a biocide, an antistatic additive, a drag reducer, a demulsifier, an emulsifier, an anti-fogging agent, a deicer additive, an antiknock additive, an anti-valve seat recession additive, a lubricating additive, a surfactant and a combustion improver. Moreover, a lubricant, various additives used for, for example, a bearing oil, a gear oil, a power transmission oil, etc., namely a wear-resistant agent, a viscosity index improver, a cleaning dispersant, a metal deactivator, a corrosion inhibitor, an antifoaming agent, etc., can be properly added within the rang where the object of the invention is not impaired. Such a material may be at least one member selected among an organic zinc compound, a molybdenum compound, an organic phosphorus compound and an organic sulfur compound, and the addition of such a compound is preferable from the standpoints of addition of a function of anti-oxidation ability by the organic zinc compound and wear inhibition under a true boundary lubrication condition by the latter three.

Regarding some of the additives, specific examples will be described in details below.

Antiwear Agents:

Internal combustion engine lubricating oils require the presence of antiwear and/or extreme pressure (EP) additives in order to provide adequate antiwear protection for the engine. Increasingly demanding specifications for engine oil performance have required increasing antiwear properties of the oil. Antiwear and EP additives perform this role by reducing friction and wear of metal parts. While there are many different types of antiwear additives, for several decades the principal antiwear additive for internal combustion engine crankcase oils has been a metal alkylthiophosphate and more particularly a metal dialkyldithiophosphate in which the primary metal constituent is zinc, or zinc dialkyldithiophosphate (ZDDP). Typical examples of ZDDP compound include the compounds represented by the formula of $Zn[SP(S)(OR^{71})(OR^{72})]_2$ ($R^{71}$ and $R^{72}$ are $C_1$-$C_{18}$ alkyl groups, preferably $C_2$-$C_{12}$ alkyl groups). These alkyl groups may be straight chain or branched, and derived from primary and/or secondary alcohols and/or alkaryl groups such as alkyl phenol. The ZDDP generally is used in amounts of from about 0.4 to 1.4% by mass of the total composition, although the amount is not limited to the range.

However, it has been found that the phosphorus from these additives has a harmful effect on the catalyst in catalytic converters and also on oxygen sensors in automobiles. One example of the way for minimizing this effect is to replace some or all of the ZDDP with phosphorus-free antiwear additives. Accordingly, various non-phosphorous additives can be also used as antiwear agent. Sulfurized olefins are useful as antiwear or EP additives. Sulfur-containing olefins can be prepared by sulfurization of various organic materials such as aliphatic, arylaliphatic and alicyclic olefin hydrocarbons containing from about 3 to 30 carbon atoms, preferably from about 3 20 carbon atoms. The olefinic compounds contain at least one non-aromatic double bond. Such compounds are represented by the formula:

$$R^{73}R^{74}C{=}CR^{75}R^{76}$$

In the formula, $R^{73}$-$R^{76}$ each independently represent a hydrogen or a hydrocarbon group. Preferred hydrocarbon group is n alkyl or alkenyl group. Any two of $R^{73}$-$R^{76}$ may be connected so as to form a cyclic ring. Additional information concerning sulfurized olefins and their preparation can be found in U.S. Pat. No. 4,941,984, which can be referred.

The use of polysulfides of thiophosphorous acids and thiophosphorous acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex ($R{=}C_8$-$C_{12}$ alkyl) are also useful antiwear agents.

Glycerol esters may be used as antiwear agents. For example, mono-, di, and tri-oleates, mono-palmitates and mono-myristates may be used.

ZDDP may be combined with other antiwear agent(s). U.S. Pat. No. 5,034,141 discloses that a combination of a thiodixanthogen compound (such as octylthiodixanthogen) and a metal thiophosphate (such as ZDDP) can improve antiwear properties. U.S. Pat. No. 5,034,142 discloses that use of a metal alkyoxyalkylxanthate (such as nickel ethoxyethylxanthate) and a dixanthogen (such as diethoxyethyl dixanthogen) in combination with ZDDP improves antiwear properties.

Preferred antiwear additives include phosphorus and sulfur compounds such as zinc nd sulfur compounds such as zinc dithiophosphates and/or sulfur, nitrogen, boron, molybdenum phosphorodithioates, molybdenum dithiocarbamates and various organo-molybdenum derivatives including heterocyclics (for example, dimercaptothiadiazoles, mercaptobenzothiadiazoles, triazines, and the like), alicyclics, amines, alcohols, esters, diols, triols, fatty amides and the like can also be used. Such additive may be used in amounts ranging from about 0.01 to 6% by mass, preferably about 0.01 to 4% by mass.

Viscosity Index Improver:

Viscosity index improvers (also known as VI improvers, viscosity modifiers, and viscosity improvers) provide lubricants with high and low-temperature operability. These additives impart favorable viscosity index number enhancement and shear stability at elevated temperatures and acceptable viscosity at low temperatures. Appropriate examples of the viscosity index improver include high-molecular weight hydrocarbons, polyesters, and viscosity index improvers capable of functioning not only as a viscosity index improver but also as a dispersant. The molecular weight of such a polymer is typically from about 10,000 to about 1,000,000, more typically from about 20,000 to about 500,000, and even more typically from about 50,000 to about 200,000.

Appropriate examples of the viscosity index improver include polymers and copolymers of methacrylate, butadiene, olefin or alkylated styrene. Polyisobutylenes are the typical viscosity index improvers. Other typical examples are polymethacrylates (for example, copolymers of any length alkyl methacrylate); and some of them function as a pour point depressant. Other typical examples are copolymers of ethylene and propylene, hydrogenated block-copolymers of styrene and isoprene, and polyacrylates (for example, copolymers of any length alkyl acrylate). Specific examples of them include styrene-butadiene polymers and styrene-isoprene polymers having a molecular-weight of from about 50,000 to about 200,000.

The viscosity index improver may be used in amounts ranging from about 0.01 to 8% by mass, preferably about 0.01 to 4% by mass.

Antioxidants:

Antioxidants have a function of retarding the oxidative degradation of oil(s) used in along with them. Such degradation may result in deposits on metal surfaces, the presence of sludge, or a viscosity increase in the lubricant. Various antioxidants which are useful in lubricant oil compositions are described, for example, "Klamann in Lubricants and Related Products" (Verlag Chemie (Deerfield Beach, Fla.), ISBN0-89573-177-0), and U.S. Pat. Nos. 4,798,684 and 5,084,197, which can be referred.

Useful antioxidants include hindered phenols. These phenolic antioxidants may be ashless (metal-free) phenolic compounds or neutral or basic metal salts of certain phenolic compounds. Typical phenolic antioxidants are hindered phenolics that contain a sterically hindered hydroxyl group, and these include those derivatives of dihydroxy aryl compounds in which the hydroxyl groups are in the o- or p-position to each other. Examples of the typical phenolic antioxidant include hindered phenols substituted with about $C_6$+alkyl groups and alkylene coupled derivatives of such hindered phenols. Examples of phenolic materials of this type include 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful mono-phenolic antioxidants may include, for example, 2,6-di-alkyl-phenolic proprionic ester derivatives. Bis-phenolic antioxidants may also be advantageously used in combination with the invention. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol). Para coupled bis phenols include, for example, 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include alkylated and non-alkylated aromatic amines such as aromatic monoamines represented by formula of $R^{78}R^{79}R^{80}N$ {in the formula, $R^{78}$ represents an aliphatic, aromatic or substituted aromatic group; $R^{79}$ represents an aromatic or a substituted aromatic group; and $R^{80}$ represents H, alkyl, aryl or $R^{81}S(O)_xR^{82}$ (where $R^{81}$ represents an alkylene, alkenylene, or aralkylene group, $R^{82}$ represents a higher alkyl group, or an alkenyl, aryl, or alkaryl group, and x is 0, 1 or 2)}. The aliphatic group $R^{78}$ may contain from 1 to about 20 carbon atoms, and preferably contains from about 6 to 12 carbon atoms. The aliphatic group means a saturated aliphatic group. Preferably, both $R^{78}$ and $R^{79}$ are aromatic or substituted aromatic groups, and the aromatic group may be a condensed ring aromatic group such as naphthyl. Aromatic groups $R^{78}$ and $R^{79}$ may be joined together with other groups such as S.

Typical aromatic amines antioxidants may have alkyl substituent groups having at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthyl-amines, phenothiazines, imidodibenzyls and diphenyl phenylene diamines.

Mixtures of two or more aromatic amines are also useful. Polymeric amine antioxidants may also be used. Specific examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants. Low sulfur peroxide decomposers are useful as antioxidants.

Another class of antioxidant to be used in the composition of the invention is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and/or Cu(II) salts derived from alkenyl succinic acids or anhydrides are know to be particularly useful.

Preferable examples of the antioxidant include hindered phenols, arylamines, low sulfur peroxide decomposers and other related components. These antioxidants may be used individually by type or in combination with one another. Such additives may be used in amounts of from about 0.01 to 5% by mass, preferably from about 0.01 to 2% by mass, even more preferably from about 0.01 to 1% by mass.

Cleaning Agents:

Cleaning agents are commonly used in lubricant oil compositions. A typical cleaning agent is an anionic material containing a long chain lipophilic portion of the molecule and a smaller anionic or lipophobic portion of the molecule. The anionic portion of the cleaning agent is typically derived from an organic acid such as a sulfur acid, carboxylic acid, phosphorous acid, phenol, or mixtures thereof. The counter ion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful cleaning agents can be neutral, mildly overbased, or highly overbased.

It is generally desirable for at least some parts of the cleaning agent to be overbased. Overbased cleaning agents help neutralize acidic impurities produced by the combustion process and become entrapped in the oil. Typically, the overbased material has a ratio of metallic ion to anionic portion of the cleaning agent of about 1.05:1 to 50:1 on an equivalent basis. More preferably, the ratio is from about 4:1 to about 25:1. The resulting cleaning agent is an overbased cleaning agent that will typically have a TBN of about 150 or higher, often about 250 to 450 or more. Preferably, the overbasing cation is sodium, calcium, or magnesium. A mixture of cleaning agents of differing TBN can be used in the present invention.

Preferable examples of the cleaning agent include the alkali or alkaline earth metal salts of sulfates, phenates, carboxylates, phosphates, and salicylates.

Sulfonates may be prepared from sulfonic acids that are typically obtained by sulfonation of alkyl substituted aromatic hydrocarbons. Examples of hydrocarbon include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Various overbased metal salts of various sulfonic acids which are useful as cleaning agents/dispersants in lubricant oils are disclosed. Various overbased sulfonates which are useful as cleaning agents/detergents are disclosed. They may be used in the invention.

Alkaline earth phenates are another useful class of cleaning agent. These cleaning agents may be prepared by reacting alkaline earth metal hydroxide or oxide (such as CaO, $Ca(OH)_2$, BaO, $Ba(OH)_2$, MgO, and $Mg(OH)_2$) with an alkyl phenol or sulfurized alkylphenol. Useful alkyl groups include straight chain or branched about $C_1$-$C_{30}$ alkyl groups, preferably about $C_4$-$C_{20}$ alkyl groups. Examples of suitable phenols include isobutylphenol, 2-ethylhexylphenol, nonylphenol, 1-ethyldecylphenol, and the like. It should be noted that starting material of alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent, including elemental sulfur or sulfur halides, such as sulfur dichloride and the like, and then reacting the sulfurized phenol with an alkaline earth metal base.

Metal salts of carboxylic acids are also useful as cleaning agents. These carboxylic acid cleaning agents may be prepared by reacting a basic metal compound with at least one carboxylic acid and removing free water from the reaction product. These compounds may be overbased to produce the desired TBN level. Cleaning agents made from salicylic acid are one preferred class of cleaning agents derived from carboxylic acids. Examples of the useful salicylate include long chain alkyl salicylates. One useful family of compositions is of the following formula.

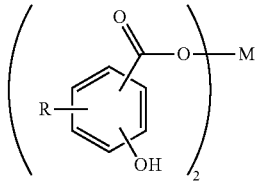

In the formula, R represents a hydrogen atom or an alkyl group having 1 to about 30 carbon atoms, n is an integer from 1 to 4, and M is an alkaline earth metal. Preferably, R is a $C_{11}$ or longer alkyl chain, and more preferably $C_{13}$ or longer alkyl chain. R may be an optionally substituted with substituents that do not interfere with the cleaning-agent's function. M is preferably, calcium, magnesium, or barium, and more preferably, calcium or magnesium. More preferably, M is calcium.

Hydrocarbyl-substituted salicylic acids may be prepared from phenols by the Kolbe reaction. See U.S. Pat. No. 3,595,791, incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as cleaning agents.

Detergents may be simple cleaning agents or what is known as hybrid or complex cleaning agents. The latter cleaning agents can provide the properties of two cleaning agents without the need to blend separate materials. See, for example, U.S. Pat. No. 6,034,039, which can be referred. Preferable examples of the cleaning agent include calcium phenates, calcium sulfonates, calcium salicylates, magnesium phenates, magnesium sulfonates, magnesium salicylates and other related components (including borated cleaning agents). Typically the total cleaning agent concentration is from about 0.01 to 6% by mass, preferably from about 0.1 to 3% by mass, even more preferably from about 0.01 to 0.5% by mass.

Dispersants:

During engine operation, oil insoluble oxidation byproducts are produced. Dispersants help keep these byproducts in solution, thus diminishing their deposit on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing cleaning agents discussed above form ash upon combustion.

Suitable dispersants typically contain a polar group attached to a relatively high molecular weight hydrocarbon chain. The polar group typically contains at least one element of nitrogen, oxygen, or phosphorous. Typical hydrocarbon chains contain about 50 to 400 carbon atoms.

Examples of the dispersant include phenates, sulfonates, sulfurized phenates, salicylates, naphthenates, stearates, carbamates, thiocarbamates, and phosphorus derivatives. A particularly useful examples of the dispersant include alkenylsuccinic derivatives, typically produced by the reaction of a long chain substituted alkenyl succinic compound, usually a substituted succinic anhydride, with a polyhydroxy or polyamino compound. The long chain group constituting the lipophilic portion of the molecule which adds solubility in the oil, is normally a polyisobutylene group. Many examples of this type of dispersant are well known commercially or in various documents. Exemplary U.S. Patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants is also found in European Patent Application No. 471 071.

Hydrocarbyl-substituted succinic acid compounds are well known dispersants. In particular, succinimide, succinate esters, or succinate ester amides prepared by the reaction of hydrocarbon-substituted succinic acid preferably having at least 50 carbon atoms in the hydrocarbon substituent, with at least one equivalent of an alkylene amine, are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; 3,652,616; 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpoly-amines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will range between about 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product, including those derived from mono-succinimides, bis-succinimides (also known as disuccinimides), and mixtures thereof.

Mannich base dispersants are made from the reaction of alkylphenols, formaldehyde, and amines. See U.S. Pat. No. 4,767,551, incorporated by reference herein in its entirety. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, decaethylene undecamine, and mixtures of such amines. Some preferred compositions correspond to formula $H_2N—(Z—NH—)_nH$, where Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. Alkylene polyamines usually are obtained by the reaction of ammonia and dihalo alkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include aliphatic aldehydes such as formaldehyde (such as paraformaldehyde and formalin), acetaldehyde and aldol (b-hydroxybutyraldehyde, for example). Formaldehyde or a formaldehyde-yielding reactant is preferred.

Hydrocarbyl substituted amine ashless dispersant additives are well known to those skilled in the art. See, for example, U.S. Pat. Nos. 3,275,554; 3,438,757; 3,565,804; 3,755,433, 3,822,209, and 5,084,197, which can be referred.

Preferable examples of the dispersant include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, preferably from about 1000 to about 3000, more preferably from about 1000 to about 2000, even more preferably from about 1000 to about 1600, or a mixture of such hydrocarbylene groups. Other preferable examples of the dispersant include succinic acid-esters and amides, alkylphenol-polyamine coupled Mannich adducts, their capped derivatives, and other related components. Such additives may be used in an amount of about 0.1 to 20% by mass, preferably about 0.1 to 8% by mass.

Pour Point Depressants:

Pour point depressants have a function of lowering the minimum temperature at which the fluid will flow or can be poured. Examples of the suitable pour point depressant include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5% by mass, preferably about 0.01 to 1.5% by mass.

Corrosion Inhibitors:

Corrosion inhibitors are used to reduce the degradation of metallic parts to contact with the lubricating oil composition. Examples of the suitable corrosion inhibitor include thiadiazoles. See, for example, U.S. Pat. Nos. 2,719,125; 2,719,126; and 3,087,932, which can be referred. Such additives may be used in an amount of about 0.01 to 5% by mass, preferably about 0.01 to 1.5% by mass.

Seal Compatibility Additives:

Seal compatibility agents help to swell elastomeric seals by bringing about chemical reactions in fluids or physical changes in elastomers. Examples of the suitable seal compatibility agent include organic phosphates, aromatic esters, aromatic hydrocarbons, esters (such as butylbenzyl phthalate), and polybutenyl succinic anhydride. Such additives may be used in an amount of about 0.01 to 3% by mass, preferably about 0.01 to 2% by mass.

Anti-Foam Agents:

Anti-foam agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Antirust Additives (or Corrosion Inhibitors):

Antirust additives (or corrosion inhibitors) are additives that protect lubricated metal surfaces against chemical attack by water or other contaminants. Various antirust additives are commercially available; they are referred to also in Klamann in "Lubricants and Related Products" (Verlag Chemie (Deerfield Beach, Fla.), ISBN0-89573-177-0).

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5% by mass, preferably about 0.01 to 1.5% by mass.

Friction Modifiers:

A friction modifier is any material or materials that can alter the coefficient of friction of any lubricant or fluid containing such material(s). Friction modifiers, also known as friction reducers, or lubricity agents or oiliness agents, and other such agents that change the coefficient of friction of lubricant base oils, formulated lubricant compositions, or functional fluids, may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates (Mo(DTC)), Mo-dithiophosphates (Mo(DTP)), Mo-amines (Mo (Am)), Mo-alcoholates, Mo-alcohol-amides, etc.

Ashless friction modifiers may have also include lubricant materials that contain effective amounts of polar groups, for example hydroxyl-containing hydrocaryl base oils, glycerides, partial glycerides, glyceride derivatives, and the like. Polar groups in friction modifiers may include hyrdocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01% by mass to 15% by mass, often with a preferred range of about 0.1% by mass to 5% by mass. Concentrations of molybdenum containing materials are often described in terms of Mo metal concentration. Advantageous concentrations of Mo may range from about 10 ppm to 3000 ppm or more, and often with a preferred range of about 20 2000 ppm, and in some instances a more preferred range of about 30 1000 ppm. Friction modifiers of all types may be used alone or in mixtures with the materials of this invention. Often mixtures of two or more friction modifiers, or mixtures of friction modifiers(s) with alternate surface active material(s), are also desirable.

Additives of Grease Composition:

The composition of the invention may be prepared as a grease composition. In the subject embodiment, in order to ensure a practical performance in the case of adapting to a grease application, a thickener or the like may be properly added within the range where the object of the invention is not impaired, as the need arises. Additives which can be added during the preparation of a grease composition are hereunder described.

As the thickener which can be added, all of thickeners such as soap based thickeners, for example, a metal soap, a composite metal soap, etc.; non-soap based thickeners such as Bentone, silica gel, urea based thickeners (urea compounds, urea/urethane compounds, urethane compounds, etc.); and the like can be used. Of these, soap based thickeners and urea based thickeners are preferably used because they are less likely to damage resin-made members.

Examples of the soap based thickener include a sodium soap, a calcium soap, an aluminum soap, a lithium soap, etc. Of these, a lithium soap is preferable in view of excellent waterproof properties and thermal stability. Examples of the lithium soap include lithium stearate, lithium 12-hydroxystearate, etc.

Moreover, examples of the urea based thickener include urea compounds, urea/urethane compounds, urethane compounds, mixtures of these compounds, etc.

Examples of the urea compound, urea/urethane compound and urethane compound include diurea compounds, triurea compounds, tetraurea compounds, polyurea compounds (excluding diurea compounds, triurea compounds and tetraurea compounds), urea/urethane compounds, diurethane compounds, mixtures of these compounds, etc. Preferably, diurea compounds, urea/urethane compounds, diurethane compounds and mixtures of these compounds are exemplified.

Examples of the solid lubricant include polytetrafluoroethylene, boron nitride, fullerene, graphite, fluorinated graphite, melamine cyanurate, molybdenum disulfide, Mo-dithiocarbamate, antimony sulfide, borates of an alkali (alkaline earth) metal, etc.

Examples of the wax include various waxes including natural waxes and mineral oil based or synthetic waxes. Specific examples thereof include a montan wax, a carnauba wax, an amide compound of a higher fatty acid, a paraffin wax, a microcrystalline wax, a polyethylene wax, a polyolefin wax, an ester wax, etc.

Besides, benzotriazole, benzimidazole, thiadiazole and the like are known as the metal deactivator, and these can be used.

A viscosity improver can be added to the foregoing grease composition. Examples of the viscosity improver include polymethacrylate, polyisobutylene, polystyrene, etc.

Poly(meth)acrylate is also known to have an effect of preventing an abnormal sound at a low temperature in a cold district.

In general, a rotary bearing portion of a food-making machine adopts a prelubricated rolling bearing or the like. However, since there may be a possibility that such a mineral oil based grease composition is scattered and brought into contact with foods during the operation of the machine, it may not be said that such is suitable in view of the food hygiene. Moreover, there is a concern that the grease is polluted by bacteria, so that it may be likely considered that there is a possibility that the foods are adversely affected. As a grease composition capable of solving such a problem, there are known a grease composition containing antibacterial zeolite as an antibacterial agent and so forth. Moreover, a natural antibacterial agent is preferable in view of safety. Specifically, chitosans, catechins, Moso bamboo, mustard, an essential oil of wasabi and the like are representative. Besides, antibacterial substances such as colloidal pectin abundant in apple, grape and citrus fruits; polylysin which is a straight-chain polymer of L-lysine as an essential amino acid; protamine which is a basic protein contained in matured testis of salmon, trout, herring and the like; extracts of seed and fruit of *Psoralea corylifolia*; spices obtained by dried leaves of Lamiaceae such as rosemary, sage, thyme and so forth; extracts of *Coix lacryma-jobi* obtained by using a hydrophobic organic solvent; extracts of root and stem of *Cirsium brevicaule*; propolis obtained from honeycomb; and the like can be used.

Of these, catechins which are largely effective against various types of food poisoning are suitable. Above all, epigallocatechin, epicatechin, epicatechin gallate, epigallocatechin gallate, catechin and so forth, which are a water-soluble component contained in tea leaves, are preferable. In general, since such catechins are soluble in water, they are preferably used upon being added with a small amount of a surfactant. However, in the case of a grease composition, there is no need of further adding a surfactant because the thickener also plays a role as the surfactant.

Moreover, the grease composition is also highly adaptable to a rubber to be disposed in the vicinity of a sliding portion. Though such a rubber is not particularly limited, specific examples thereof include a nitrile rubber, a chloroprene rubber, a fluorinated rubber, an ethylene/propylene rubber, an acrylic rubber and composites of these materials.

Static electricity generated in rolling bearings is known to adversely affect, by a radiated noise thereof, a copied image produced by a copying machine, such as distortion, etc., and the copresence of a conductive material is effective for its suppression. The conductive material is added in an amount of from 2 to 10% by mass of the total amount of the grease. Of the conductive materials, carbon black and graphite are suitable, and the both can be used independently or in admixture. In the case of using them as a mixture, the total content is regulated to the foregoing addition amount. Moreover, each of carbon black and graphite is preferably one having an average particle size of from 10 to 300 nm.

Moreover, the conductive material is also known to be effective as an anti-separation agent as described in the section relevant to the extreme pressure agent. As described in JP-A-2002-195277, this conductive material has an effect of suppressing whitening and separation to be caused by a hydrogen ion.

There are also known techniques of adding a hollow filler or a silica particle for the purpose of improving heat-insulating properties of the grease, or conversely, techniques of adding a powder of metal such as copper, etc. for the purpose of promoting heat conduction and heat radiation properties.

As the grease with improved flame retardancy, there are known those obtained by adding a powder of an oxide, a carbonate or the like of an alkali metal or alkaline earth metal to a lithium soap grease, those obtained by adding calcium carbonate and a platinum compound to a silicone grease, and those obtained by allowing a grease to contain a water-absorptive polymer and water.

5. Properties of Composition of The Invention:

5-1. Clearing Point:

It is preferable that the composition of the invention has a clearing point at which it transfers from an opaque state to a transparent state. Since the majority of the compounds represented by the foregoing formula (Z) are dispersed in the oily medium at atmospheric pressure and room temperature, the composition of the invention is frequently seen to be suspended. The degree of suspension largely varies depending upon the compound and the oily medium. When the composition in such a state is heated, it becomes steeply transparent in a certain temperature range. This temperature at which the composition becomes transparent is referred to as "clearing point". More specifically, the "clearing point" means a temperature at which fine particles of a compound become to have a particle size of not more than that at which the Mie scattering is caused, whereby the resulting composition changes to a state where it is seen to be transparent. The particle size at which the Mie scattering is caused is about 0.1 μm in terms of a diameter. In other words, it may be said that the "clearing point" is a temperature at which particles of the compound represented by the foregoing formula (Z) dispersed in the oily medium change to particles having a particle size of substantially less than 0.1 μm in terms of a diameter. This change in the particle size can be observed by a heating microscope. In consequence, the "clearing point" does not always mean a dissolved state of solvated monomeric dispersion. In the composition of the invention, though the foregoing compound is dispersed and/or dissolved in the oily medium, this state is not an expression in conformity with physicochemical definition.

The composition of the invention preferably has the foregoing clearing point, and the clearing point is more preferably not higher than 70° C. at atmospheric pressure. When the clearing point falls within the foregoing range, there is a tendency that the lubricating effect of the composition in a sliding part is high so that the temperature range in which a low coefficient of friction is revealed becomes wide. Though a lower limit value of the clearing point is not particularly limited, in the case where the composition is suspended at room temperature, the clearing point becomes about 35 to 40° C. or higher.

5-2. Viscosity:

A viscosity at 40° C. of the composition of the invention is preferably not more 100 mPa·s, more preferably not more than 50 mPa·s, and further preferably not more than 30 mPa·s. The smaller the viscosity, the more preferable the composition is because it contributes to low fuel consumption. However, since the viscosity of the composition of the invention largely varies with a viscosity of the base oil to be used, a structure and an addition amount of the compound of the invention and coexistent additives, and an adequate viscosity is required depending upon the use environment, the viscosity of the composition of the invention must be made in conformity therewith. However, since the invention is not required to suppress the lowering in viscosity of a base oil at a high temperature to be caused due to a viscosity index improver in the current technologies, it is free from the occurrence of an increase in viscosity at a low temperature to be caused due to the addition of a viscosity index improver. Thus, it is also one of characteristic features that the effect of the low-viscosity base oil contributes directly to the fuel consumption.

A preferred example of the compound represented by the formula (Z) is a compound satisfying the following conditions (A) and (B).

(A) An average value of particle sizes of the compound dispersed in an oily medium at room temperature and measured by a dynamic light scattering method is not more than 1 μm, the compound is dispersed in a state close to a monodispersed state, and its clearing point is not higher than 55° C.; and (B) A melting point is not higher than 70° C.

5-3. Elementary Formulation:

As for the composition of the invention, it is preferable that the constituent elements are composed of only carbon, hydrogen, oxygen and nitrogen. The compound of the foregoing formula (Z) can be constituted of only carbon, hydrogen and oxygen. Moreover, as for the oil to be used for the oily medium, there are various materials composed of only carbon, hydrogen and oxygen. By combining them, a composition in which the constituent elements are composed of only carbon, hydrogen, oxygen and nitrogen can be prepared. In general, the current lubricating oils contain phosphorus, sulfur and a heavy metal. In a lubricating oil to be used for a 2-stroke engine of combusting the lubricating oil together with a fuel, though it does not contain phosphorus and a heavy metal while taking into consideration the environmental load, it contains sulfur in an amount of about a half of a lubricating oil to be used for a 4-stroke engine. That is, in the current lubricating technologies, though it may be conjectured that the formation of a boundary lubricating film made of sulfur is essential at a minimum. In view of the fact that a sulfur element is contained, a load to a catalyst for exhaust gas cleaning is very large. In this catalyst for exhaust gas cleaning, though platinum and nickel are used, a poisoning action of phosphorus or sulfur is a serious problem. From this point of issue, a merit to be brought due to the fact that elements constituting a composition of the lubricating oil are composed of only carbon, hydrogen, oxygen and nitrogen is very large. In addition, the fact that the composition is composed of only carbon, hydrogen and oxygen is optimal for lubricating oils of industrial machines, in particular food manufacturing-related devices. According to the current technology, an elementary composition taking into consideration the environment while scarifying the coefficient of friction is adopted. This is also a very preferable technology for a lubricating oil for cutting or working a metal requiring a large amount of water for cooling. In many cases, the lubricating oil inevitably floats or vaporizes in the air as a mist, and a treatment waste fluid is discharged into the natural system. Therefore, in order to make both the lubricating properties and the environmental protection compatible with each other, it is very preferable to substitute the current lubricating oils with the composition of the invention which is constituted of only carbon, hydrogen and oxygen.

5-4. Liquid Crystallinity:

From the viewpoint of lubricating performance, it is preferable that the composition of the invention exhibits liquid crystallinity. This is because in view of the fact that the composition reveals liquid crystallinity, the molecule is oriented in the sliding portion, and a lower coefficient of friction is revealed due to an effect of its anisotropic low viscosity (see, for example, Ken KAWATA and Nobuyoshi OHNO, *Fujifilm Research and Development* (No. 51-2006, pp. 80 to 85).

As for the liquid crystallinity, the compound represented by the formula (Z) may singly reveal thermotropic liquid crystallinity, or it may reveal thermotropic liquid crystallinity together with the oily medium.

6. Applications of Composition of The Invention:

The composition of the invention is useful as a lubricating oil. For example, the composition of the invention is fed between the two sliding surfaces and can be used for reducing the friction. The composition of the invention is able to form a film on the sliding surface. As for the material quality of the sliding surface, specific examples of steel include carbon steels for machine structural use; alloy steels for machine structural use such as a nickel-chromium steel material, a nickel-chromium-molybdenum steel material, a chromium steel material, a chromium-molybdenum steel material, an aluminum-chromium-molybdenum steel material, etc.; stainless steel, and maraging steel.

Various metals other than steel, or inorganic or organic materials other than metals are widely used.

Examples of the inorganic or organic materials other than metals include various plastics, ceramics, carbon, etc. and mixtures of these materials, etc. More specific examples of the metal materials other than steel include cast iron, a copper/copper-lead/aluminum alloy, castings of these materials and white metal.

Examples of the organic material include all of general plastics, engineering plastics, such as high-density polyethylenes (HDPE), polyamides, polyacetals (POM), polycarbonates, polyethylene terephthalates, polybutylene terephthalates, polybutylene naphthalates, polyphenylene ethers, poly phenylene Sulfides (PPS), fluorine resins. Tetrafluoroethylene resins (PFPE), polyaryalates, polyamide imides (PAI), polyether imides, polypyromellitimides, polyether ether ketones (PEEK), polysulfones, polyethersulfones, polyimides (PI), polystyrenes, polyethylenes, polypropylenes, phenol resins, AS resins, ABS resins, AES resins, AAS resins, ACS resins, MBS resins, polyvinyl chloride resins, epoxy resins, diallyl phthalate resins, polyester resins, methacryl resins, and ABS/polycarbonate alloy.

Such a resin forms a molding or a resin layer as various components or members, and this grease composition is applied in a portion where it comes into contact with other resin or metal. Specifically, the grease composition is effectively applied to, for example, a sliding portion, a bearing and a resin gear part of automotive electrical equipment represented by an electric power steering, a door mirror and so forth; a resin gear part for audio instruments such as a radio cassette recorder, VTR, a CD player and so forth; a resin gear unit for office automation equipment such as a printer represented by a laser printer, a copying machine, a facsimile and so forth; and a contact portion between a resin material for forming a sliding part of every automotive actuator and an air cylinder interior, with other resin material or a metal material.

Examples of the inorganic material include ceramics such as silicon carbide, silicon nitride, alumina, zirconia, titanium carbide (TiC), zirconium carbide (ZrC), titanium nitride (TiN), etc.; and carbon materials. Moreover, examples of a mixture of these materials include organic-inorganic composite materials in which a plastic is composited with fibers of glass, carbon, aramid, etc., cermet which is a composite material of a ceramic and a metal and so forth.

In the case where a part is composed of a material other than steel, at least a part of the surface of a steel material is covered by a film composed of a metal material other than steel or an organic or inorganic material other than metal materials. Examples of the covering film include magnetic material thin films such as a thin film made of diamond-like carbon and organic or inorganic porous films.

Moreover, the configuration may be achieved in such a manner that a porous sintered layer is formed on at least one of the foregoing two surfaces, and the porous layer is impregnated with the composition of the invention, thereby allowing the lubricant composition to be properly fed onto the sliding surface at the time of sliding. The foregoing porous film may be composed of any material selected among metal materials, organic materials and inorganic materials. Specific examples thereof include sintered metals; porous ceramics formed by allowing fine particles of calcium zirconate ($CaZrO_3$) and magnesia (MgO) to strongly bond to each other; porous glasses obtained by allowing silica and a borate based component to thermally cause phase separation; sintered porous moldings of an ultra-high-molecular weight polyethylene powder; fluorocarbon resin based porous films made of polytetrafluoroethylene, etc.; polysulfone based porous films to be used for a microfilter, etc.; porous films formed by previously allowing a poor solvent of a molding and a monomer for forming the molding to cause phase separation at the time of polymerization; and so forth.

Examples of the metal or metal oxide sintered layer include porous layers formed by sintering a copper based, iron based or $TiO_2$ based powder. The copper based sintered layer can be formed by placing a mixture of a copper powder (for example, 88% by mass), tin (for example, 10% by mass) and graphite (for example, 2% by mass) on a cast iron substrate, compress molding the resultant under 250 MPa and sintering the molding in a reductive gas stream at a high temperature, for example, about 770° C. for about one hour. Moreover, the iron based sintered layer can be formed by placing a mixture of an iron powder having a copper powder (for example, 3% by mass) and chemical carbon (0.6% by mass) added thereto on a cast iron substrate, compress molding the resultant under 250 MPa and sintering the molding in a reductive gas stream at a high temperature, for example, about 770° C. for about one hour. Moreover, the $TiO_2$ sintered layer is formed by placing a mixture of $Ti(OC_8H_{17}\text{-n})$ (for example, 33% by mass), a fine powder of $TiO_2$ (for example, 57% by mass) and PEO (molecular weight MW=3,000) on a cast iron substrate and sintering the resultant under heating at 560° C. for 3 hours while irradiating UV rays.

In this connection, the material to be covered by such a porous layer is not specifically limited, and it may be any of the foregoing ceramics, resins and organic-inorganic composite materials or, as a matter of course, may be steel.

The coating film made of the foregoing magnetic material thin film such as a diamond-like carbon thin film, etc. can be formed by a surface treatment. Details of the surface treatment are described in *Tribology Handbook,* 1st edition (2001), Series B, Chapter 3, "Surface Treatment", pages 544 to 574, edited by Japanese Society of Tribologists, all contents of which are adoptable to manufacturing of the mechanical elements of the invention. In general, the surface treatment is achieved for the purpose of improving tribological characteristics through surface modification, wherein the operation of mechanical elements often requires not only low friction and wear resistance but various material characteristics such as low noise, corrosion resistance, chemical stability, heat resistance, dimensional stability, low out-gas, biocompatibility, antibacterial performance and so forth, depending on demands of the operational environment. In consequence, in the invention, the surface treatment is not limited to those aimed at improving the tribological characteristics. Examples of the surface treatment include:

1) formation of a film of aluminum, copper, silver, gold, chromium, molybdenum, tantalum or alloys thereof; a ceramic film of titanium nitride, chromium nitride, titanium carbide, chromium carbide, etc.; and an oxide film of aluminum oxide, silicon dioxide, molybdenum silicide, tantalum oxide, barium titanate, etc., by a physical vapor deposition method by vacuum vapor evaporation, ion plating, sputtering or ion implantation;

2) formation of a film of every metal; a carbide film of WC, TiC, $B_4C$; a nitride film of TiN, $Si_3N_4$, etc.; a boride film of $TiB_2$, $W_2B_3$, etc.; an oxide film of $Al_2O_3$, $ZrO_2$, etc.; an amorphous carbon film containing CrW or a Ti metal; a fluorine-containing carbon film; or a plasma-polymerized polymer, by a chemical vapor deposition method by heat, plasma, light, etc.;

3) a method of imparting characteristics such as wear resistance, anti-seize properties and so forth to a surface layer portion, by a diffusive covering method (chemical reaction process) such as carburization, nitriding, sulfurizing and boronization treatments and so forth; and 4) formation of a film of a metal, a composite metal, etc., by a plating method such as electro-plating, electroless plating and so forth.

The composition of the invention can be utilized for various applications. For example, the composition of the invention is used for fuels for combustion engine, engine oils for internal combustion engine, cutting oils, engine oils for vehicles including automobiles, etc., gear oils, hydraulic oils for automobiles, lubricating oils for marine vessel and aircraft, machine oils, turbine oils, bearing oils, hydraulic oils, oils for compressor and vacuum pump, freezer oils, lubricating oils for cooling apparatuses such as air conditioners or refrigerators having a reciprocating or rotary sealing type compressor, automotive air conditioners dehumidifiers, freezers, refrigerated warehouses, vending machines, showcases, chemical plants, etc, and so forth.

Moreover, the composition of the invention is also useful as a chlorine based compound-free lubricating oil for metal working during working of hot rolling or cutting a metal material, for example, steel materials, Al alloys, etc.; as a metal working oil or plastic working oil such as a cold rolling oil, a cutting oil, a grinding oil, a drawing oil, a press working oil, etc. of aluminum, in particular, as an inhibitor of wear, breakage or surface roughening at the time of high-speed and high-load working; and as a metal working oil composition which can be applied to low-speed and heavy cutting such as brooch working or gun drill working.

Moreover, the composition of the invention can be utilized for various lubricating oils for grease, lubricants for magnetic recording medium, lubricants for micromachine, lubricants for artificial bone and so forth. Moreover, since the elementary composition of the composition can be made of a carbohydrate, by using, as a lubricating oil, a composition containing a cooking oil as a base oil and containing a sorbitan fatty acid ester containing polyoxyethylene ether which is widely used as an emulsifier, a dispersant or a solubilizing agent for cake mixtures, salad dressings, shortening oils, chocolates, etc., a high-performance lubricating oil which is utterly harmless to man can be used for lubrication of members of manufacturing equipment of food-manufacturing line or medical equipment.

Moreover, by emulsifying and dispersing the composition of the invention in a water system or dispersing it in a polar solvent or a resin medium, it can be used as a cutting oil or a rolling oil.

Moreover, the composition of the invention can be utilized as a mold release agent for various applications. For example, the composition of the invention can be used as a mold release agent for polycarbonate resins, flame-retardant polycarbonate resins, crystalline polyester resins which are a main component for image forming toners to be used for electrophotographic apparatus or electrostatic recording apparatus, various thermoplastic resin compositions for molding, semiconductor sealing epoxy resin compositions and so forth, Moreover, by previously kneading the composition of the invention into textile goods such as clothing, etc. or coating it, it can also be used as an antifouling agent for promoting release of a stain deposited on the textile goods, thereby preventing the stain of the fiber goods.

EXAMPLES

The invention is described in more detail with reference to the following Examples. In the following Examples, the amount of the material, reagent and substance used, their ratio, the operation with them and the like may be suitably modified or changed not overstepping the sprit and the scope of the invention. Accordingly, the scope of the invention should not be limited to the following Examples.

1. Synthesis Examples of Illustrative Compounds

1-1. Synthesis Example of Illustrative Compound AII-2:

Synthesis of 1-docosanyl methanesulfonate 247.4 g of behenyl alcohol (1-docosanol) was dissolved in 640 mL of tetrahydrofuran, 116.1 mL of methanesulfonyl chloride was gradually added, and 64.7 mL of triethylamine was then added dropwise under ice cooling over 30 minutes. After stirring for one hour, the mixture was heated at 40° C. and further stirred for 30 minutes. The reaction mixture was poured into 3.5 L of ice water, and the resulting mixture was ultrasonically dispersed for 15 minutes and further stirred at room temperature for 4 hours. The dispersion was filtered under reduced pressure, and a crystal was washed with 2 L of water. The resulting white crystal was stirred in 1.5 L of acetonitrile for one hour, filtered under reduced pressure and then washed with 0.5 L of acetonitrile. The resulting crystal was dried under reduced pressure to obtain 303.4 g of a white crystal.

Synthesis of tetraethylene glycol mono-1-docosanyl ether 80.4 g of 1-docosanyl methanesulfonate was added to 207 mL of tetraethylene glycol, and the mixture was heated at 110° C. 40.0 g of t-butoxypotassium was gradually added over 2 hours. The mixture was further stirred for 3 hours, and after cooling, the reaction mixture was poured into 3 L of ice water, to which was then added 2 L of ethyl acetate, the mixture was stirred, and 22.2 g of an insoluble matter was filtered. An ethyl acetate phase was extracted and separated from the filtrate, after concentration under reduced pressure, 0.5 L of acetonitrile was added, and the mixture was stirred under ice cooling for one hour. The reaction mixture was filtered under reduced pressure and washed with 0.2 L of cold acetonitrile to obtain 81.6 g of a white crystal.

Synthesis of 3-(1-docosanyl tetraethyleneoxycarbonyl)propionic acid 25.0 g of tetraethylene glycol mono-1-docosanyl ether was dissolved in 160 mL of toluene, to which were then added 7.5 g of succinic anhydride and two drops of concentrated sulfuric acid, and the mixture was heated at 125° C. for 8 hours. After cooling, 0.3 L of acetonitrile was added, and the mixture was stirred under ice cooling for one hour and then filtered under reduced pressure. The reaction mixture was washed with 100 mL of cold acetonitrile and then dried under reduced pressure to obtain 23.3 g of a white crystal.

Synthesis of Illustrative Compound AII-2

5.0 g of 3-(1-docosanyl tetraethyleneoxycarbonyl)propionic acid was dissolved in 20 mL of toluene, two drops of dimethylformamide and 2 mL of thienyl chloride were then added thereto. After 5 minutes, the mixture was heated at 80° C. and further stirred for 2 hours, and after cooling, toluene and excessive thienyl chloride were distilled off under reduced pressure. 15 mL of toluene and 283 mg of pentaerythritol were added thereto, and 5 mL of pyridine was then gradually added. After heating at 80° C. for 8 hours, the reaction mixture was cooled, 200 mL of methanol was poured thereinto, and the mixture was stirred for 2 hours. The reaction mixture was filtered under reduced pressure to obtain 4.8 g of a white crystal.

1-2. Synthesis Example of Illustrative Compound AII-5:

Illustrative Compound AII-5 was synthesized in the same manner, except for replacing 1-docosanol as the starting raw material of Illustrative Compound II-2 with 1-stearyl alcohol.

1-3. Synthesis Example of Illustrative Compound AII-8:

Illustrative Compound AII-8 was synthesized in the same manner, except for replacing 1-docosanol as the starting raw material of Illustrative Compound AII-2 with 1-tetradecanol.

1-4. Synthesis Example of Illustrative Compound AII-1:

Synthesis of 3-(1-docosanyl polyethyleneoxycarbonyl)probionic acid 25.6 g of polyethylene glycol mono-1-docosanyl ether (manufactured by Takemoto Oil & Fat Co., Ltd.; average degree of polymerization of ethyleneoxy group: 6.65) was dissolved in 160 mL of toluene, to which were then added 8.0 g of succinic anhydride and two drops of concentrated sulfuric acid, and the mixture was heated at 125° C. for 8 hours. After cooling, 0.3 L of acetonitrile was added, and the mixture was stirred under ice cooling for one hour and then filtered under reduced pressure. The reaction mixture was washed with 100 mL of cold acetonitrile and then dried under reduced pressure to obtain 22.3 g of a white crystal.

Synthesis of Illustrative Compound AII-1

5.18 g of 3-(1-docosanyl polyethyleneoxycarbonyl)propionic acid was dissolved in 10 mL of toluene, and two drops of dimethylformamide and 2 mL of thienyl chloride were then added thereto. After 5 minutes, the mixture was heated at 80° C. and further stirred for 2 hours, and after cooling, toluene and excessive thienyl chloride were distilled off under reduced pressure. 14 mL of toluene and 245 mg of pentaerythritol were added thereto, and 6 mL of pyridine was then added thereto. After heating at 80° C. for 8 hours, the reaction mixture was cooled, 200 mL of methanol was poured thereinto, and the mixture was stirred for 2 hours. The reaction mixture was filtered under reduced pressure to obtain 4.69 g of a white crystal.

1-5. Synthesis Example of Illustrative Compound AII-17:

Illustrative Compound AII-17 was synthesized in the same manner, except for changing the average degree of polymerization of 6.65 of polyethylene glycol mono-1-dosanyl ether as the starting raw material of Illustrative Compound AII-1 to an average degree of polymerization of 10.30.

1-6. Synthesis Example of Illustrative Compound AII-18:

Illustrative Compound AII-18 was synthesized in the same manner, except for changing the average degree of polymerization of 6.65 of polyethylene glycol mono-1-dosanyl ether as the starting raw material of Illustrative Compound AII-1 to an average degree of polymerization of 19.0.

1-7. Synthesis Example of Illustrative Compound AII-33:

Illustrative Compound AII-33 was synthesized in the same manner, except for replacing succinic anhydride used in Illustrative Compound AII-1 with Meldrum's acid.

1-8. Synthesis Example of Illustrative Compound AII-34:

Illustrative Compound AII-34 was synthesized in the same manner, except for replacing succinic anhydride used in Illustrative Compound AII-1 with glutaric anhydride.

1-9. Synthesis Example of Illustrative Compound AII-36:

Illustrative Compound AII-36 was synthesized in the same manner, except for replacing succinic anhydride used in Illustrative Compound AII-1 with maleic anhydride.

1-10. Synthesis Example of Illustrative Compound AII-37:

Illustrative Compound AII-37 was synthesized in the same manner, except for replacing succinic anhydride used in Illustrative Compound AII-1 with diglycolic anhydride.

1-11. Synthesis Example of Illustrative Compound AII-38:

Illustrative Compound AII-38 was synthesized in the same manner, except for replacing succinic anhydride used in Illustrative Compound AII-1 with phthalic anhydride.

1-12. Synthesis Example of Illustrative Compound AII-40:

Illustrative Compound AII-40 was synthesized in the same manner, except for replacing succinic anhydride used in Illustrative Compound AII-1 with 3,3-dimethylglutaric anhydride.

1-13. Synthesis Example of Illustrative Compound AIV-10:

Illustrative Compound AIV-10 was synthesized in the same manner, except for replacing pentaerythritol used in Illustrative Compound AII-1 with N,N,N',N",N"-pentakis(2-hydroxypropyl)diethylenetriamine.

1-14. Synthesis Example of Illustrative Compound AV-1:

As for Illustrative Compound AV-1, pentaerythritol used in Illustrative Compound AII-1 was replaced with an equivalent amount of glycidyl alcohol to prepare a glycidyl ester of 3-(1-docosanyl polyethyleneoxycarbonyl)propionic acid, and a crystal was deposited from methanol. After drying under reduced pressure, 1.05 g of the crystal was dissolved in dichloromethane, to which was then added 0.02 mL of $BF_3$ ethelate, and the mixture was stirred at room temperature for 5 hours. A deposited white crystal was filtered, washed with methanol and then dried under reduced pressure to obtain a desired material (Mw: 7,800).

1-15. Synthesis Example of Illustrative Compound AVII-10:

As for Illustrative Compound AVII-10, first of all, the preparation was carried out in the same manner, except for replacing the acrylate working as a monomer thereof with an acid chloride of 3-(1-docosanyl polyethyleneoxycarbonyl) propionic acid used in Illustrate Compound AII-1 and using an equivalent amount of hydroxyethyl acrylate in place of pentaerythritol, and a crystal was deposited from methanol. After drying under reduced pressure, 1.485 g of the crystal was dissolved in toluene, to which was then added 13.7 mg of a radical generator V601, and the mixture was stirred at 100° C. for 5 hours. Methanol was added, and a deposited white crystal was filtered, washed with methanol and then dried under reduced pressure to obtain 0.98 g of a desired material (Mw: 13,800).

Various illustrative compounds were prepared in the similar manner as the above. Regarding some of them, their NMR spectra data, IR data and melting point are shown below.

Illustrative Compound AII-1:

$^1$H NMR (400 MHz, $CDCl_3$): δ4.24 (8H, t), 4.13 (8H, s), 3.65 (64H, m), 3.44 (8H, t), 2.64 (16H, dd), 1.58 (16H, t), 1.25 (160H, br), 0.88 (12H, t).

IR data (neat) $cm^{-1}$: 2924 (s), 2853 (s), 1739 (s), 1465 (s), 1350 (s), 1146 (s), 720 (m).

Melting point: 63.5-64.0 degrees Celsius.

Illustrative Compound AII-2:

$^1$H NMR (300 MHz, $CDCl_3$): δ4.24 (8H, t), 4.13 (8H, s), 3.65 (64H, m), 3.44 (8H, t), 2.65 (12H, br), 1.57 (8H, t), 1.25 (160H, br), 0.88 (12H, t).

IR data (neat) $cm^{-1}$: 2927 (s), 2854 (s), 1741 (s), 1464 (s), 1350 (m), 1146 (s), 720 (w).

Melting point: 64.7-65.2 degrees Celsius

Illustrative Compound AII-3:

$^1$H NMR (400 MHz, $CDCl_3$): δ4.24 (8H, t), 4.13 (8H, s), 3.65 (72H, m), 3.44 (8H, t), 2.64 (16H, m), 1.57 (16H, t), 1.26 (144H, br), 0.88 (12H, t).

IR data (neat) $cm^{-1}$: (neat): 2924 (s), 2852 (s), 1738 (s), 1465 (s), 1350 (s), 1140 (b), 858 (m), 720 (m).

Melting point: 55.1-55.6 degrees Celsius

Illustrative Compound AII-4:

$^1$H NMR (400 MHz, $CDCl_3$): δ4.24 (8H, t), 4.13 (8H, s), 3.65 (64H, m), 3.44 (8H, t), 2.63 (16H, m), 1.57 (8H, t), 1.25 (128H, br), 0.88 (12H, t).

IR data (neat) $cm^{-1}$: 2932 (s), 2859 (s), 1746 (s), 1465 (s), 1350 (s), 1156 (b), 856 (m), 720 (w).

Melting point: 46.0-47.0 degrees Celsius

Illustrative Compound AII-5:

$^1$H NMR (400 MHz, $CDCl_3$): δ4.24 (8H, t), 4.13 (8H, s), 3.65 (64H, m), 3.44 (8H, t), 2.64 (16H, s), 1.57 (16H, t), 1.25 (120H, br), 0.88 (12H, t).

IR data (neat) $cm^{-1}$: 2924 (s), 2853 (s), 1740 (s), 1464 (s), 1350 (s), 1144 (s), 718 (m).

Melting point: 47.0-47.8 degrees Celsius

Illustrative Compound AII-6:

$^1$H NMR (300 MHz, $CDCl_3$): δ4.24 (8H, t), 4.13 (8H, s), 3.65 (80H, m), 3.44 (8H, t), 2.64 (16H, d), 1.57 (16H, br), 1.25 (120H, br), 0.88 (12H, t).

IR data (neat) $cm^{-1}$: 2920 (s), 2852 (s), 1737 (s), 1458 (s), 1350 (s), 1105 (b), 862 (m), 719 (m).

Melting point: 35.3-35.8 degrees Celsius

Illustrative Compound AII-7:

$^1$H NMR (300 MHz, $CDCl_3$): δ4.24 (8H, br), 4.13 (8H, s), 3.65 (80H, m), 3.44 (8H, t), 2.64 (16H, s), 1.57 (8H, br), 1.26 (96H, br), 0.88 (12H, t).

IR data (neat) $cm^{-1}$: 2925 (s), 2854 (s), 1740 (s), 1465 (m), 1350 (m), 1253 (s), 1147 (s).

Melting point: oil at a room temperature

Illustrative Compound AII-8:

$^1$H NMR (300 MHz, $CDCl_3$): δ4.24 (8H, t), 4.13 (8H, s), 3.65 (60H, m), 3.44 (8H, t), 2.64 (16H, s), 1.59 (40H, br), 1.26 (96H, m), 0.88 (12H, t).

IR data (neat) $cm^{-1}$: 2927 (s), 2855 (s), 1740 (s), 1465 (m), 1350 (m), 1252 (s), 1152 (s), 1038 (m), 859 (w).

Melting point: 39.5-40.5 degrees Celsius

Illustrative Compound AII-14:

$^1$H NMR (300 MHz, $CDCl_3$): δ4.24 (8H, t), 4.13 (8H, s), 3.65 (64H, m), 3.44 (8H, t), 2.64 (16H, m), 1.57 (8H, t), 1.25 (160H, br), 0.88 (12H, t).

IR data (neat) $cm^{-1}$: 2928 (s), 2854 (s), 1742 (s), 1465 (m), 1351 (s), 1250 (s), 1150 (s), 720 (w).

Melting point: 63.6-64.4 degrees Celsius

Illustrative Compound AII-15:

$^1$H NMR (400 MHz, $CDCl_3$): δ4.24 (8H, t), 4.13 (8H, s), 3.65 (104H, m), 3.44 (8H, t), 2.64 (16H, m), 1.57 (8H, t), 1.25 (168H, br), 0.88 (12H, t).

IR data (neat) $cm^{-1}$: 2925 (s), 2853 (s), 1740 (s), 1465 (s), 1350 (s), 1147 (b), 865 (m), 720 (m).

Melting point: 61.9-62.9 degrees Celsius

Illustrative Compound AII-16:

$^1$H NMR (300 MHz, $CDCl_3$): δ4.24 (8H, t), 4.13 (8H, s), 3.65 (120H, m), 3.44 (8H, t), 2.64 (16H, s), 1.57 (8H, br), 1.25 (160H, br), 0.88 (12H, t).

IR data (neat) $cm^{-1}$: 2925 (s), 2854 (s), 2361 (w), 1740 (s), 1558 (w), 1457 (w), 1250 (s), 1146 (b).

Melting point: 59.3-60.3 degrees Celsius

Illustrative Compound AII-17:

$^1$H NMR (400 MHz, $CDCl_3$): δ4.23 (8H, t), 4.13 (8H, s), 3.64 (144H, m), 3.57 (8H, m), 3.44 (8H, t), 2.64 (16H, m), 1.57 (8H, t), 1.25 (160H, br), 0.88 (12H, t).

IR data (neat) $cm^{-1}$: 2925 (s), 2854 (s), 1741 (s), 1465 (m), 1351 (w), 1144 (s).

Melting point: 55.6-56.3 degrees Celsius

Illustrative Compound AII-18:

$^1$H NMR (300 MHz, $CDCl_3$): δ4.24 (8H, t), 4.13 (8H, s), 3.64 (288H, m), 3.44 (8H, t), 2.64 (16H, m), 1.59 (32H, br), 1.25 (160H, br), 0.88 (12H, t).

IR data (neat) $cm^{-1}$: 2924 (s), 2854 (s), 1738 (s), 1459 (s), 1349 (s), 1250 (s), 1109 (b), 857 (m).

Melting point: 43.8-47.1 degrees Celsius

Illustrative Compound AII-19:

$^1$H NMR (300 MHz, $CDCl_3$): δ4.24 (8H, t), 4.13 (8H, s), 3.64 (424H, m), 3.44 (16H, t), 2.64 (16H, m), 1.59 (40H, br), 1.25 (160H, br), 0.88 (12H, t).

IR data (neat) $cm^{-1}$: 2925 (s), 2856 (s), 1739 (s), 1460 (m), 1350 (s), 1296 (s), 1251 (s), 1119 (b), 946 (m), 857 (m).

Melting point: 46.4-47.4 degrees Celsius

Illustrative Compound AII-33:

$^1$H NMR (400 MHz, $CDCl_3$): δ4.30 (8H, t), 4.21 (8H, s), 3.65 (72H, m), 3.45 (16H, m), 3.24 (8H, t), 1.57 (8H, t), 1.25 (160H, br), 0.88 (12H, t).

IR data (neat) $cm^{-1}$: 3481 (b), 2924 (s), 2853 (s), 1739 (s), 1648 (m), 1559 (w), 1465 (s), 1266 (b), 1129 (b), 1041 (s), 720 (m).

Melting point: 65.5-66.5 degrees Celsius

Illustrative Compound AII-34:

$^1$H NMR (400 MHz, $CDCl_3$): δ4.23 (8H, m), 4.11 (8H, s), 3.65 (80H, m), 3.44 (8H, t), 2.41 (16H, t), 1.96 (8H, tt), 1.59 (8H, br), 1.25 (160H, br), 0.88 (12H, t).

IR data (neat) $cm^{-1}$: 3495 (b), 2930 (s), 2855 (s), 1740 (s), 1464 (s), 1351 (m), 1136 (s), 720 (w).

Melting point: 59.9-61.6 degrees Celsius

Illustrative Compound AII-36:

$^1$H NMR (300 MHz, $CDCl_3$): δ6.88 (4H, d), 6.84 (4H, d), 4.33 (16H, m), 3.64 (64H, m), 3.44 (16H, t), 1.57 (8H, br), 1.25 (160H, m), 0.88 (12H, t).

IR data (neat) $cm^{-1}$: 2923 (s), 2853 (s), 1728 (s), 1465 (s), 1351 (m), 1292 (s), 1254 (s), 1146 (s), 769 (s), 720 (m).

Melting point: 60.2-61.5 degrees Celsius

Illustrative Compound AII-37:

$^1$H NMR (300 MHz, $CDCl_3$): δ4.32 (8H, t), 4.27 (16H, s), 4.23 (8H, s), 3.72 (8H, m), 3.65 (80H, m), 3.44 (8H, t), 1.57 (8H, br), 1.25 (160H, br), 0.88 (12H, t).

IR data (neat) $cm^{-1}$: 2926 (s), 2854 (s), 1758 (s), 1465 (s), 1351 (m), 1204 (s), 1138 (s), 720 (m).

Melting point: 60.6-63.8 degrees Celsius

Illustrative Compound AII-38:

$^1$H NMR (300 MHz, $CDCl_3$): δ7.74 (8H, m), 7.54 (8H, m), 4.46 (8H, t), 3.91 (8H, s), 3.80 (8H, t), 3.64 (80H, m), 3.44 (8H, t), 1.64 (16H, br), 1.25 (152H, m), 0.88 (12H, t).

IR data (neat) $cm^{-1}$: 2925 (s), 2854 (s), 1733 (s), 1465 (w), 1287 (s), 1122 (s), 743 (w).

Melting point: 64.7-65.7 degrees Celsius

Illustrative Compound AII-40:

$^1$H NMR (400 MHz, $CDCl_3$): δ4.22 (8H, m), 4.09 (8H, s), 3.64 (72H, m), 3.44 (8H, t), 2.43 (8H, t), 1.56 (8H, br), 1.25 (160H, m), 1.09 (24H, s), 0.88 (12H, t)

IR data (neat) $cm^{-1}$: 2924 (s), 2853 (s), 1737 (m), 1465 (m), 1287 (m), 1123 (s).

Melting point: 53.1-53.7 degrees Celsius

Illustrative Compound AII-41:

$^1$H NMR (300 MHz, $CDCl_3$): δ4.50 (8H, s), 4.35 (8H, t), 3.67 (96H, m), 3.48 (8H, m), 1.58 (8H, br), 1.25 (160H, m), 0.88 (12H, t).

IR data (neat) $cm^{-1}$: 2927 (s), 2855 (s), 1780 (s), 1465 (m), 1246 (m), 1178 (s), 942 (m).

Melting point: 56.2-57.0 degrees Celsius

Illustrative Compound AII-42:

$^1H$ NMR (300 MHz, $CDCl_3$): δ8.09 (4H, t), 8.00 (4H, s), 4.32 (8H, m), 4.16 (4H, t), 4.06 (4H, t), 3.67 (64H, m), 2.87 (24H, t), 1.61 (8H, br), 1.26 (160H, br), 0.88 (12H, t)

IR data (neat) $cm^{-1}$: 2925 (s), 2854 (s), 1780 (s), 1734 (s), 1465 (s), 1258 (s), 1153 (b), 1028 (s), 720 (w).

Melting point: 58.2-59.2 degrees Celsius

Illustrative Compound AII-43:

$^1H$ NMR (300 MHz, $CDCl_3$): δ4.52 (8H, s), 4.46 (8H, t), 3.77 (8H, t), 3.64 (64H, m), 3.44 (8H, t), 1.74 (16H, br), 1.56 (8H, t), 1.25 (160H, m), 0.88 (12H, t).

IR data (neat) $cm^{-1}$: 2925 (s), 2853 (s), 1747 (m), 1631 (m), 1519 (s), 1479 (s), 1396 (s), 1323 (s), 1214 (b), 1119 (s), 721 (m).

Melting point: 55.4-56.4 degrees Celsius

Illustrative Compound AII-65:

$^1H$ NMR (400 MHz, $CDCl_3$): δ4.24 (8H, t), 4.14 (8H, s), 3.64 (88H, m), 3.56 (8H, t), 3.32 (8H, d), 2.64 (16H, d), 1.59 (40H, br), 1.26 (84H, br), 0.85 (76H, m), 0.75 (12H, t).

IR data (neat) $cm^{-1}$: 2955 (s), 2926 (s), 2858 (s), 1737 (s), 1460 (s), 1378 (s), 1349 (s), 1248 (s), 1105 (s), 1038 (s), 861 (m).

Melting point: oil at a room temperature

Illustrative Compound AII-88:

$^1H$ NMR (400 MHz, $CDCl_3$): δ4.24 (8H, t), 4.14 (8H, s), 3.64 (88H, m), 3.56 (8H, t), 3.32 (8H, d), 2.64 (16H, d), 1.59 (40H, br), 1.26 (84H, br), 0.85 (76H, m), 0.75 (12H, t).

IR data (neat) $cm^{-1}$: 2955 (s), 2926 (s), 2858 (s), 1737 (s), 1460 (s), 1378 (s), 1349 (s), 1248 (s), 1105 (s), 1038 (s), 861 (m).

Melting point: oil at a room temperature

Illustrative Compound AII-89:

$^1H$ NMR (400 MHz, $CDCl_3$): δ4.24 (8H, t), 4.14 (8H, s), 3.64 (88H, m), 3.56 (8H, t), 3.32 (8H, d), 2.64 (16H, d), 1.59 (40H, br), 1.26 (84H, br), 0.85 (76H, m), 0.75 (12H, t).

IR data (neat) $cm^{-1}$: 2955 (s), 2926 (s), 2858 (s), 1737 (s), 1460 (s), 1378 (s), 1349 (s), 1248 (s), 1105 (s), 1038 (s), 861 (m).

Melting point: oil at a room temperature

Illustrative Compound AII-90:

$^1H$ NMR (400 MHz, $CDCl_3$): δ4.24 (8H, t), 4.14 (8H, s), 3.64 (88H, m), 3.56 (8H, t), 3.32 (8H, d), 2.64 (16H, d), 1.59 (40H, br), 1.26 (84H, br), 0.85 (76H, m), 0.75 (12H, t).

IR data (neat) $cm^{-1}$: 2955 (s), 2926 (s), 2858 (s), 1737 (s), 1460 (s), 1378 (s), 1349 (s), 1248 (s), 1105 (s), 1038 (s), 861 (m).

Melting point: oil at a room temperature

Illustrative Compound AIV-10:

$^1H$ NMR (400 MHz, $CDCl_3$): δ4.25 (10H, t), 4.08 (H, t), 3.65 (50H, m), 3.45 (10H, t), 3.09 (3H, m), 2.63 (20H, br), 1.58 (10H, m), 1.26 (190H, br), 0.88 (15H, t).

IR data (neat) $cm^{-1}$: 3454 (b), 2917 (s), 2849 (s), 1954 (b), 1733 (s), 1646 (m), 1576 (s), 1469 (s), 1377 (s), 1350 (s), 1250 (s), 1137 (b), 993 (s), 950 (b), 877 (m), 839 (m), 721 (s).

Melting point: 60.3-60.9 degrees Celsius

Illustrative Compound AV-1:

$^1H$ NMR (400 MHz, $CDCl_3$): δ4.25 (2H, t), 4.08 (2H, m), 3.65 (12H, m), 3.44 (2H, t), 2.67 (4H, br), 1.57 (2H, m), 1.25 (38H, br), 0.88 (3H, t).

IR data (neat) $cm^{-1}$: 3454 (b), 2916 (s), 2849 (s), 1736 (s), 1635 (w), 1467 (s), 1411 (s), 1350 (s), 1251 (s), 1126 (b), 949 (m), 862 (m), 720 (s).

Melting point: 62.4-63.4 degrees Celsius

Illustrative Compound AVII-10:

$^1H$ NMR (400 MHz, $CDCl_3$): δ4.22 (4H, br), 3.65 (72H, m), 3.44 (2H, t), 2.64 (4H, br), 1.78 (2H, s), 1.57 (2H, m), 1.25 (38H, br), 0.88 (3H, t).

IR data (neat) $cm^{-1}$: 3587 (b), 2916 (s), 2850 (s), 1971 (b), 1735 (s), 1641 (w), 1470 (s), 1345 (s), 1281 (s), 1243 (s), 1113 (b), 962 (s), 844 (s), 718 (m).

Melting point: 45.3-45.9 degrees Celsius

2. Test Example 1 (Evaluation of Compound)

As for the Illustrative Compounds and Comparative Compounds, a lubricating characteristic was evaluated using Optimol's reciprocating friction and wear tester (SRV) under the following condition.

Evaluation and Measurement Methods by Reciprocating (SRV) Friction and Wear Test:

A coefficient of friction was evaluated using a reciprocating (SRV) friction and wear tester under the following test condition.

Test piece (friction material): SUJ-2

Plate: 24 mm in diameter×7 mm in thickness, surface roughness: 0.45 to 0.65 μm

Cylinder: 15 mm in diameter×22 mm in width, surface roughness: up to 0.05 μm

Temperature: 30 to 150° C.

Load: 50 N, 75 N, 100 N, 200 N and 400 N

Amplitude: 1.5 mm

Frequency: 50 Hz

Time change pattern of temperature and load

The temperature was initially set up at 90° C., and after keeping for a certain period of time, it was dropped to the neighborhood of a melting point of each raw material by 10° C. at intervals of ten minutes. Thereafter, the temperature was similarly increased to 150° C. and further dropped to 50° C.

The pressure (load) was changed in a manner of 50 N→75 N→100 N→200 N→400 N→50 N at intervals of one minute twice at 90° C. and once at 120° C. and 150° C., respectively.

The illustrative compounds used for the evaluation are AII-1, 2, 17, 18 and 65. Moreover, as the comparative compounds, alkyleneoxy group-free pentaerythritol tetrastearate ($C(CH_2OCOC_{17}H_{35}\text{-}n)_4$: Comparative Compound C-1) and $C\{CH_2O(C_2H_4O)_{6.5}C_{22}H_{45}\text{-}n\}_2$ (Comparative Compound C-2), the both of which are a compound generally used as a lubricant, were used, respectively.

The measurement results are shown in FIGS. 1 to 4.

On review of the measurement results shown in FIGS. 1 to 4, it can be understood that Illustrative Compounds AII-1, AII-2, AII-17, AII-18 and AII-65 are conspicuously small in the coefficient of friction as compared with Comparative Compounds C-1 and C-2.

It is noted that in all of Illustrative Compounds AII-1, AII-2, AII-17, AII-18 and AII-65 of the formula (Z), the coefficient of friction abruptly increases in the vicinity of the melting point at the time of first temperature drop. It may be conjectured that this is an increase of the coefficient of friction to be caused due to an abrupt increase of the viscosity getting close to the melting point. Moreover, it may be considered that in view of the fact that the coefficient of friction does not depend upon a change of the viscosity so much in the subsequent temperature increase and temperature drop processes, the material is in a fluid lubricating state in a low temperature region in the vicinity of the melting point, whereas it is an elastic fluid lubrication region at a temperature higher than that temperature.

On the other hand, in all of Comparative Compounds C-1 and C-2, the melting point is not higher than 60° C., an increase of the coefficient of friction is seen in the vicinity thereof, and the coefficient of friction is not influenced by a change of the temperature at a temperature higher than that temperature. It may be considered that these compounds undergo frictional sliding in a region of from fluid lubrication to elastic fluid lubrication similarly to the foregoing illustrative compounds.

In Illustrative Compound AII-65 having the lowest viscosity among these compounds, it can be understood that the coefficient of friction exhibits distinct positive temperature dependency, and it may be considered from the Stribeck curve that it is suggested that AII-65 relatively contributes to mixed lubrication.

Since all of other compounds than Illustrative Compound AII-65 exhibit a similar melting point, it is safe to consider that the viscosity of these compounds is also similar. So, in view of the fact that the coefficients of friction of Illustrative Compounds AII-1, AII-2, AII-17, AII-18 and AII-65 are conspicuously different from the coefficients of friction of Comparative Compounds C-1 and C-2, it may be considered from the Barus equation: $\eta=\eta_0\exp(\alpha P)$, which expresses the pressure dependency of viscosity, there is a significant difference in the viscosity $\eta$ under a high pressure P in an elastic fluid lubrication region, namely a viscosity-pressure modulus $\alpha$. This is one of the characteristic features of the group of compounds of the invention.

Moreover, results obtained by evaluating a wear depth of the sliding part of the test piece after the frictional sliding test of each of the compounds using a laser microscope are shown below.

TABLE 1

| Compound No. | Wear Depth [μm] |
|---|---|
| Illustrative Compound AII-1 | 0.07 |
| Illustrative Compound AII-2 | 0.05 |
| Illustrative Compound AII-17 | 0.03 |
| Illustrative Compound AII-18 | 0.02 |
| Illustrative Compound AII-65 | 0.08 |
| Compound C-1 for comparative Example | 0.25 |
| Compound C-2 for comparative Example | 0.32 |

The following can be understood from the results shown in the table.

When the illustrative compounds of the formula (Z) were utilized, the wear depth was extremely shallow, and a sliding scar itself was not substantially observed. On the other hand, when the comparative compounds were utilized, a distinct sliding scar was observed in all of the cases. That is, as for the wear depth, there was generated a distinct difference between the illustrative compounds and the comparative compounds.

3. Test Example 2 (Evaluation of Oily Medium Dispersion Composition)

As for the compositions of the invention and the comparative compositions, a lubricating characteristic was evaluated using Optimol's reciprocating friction and wear tester (SRV) under the following condition.

Evaluation and Measurement Methods by Reciprocating (SRV) Friction and Wear Test:

A coefficient of friction and wear resistance were evaluated using a reciprocating (SRV) friction and wear tester, and a friction and wear test was carried out under the following test condition.

Lubricant composition:

SUPER OIL N-32 (manufactured by Nippon Oil Corporation) which is a mineral oil was used as an oily medium, to which was then added Illustrative Compound AII-1 in a concentration of 1.0% by mass; the mixture was heated to 70° C. to form a transparent solution; and after air cooling for 10 minutes, this composition was tested under the following condition. This composition became cloudy step-by-step at the time of air cooling.

Test piece (friction material): SUJ-2

Plate: 24 mm in diameter×7 mm in thickness, surface roughness: 0.45 to 0.65 μm

Cylinder: 15 mm in diameter×22 mm in width, surface roughness: up to 0.05 μm

Temperature: 25 to 110° C.

Load: 50 N, 75 N, 100 N, 200 N and 400 N

Amplitude: 1.5 mm

Frequency: 50 Hz

Test method:

About 60 mg of the sample composition was placed in a portion where the cylinder slid on the plate and subjected to frictional sliding according to the following steps, thereby evaluating a coefficient of friction at each temperature and each load, and the following steps were repeated until a substantially constant pattern was obtained. After the completion, a wear depth of the plate was evaluated by a laser microscope.

Similarly, SUPER OIL N-32 (manufactured by Nippon Oil Corporation) which is a mineral oil was used as an oily medium, to which was then added each of the following illustrative compounds in a concentration of 1.0% by mass in place of Illustrative Compound AII-1, thereby evaluating the dependency of the coefficient of friction on temperature, pressure and lapsing time. Among the test sample compositions, as for sample compositions prepared using each of Illustrative Compounds AII-1, 3, 4, 5, 6, 7, 8, 14, 16, 17, 18, 19, 33, 34, 36, 37, 38, 40, 41, 42, 43, 65, 88, 89 and 90, AIV-10, AV-1 and AVII-10 and similarly, as for a sample composition prepared by adding AII-88 (concentration: 0.60% by mass) and Diester Y-10 whose structure is corresponding to AII-88 (concentration: 0.40% by mass) in a concentration of 1.0% by mass in terms of a total sum to SUPER OIL N-32 (manufactured by Nippon Oil Corporation) which is a mineral oil as an oily medium, the dependency of the coefficient of friction on temperature, pressure and lapsing time was evaluated. The results are shown in respective graphs shown in FIGS. 5 to 22.

Moreover, compositions were similarly prepared using, as a comparative compound, each of compounds which are a pentaerythritol derivative but do not contain a polyalkyleneoxy group, specifically Comparative Compound C-3 ($C(CH_2OCOC_2H_4CO_2C_{22}H_{45}\text{-}n)_4$) and Comparative Compound C-6 ($C(CH_2OCOC_{17}H_{35}\text{-}n)_4$) and tested. The rest results are shown in a graph shown in FIG. 23.

Moreover, as a referential example, only SUPER OIL N-32 used as an oily medium, which is a mineral oil, was similarly tested. The results are shown in a graph shown in FIG. 24.

As shown in FIG. 5, it can be understood that the sample prepared utilizing Illustrative Compound AII-1 exhibits a low friction of friction such that the coefficient of friction at 25° C. is not more than 0.05. As shown in FIG. 1, since Illustrative Compound AII-1 is singly a crystal having a melting point of from 63.5 to 64.0° C., its coefficient of friction of SRV at 25° C. was 0.3 or more because of its high viscosity. Moreover, as shown in FIG. 24, SUPER OIL N-32 used as an oily medium, which is a mineral oil, singly exhibits a coefficient of friction at 25° C. of 0.07 or more. From this fact, it may be considered that in a state where Illustrative Compound AII-1 is dispersed in a concentration of 1.0% by mass in SUPER OIL N-32, the both do not work singly but mutually work as some kind of interaction, thereby revealing this small coefficient of friction.

In general, if a low-viscosity fluid and a high-viscosity fluid are present in the vicinity of an interface and produce a high shear field, the matter that the high-viscosity fluid forms a smooth coating film by shear in the vicinity of the harder interface, and the low-viscosity fluid is interposed in a gap between the both interfaces, thereby revealing a lower coefficient of friction conforms with the reason of lubrication, and it is suggested that such a phenomenon occurs.

In the sample containing Illustrative Compound AII-1, the coefficient of friction abruptly increases to 0.09 with an increase of the temperature, and that coefficient of friction is kept in the range of from 60 to 110° C. without utterly depending upon the temperature. It may be supposed that this is caused due to the fact that this lubrication state resides in elastic fluid lubrication but not boundary lubrication. This is because as shown in FIG. 24, the coefficient of friction of SUPER OIL N-32 which is a fluid with lower viscosity exhibits distinct positive temperature dependency, and it is strongly suggested that SUPER OIL N-32 slides in a mixed lubrication region; and therefore, it is hardly considered that SUPER OIL N-32 abruptly comes into the boundary lubrication in a field where a fluid with higher viscosity coexists.

As shown in FIGS. 5 to 22, as for the samples prepared utilizing other illustrative compounds, the same behavior as that in Illustrative Compound AII-1 was observed.

Moreover, in the case of adding Illustrative Compound AII-88 with corresponding Diester Y-10 thereto, in comparison with the single use of AII-88, by adding Y-10, not only the temperature dependency of the coefficient of friction is small, but the coefficient of friction in a high-temperature region is small, and a friction reducing effect by the addition of the diester was confirmed.

On the other hand, it can be understood that all of the compositions prepared utilizing Comparative Compounds C-3 and C-6, respectively are high in the coefficient of friction as compared by the compositions prepared utilizing each of the illustrative compounds.

A measurement value of a wear scar depth of the sliding part of each of the samples after the frictional sliding test is shown below. In this connection, Comparative Compound C-4 is $C\{CH_2O(C_2H_4O)_{6.5}C_{22}H_{45}\text{-}n\}_2$.

TABLE 2

| Material No. | Wear Depth [μm] |
|---|---|
| AI-1 | 0.33 |
| AI-2 | 0.25 |
| AI-3 | 0.23 |
| AI-4 | 0.14 |
| AI-5 | 0.13 |
| AI-6 | 0.28 |
| AI-7 | 0.45 |
| AI-8 | 0.22 |
| AI-12 | 0.18 |
| AI-15 | 0.09 |
| AI-22 | 0.34 |
| AI-26 | 0.28 |
| AI-30 | 0.41 |
| AI-32 | 0.33 |
| AI-34 | 0.25 |
| AI-55 | 0.24 |
| AI-58 | 0.14 |
| AI-68 | 0.53 |
| AI-71 | 0.15 |
| AI-76 | 0.20 |

TABLE 2-continued

| Material No. | Wear Depth [μm] |
|---|---|
| AII-1 | 0.08 |
| AII-2 | 0.13 |
| AII-3 | 0.13 |
| AII-4 | 0.09 |
| AII-5 | 0.07 |
| AII-6 | 0.08 |
| AII-7 | 0.14 |
| AII-8 | 0.07 |
| AII-15 | 0.25 |
| AII-16 | 0.14 |
| AII-17 | 0.06 |
| AII-18 | 0.07 |
| AII-19 | 0.12 |
| AII-21 | 0.21 |
| AII-23 | 0.09 |
| AII-24 | 0.16 |
| AII-33 | 0.11 |
| AII-34 | 0.13 |
| AII-35 | 0.23 |
| AII-36 | 0.22 |
| AII-37 | 0.12 |
| AII-38 | 0.11 |
| AII-39 | 0.07 |
| AII-40 | 0.11 |
| AII-41 | 0.13 |
| AII-42 | 0.10 |
| AII-43 | 0.19 |
| AII-48 | 0.14 |
| AII-49 | 0.32 |
| AII-50 | 0.22 |
| AII-54 | 0.23 |
| AII-57 | 0.24 |
| AII-59 | 0.33 |
| AII-60 | 0.23 |
| AII-64 | 0.22 |
| AII-65 | 0.14 |
| AIII-1 | 0.09 |
| AIII-2 | 0.09 |
| AIII-7 | 0.21 |
| Comparative Example C-3 | 0.69 |
| Comparative Example C-4 | 0.98 |
| Comparative Example C-6 | 1.23 |
| Mineral Oil (N-32) | 1.07 |

It can be understood that the samples of the Examples of the invention are markedly shallow in the wear scar and excellent in the wear resistance as compared with those of the Comparative Examples.

In this connection, as compared with the wear scar depths of Test Example 1, the results of Test Example 2 generally exhibit large values. That appears to be very natural because in Test Example 2, the compound is used singly for the sample so that elastic fluid lubrication in an approximately thick film thickness is revealed, whereas in the present test example, only 1% by mass of the compound is contained in SUPER OIL N-32 as a low-viscosity oil. In addition, since the foregoing results include an example giving the same results as those obtained under the non-dilution condition of Test Example 1, it can be understood that the compositions of the Examples of the invention also have excellent properties regarding the wear resistance.

4. Test Example 3

Compositions were similarly prepared by using each of a commercially available poly-α-olefin (manufactured by Nippon Oil Corporation), a polyol ester (POE), a commercially available fluid and N-methylpyrrolidone as the oily medium in place of SUPER OIL N-32 which is a mineral oil and adding Illustrative Compound AII-4 in a concentration of 1.0% by mass thereto and then evaluated for the dependency of the coefficient of friction on temperature, pressure and lapsing time in the same manner as in Test Example 2. The results are shown in respective graphs shown in FIGS. 25 to 26.

From the results shown in FIGS. 25 to 26, it can be understood that even compositions prepared using any material as the oily medium exhibit a low coefficient of friction.

5. Test Example 4

A reciprocating (SRV) friction and wear test was carried out under the following condition. However, the evaluation was conducted on polyetheretherketone as a resin and aluminum oxide as a ceramic as other raw material than steel. A coefficient of friction and wear resistance were evaluated using a reciprocating (SRV) friction and wear tester, and a friction and wear test was carried out under the following test condition.

Preparation of Sample:

SUPER OIL N-32 (manufactured by Nippon Oil Corporation) which is a mineral oil was used as a base oil, to which was then added Illustrative Compound AII-1 in a concentration of 1.0% by mass, and the mixture was heated to 70° C. to form a transparent solution, followed by air cooling for 10 minutes, thereby obtaining a dispersion composition for sample. This sample became cloudy step-by-step at the time of air cooling.

Test Condition:

The above-prepared sample was tested under the following condition.

Test piece (friction material): SUJ-2

Cylinder: 15 mm in diameter×22 mm in width, surface roughness: up to 0.05 μm

Plate: 24 mm in diameter×7 mm in thickness, surface roughness: 0.45 to 0.65 μm

Temperature: 30 to 180° C.

Load: 50 N, 75 N, 100 N, 200 N and 400 N

Amplitude: 1.5 mm

Frequency: 50 Hz

Test method:

About 60 mg of the foregoing sample was placed in a portion where the cylinder slid on the plate and subjected to frictional sliding according to the following steps, thereby evaluating a coefficient of friction at each temperature and each load.

(1) A coefficient of friction with time is measured until a fluctuation of a value of the coefficient of friction at 30° C. under 50 N for 10 minutes becomes not more than 0.01.

(2) The sample is heated under 50 N by increasing the temperature from 30° C. to 110° C. at intervals of 10° C., thereby measuring a coefficient of friction at each temperature.

(3) The same is cooled to 30° C.

(4) (30 minutes after starting the cooling), a coefficient of friction is measured at 30° C. under 50 N, 75 N, 100 N, 200 N and 400 N, respectively.

(5) The sample is heated by increasing the temperature from 30° C. to 110° C. at intervals of 10° C., thereby measuring a coefficient of friction at each temperature. However, a coefficient of friction is measured at each of 60° C. and 90° C. under 50 N, 75 N, 100 N, 200 N and 400 N, respectively.

(6) (3) to (6) are repeated until a difference of the coefficient of friction at 70° C. or higher from the last is not substantially found.

(7) The sample is cooled to 30° C.

(8) (30 minutes after starting the cooling), the temperature is increased from 30° C. to 180° C. at intervals of 10° C., thereby measuring a coefficient of friction at each temperature.

However, a coefficient of friction is measured at each of 60° C., 90° C., 120° C., 150° C. and 180° C. under 50 N, 75 N, 100 N, 200 N and 400 N, respectively.

(9) (5) and (6) are conducted, thereby finishing the operations.

The dependency of the coefficient of friction on temperature and pressure having become constant was evaluated with respect to each of a plate made of steel (SUJ-2), a plate obtained by forming a DLC thin film on steel by a CVD method, a plate made of polyetheretherketone and a plate made of aluminum oxide.

Plate 1: 24 mm in diameter×7 mm in thickness, material quality: diamond-like carbon, film thickness: 35 nm, surface roughness: not more than 0.01 μm Plate 2: 24 mm in diameter×7 mm in thickness, material quality: polyetheretherketone, surface roughness: up to than 0.05 μm Plate 3: 24 mm in diameter×7 mm in thickness, material quality: aluminum oxide, surface roughness: up to than 0.15 μm The results of the foregoing test are shown in FIG. 27. From the results shown in FIG. 27, it can be understood that the coefficient of friction increases in the order of DLC (diamond-like carbon)<PEEK<Fe (SUJ-2)<aluminum oxide at a low temperature. However, in this region, the film of Illustrative Compound AII-1 is much more hard, so that it may be conjectured that the mineral oil N-32 used as a base oil reveals fluid lubrication in a gap relative to the thin film of Illustrative Compound AII-1. If this conjecture is agreeable, it may be considered that this difference in the coefficient of friction is one reflecting the film thickness of the fluid film of the mineral oil N-32 to be caused by Illustrative Compound AII-1 existing on the interface, in its turn, the surface roughness of a base thereof. From a region where the temperature exceeds 100° C., a lowering of the coefficient of friction of each of the SUJ-2 and aluminum oxide plates is seen. However, in this region, Illustrative Compound AII-1 is in an elastic fluid lubrication region, and it may be conjectured that an influence of the surface roughness of the interface base is also revealed here together with the effect of elastic deformation. The diamond-like carbon coating film was separated on the way because the adhesion to steel was not sufficient. However, it is evident that all of the samples give a low coefficient of friction as compared with that obtained using the current lubrication technologies.

6. Test Example 5

As for a phenomenon in which Illustrative Compound AII-1 of the invention is segregated in the sliding part, the present inventor spectrally observed a neighborhood of a point-contacting portion of an instrument using a point contact EHL evaluation apparatus for evaluating an elastic fluid lubrication region in the technical field of tribology and succeeded in quantitatively grasping a change of material concentration at a high load in a high shear field. Specifically, the observation was carried out in the following manner.

Preparation of Sample:

First of all, Illustrative Compound AII-1 was dispersed in an oily medium to prepare a sample. SUPER OIL N-32 (manufactured by Nippon Oil Corporation) which is a mineral oil was used as the oily medium, to which was then added Illustrative Compound AII-1 in a concentration of 1.0% by mass, and the mixture was heated to 70° C. to form a transparent solution, followed by air cooling for 10 minutes, thereby obtaining a dispersion composition for sample. Thereafter, this sample was tested under the following condition. In this connection, this sample became cloudy step-by-step at the time of air cooling.

Outline of Measurement Method:

FIG. 28 is a diagrammatic view of an apparatus used for this measurement. For micro FT-IR, MICRO20 connected to FT-IR400, manufactured by JASCO Corporation was used, and the apparatus was positioned such that the point-contacting portion of the point contact EHL evaluation apparatus was located in a working distance of a Cassegrain mirror thereof. A rotating steel ball was placed on a diamond (hard plane) plate while making its rotation axis parallel, and a load was applied to the axis, thereby bringing them into press contact with each other. The prepared sample was fed and flown in a gap between the rotating steel ball and the diamond plate and its neighborhood.

Though a Newtonian ring which is an optical interference pattern is formed in a portion where the steel ball comes into point contact with the diamond plate, by irradiating infrared rays from the opposite side to the steel ball via the diamond plate and reflecting them on the steel ball, an IR spectrum of a thin film of the sample in the vicinity of the Newtonian ring can be measured. FIG. 29 shows a figure of the Newtonian ring formed by the point contact. A size of the Newtonian ring shown in FIG. 29 is about 200 μm, and a portion surrounded by a dotted line is an IR measurement light confined into a square of 160 μm.

When a mineral oil or a poly-α-olefin is used as the oily medium at the time of preparing a sample, since such a material is a hydrocarbon, there is no characteristic absorption other than those of C—C and C—H. In consequence, since Illustrative Compound AII-1 in the sample has a carbonyl group of an ester bond exhibiting a distinct high-intensity characteristic absorption band, a change of the concentration can be quantitatively detected from the intensity of the characteristic absorption band.

As a result of observation using the foregoing apparatus, it was noted that in a so-called Hertzian area under a high pressure in a high shear field, where a Newtonian ring is formed, Illustrative Compound II-1 was gradually segregated in a form of a candle flame formed by partition of a flow of the sample in, for example, a region of from 20 to 400 μm backward.

In many cases, the concentration becomes substantially constant for about 5 minutes to 2 hours under a condition at a measurement temperature of 40° C. at a linear velocity of 0.15 m/sec under a Hertzian pressure of 0.3 GPa, an aspect of which is, however, different depending upon a condition such as a temperature, etc.

Figure 32:
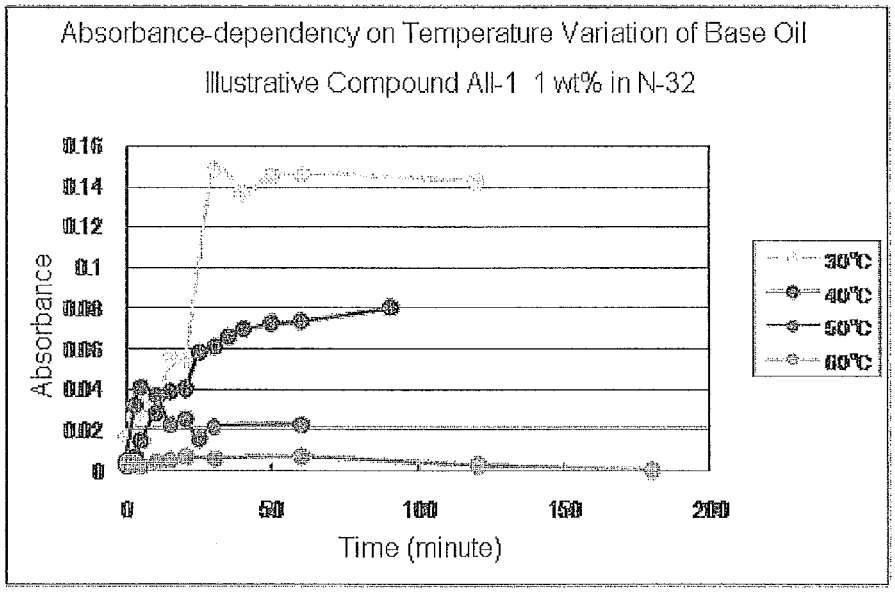

FIG. 32 is a graph showing the temperature dependency of an absorbance. Obviously, it is noted that as a sample becomes close to a clearing point, namely a dispersion particle size of Illustrative Compound AII-1 becomes small, a segregation rate of Illustrative Compound AII-1 also becomes small, a segregation amount of which is not more than a measurement limit in this evaluation apparatus at a temperature of the clearing point or higher.

Figure 33:
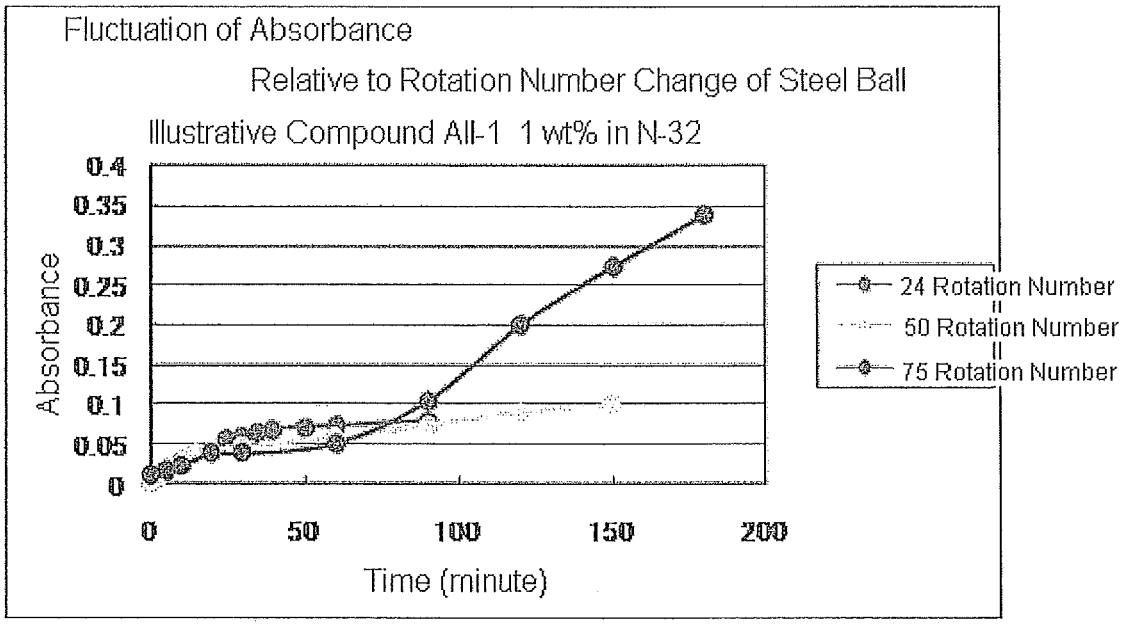

FIG. 33 is a graph showing a relation between a rotation speed of a steel ball, namely an amount at which a lubricating oil thereof is sent into a point-contacting portion and a segregation amount. As expected, it can be understood from this graph that the higher the rotation number, namely the larger the amount of a dispersion composition sample to be fed into the point-contacting portion, the more the segregation amount increases.

The foregoing point contact EHL evaluation apparatus is a model of the Hertzian contact area under a high-pressure and high-shear condition, namely a true contact site. The actual friction contact area is an area where such true contact areas are crowded. Therefore, it may be considered that in a sample containing Illustrative Compound AII-1 in the oily medium, the amount of the base oil with relatively low viscosity (oily medium) becomes small in the vicinity of a number of true contact areas of such a friction contact area, whereby the foregoing Illustrative Compound AII-1 is accumulated.

In consequence, even when the amount of Illustrative Compound AII-1 contained in the sample is small as about 1% by mass, and even under a condition under which there is a concern that originally, a compound is not accumulated at a high temperature, it can be expected that if the concentration of Illustrative Compound AII-1 is increased in the sliding portion, a low-viscosity effect is revealed under elastic fluid lubrication which is original to the subject compound even at the high temperature, as indicated by the frictional coefficient at the high temperature in an SRV evaluation apparatus.

7. Test Example 6

Performance Evaluation of Grease Composition:

Grease samples 1 to 5 each having a formulation shown in the following table were prepared using Illustrative Compounds AII-18, AI-64, AII-37, AI-71 and AIII-1, respectively. Moreover, comparative grease samples C1 to C4 each having a formulation shown in the following table were prepared, respectively.

A friction test was carried out, thereby measuring a coefficient of friction and a wear scar depth. In this connection, the coefficient of friction in the Examples was measured using a reciprocating friction tester (SRV friction and wear tester), and the friction test was carried out under the following test condition. The results of grease samples 1 to 5 of the Examples are shown in the following Table 3, and the results of the comparative grease samples C1 to C4 are shown in the following Table 4.

Test Condition:

The test condition was adopted by the ball-on-plate system.
Test piece (friction material): SUJ-2
Plate: ϕ24×6.9 mm
Ball: ϕ10 mm
Temperature: 70° C.
Load: 100 N
Aptitude: 1.0 mm
Frequency: 50 Hz
Test time Measured 30 minutes after starting the test

TABLE 3

| Grease Sample No. | 1 | 2 | 3 | 4 | 5 |
|---|---|---|---|---|---|
| Compound of the Invention | AII-18 | AI-64 | AII-37 | AI-71 | AIII-1 |
| % by mass | 3 | 5 | 3 | 5 | 3 |

TABLE 3-continued

| Grease Sample No. | 1 | 2 | 3 | 4 | 5 |
|---|---|---|---|---|---|
| Base Oil % by mass | | | | | |
| Mineral Oil*1 | 70 | 75 | 80 | — | — |
| Poly-α-olefin*2 | — | — | — | 82 | 82 |
| Thickener % by mass | | | | | |
| Lithium stearate | 27 | 20 | — | — | — |
| Urea*3 | — | — | 17 | 13 | 15 |
| Mixed consistency (40 degrees Celsius) | 288 | 265 | 274 | 251 | 299 |
| Friction Coefficient | 0.055 | 0.085 | 0.060 | 0.084 | 0.069 |
| Wear Depth (μm) | 0.35 | 0.58 | 0.53 | 0.71 | 0.56 |

*1Viscosity 11 cst (100 degrees Celsius)

*2Viscosity 12 cst(100 degrees Celsius)

*3Product obtained by reacting 1 equivalent amount of diphenyl methane 4,4'-diisocyanate with 2 equivalent amounts of octadecyl amine.

TABLE 4

| | Grease Sample for Comparative Example No. | | | |
|---|---|---|---|---|
| | C1 | C2 | C3 | C4 |
| Compound of the Invention | — | — | — | — |
| Base Oil % by mass | | | | |
| Mineral Oil*1 | 75 | — | 85 | — |
| Poly-α-olefin*2 | — | 75 | — | 85 |
| Thickener % by mass | | | | |
| Lithium stearate | 25 | 25 | — | — |
| Urea*3 | — | — | 15 | 15 |
| Mixed consistency (40 degrees Celsius) | 320 | 317 | 311 | 307 |
| Friction Coefficient | 0.127 | 0.135 | 0.132 | 0.145 |
| Wear Depth (μm) | 1.24 | 1.44 | 1.22 | 1.53 |

*1Viscosity 11 cst (100 degrees Celsius)

*2Viscosity 12 cst(100 degrees Celsius)

*3Product obtained by reacting 1 equivalent amount of diphenyl methane 4,4'-diisocyanate with 2 equivalent amounts of octadecyl amine.

From the results shown in the foregoing tables, it can be understood that the grease composition samples of the Examples of the invention conspicuously exhibit a friction reducing effect and a wear inhibiting effect.

8. Test Example 7

Performance Evaluation of the Composition of the Invention as a Mold Release Agent:

100 parts by mass of a polycarbonate resin (manufactured by Sumitomo Dow Limited, molecular weight: 20,500) and 0.2 parts by mass of each of Illustrative Compounds AII-1, AII-88, AIII-1, AIV-1, AV-1, AVI-1, AVII-1 and AVIII-1 and Comparative Compound C-1 were mixed in a tumbler, and thereafter, each of the mixtures was pelletized using a two-screw extruder under a condition at a melting temperature of 280° C.

A box-shaped molding (draft angle: 2°) of 200 mm in width×250 mm in length×400 mm in depth and having a thickness of 2.5 mm was molded using an injection molding machine, a load applied to the injector at the time of mold release was recorded as a voltage, and the obtained electric power value was converted into a force (kgf) to determine a mold release resistance. The results are shown in the following table. It may be said to be practically acceptable that the mold release resistance is not more than 450 kgf.

TABLE 5

| | Mold Release Agent Sample No. | | | | | | | | |
|---|---|---|---|---|---|---|---|---|---|
| | Example | | | | | | | | Comparative Example |
| | 1 | 2 | 3 | 4 | 5 | 6 | 7 | 8 | C1 |
| Polyol ester (additive amount: parts by mass) | AII-1 (0.4) | AII-88 (0.4) | AIII-1 (0.4) | AVI-1 (0.4) | AV-1 (0.4) | AVI-1 (0.4) | AVII-1 (0.4) | AVIII-1 (0.4) | C-1 (0.4) |
| Polycarbonate (additive amount: parts by mass) | 100 | 100 | 100 | 100 | 100 | 100 | 100 | 100 | 100 |
| Mold Release Resistance (kgf) | 420 | 400 | 440 | 480 | 430 | 410 | 450 | 450 | 530 |

From the results shown in the foregoing table, it can be understood that the Examples of the composition of the invention are excellent in mold release properties.

9. Test Example 8

Evaluation of the Composition of the Invention as a Lubricating Oil for Internal Combustion Engine:

A lubricating oil composition containing each of four compounds of Illustrative Compounds AII-18, AI-8, AII-1 and AIII-1, a base oil (100 neutral oil, viscosity at 100° C.: 4.4 $mm/s^2$), each component of the kind and amount shown in the following table and 2.0% by mass of calcium sulfonate as a metallic cleaning agent was prepared and then measured for a coefficient of friction. The results are shown in the following table. In this connection, the coefficient of friction of the lubricating oil composition was measured using a reciprocating sliding friction tester [SRV friction tester] at a frequency of 50 Hz, an aptitude of 1.5 mm, a load of 50 N and a temperature of 65° C. for a test time of 30 minutes.

TABLE 6

| | | Lubricant Oil Composition Sample No. | | | | | | | |
|---|---|---|---|---|---|---|---|---|---|
| | | Example | | | | Comparative Example | | | |
| | | 1 | 2 | 3 | 4 | C1 | C2 | C3 | C4 |
| Compound of the Invention (% by mass) | | AII-18 (1.00%) | AI-8 (1.00%) | AII-1 (1.00%) | AIII-1 (1.00%) | — | — | — | — |
| MoDTC | The Mount of Mo in $C_8$—MoDTC*1 (ppm) | — | — | — | 400 | 400 | — | 400 | 400 |
| | The amount of Mo in $C_{16}$—MoDTC*2 (ppm) | — | — | — | — | — | 800 | — | — |
| ZnDTP | The amount of phosphorous in $C_4/C_5$ZnDTP(primary) (% by mass) | — | — | — | — | — | — | 0.1 | — |
| | The amount of phosphorous in $C_8$ZnDTP(primary) (% by mass) | — | — | — | — | 0.1 | 0.1 | — | — |
| | The amount of phosphorous in $C_3/C_6$ZnDTP(secondary) (% by mass) | — | — | — | — | — | — | — | 0.1 |
| Ashless Dispersant | Boron-containing Succinimide (% by mass) | — | — | 5 | 5 | 5 | 5 | 5 | 5 |
| | Succinimide (% by mass) | — | — | — | — | — | — | — | — |
| | The amount of Boron (% by mass) | — | — | 0.016 | 0.016 | 0.016 | 0.016 | 0.016 | 0.016 |
| | B/N (ration of the numbers of atom) | — | — | 0.26 | 0.26 | 0.26 | 0.26 | 0.26 | 0.26 |
| Friction Coefficient | | 0.064 | 0.071 | 0.078 | 0.083 | 0.102 | 0.113 | 0.138 | 0.097 |

*1$C_8$—MoDTC: Sulfurized oxymolybdenum-N,N-di-octyldithiocarbamate
*2$C_{16}$—MoDTC: Sulfurized oxymolybdenum-N,N-di-tridecyldithiocarbamate
*3$C_4/C_5$ ZnDTP(primary): Zinc n-butyl-n-pentyldithio phosphate;
*4$C_8$ ZnDTP(primary): Zinc di-2-ethyl hexyldithio phosphate;
*5$C_3/C_6$ ZnDTP(secondary): Zinc isopropyl-1-ethylbutyldithiophosphate In all of the cases of using the lubricating oil composition samples Nos. 1 to 4 of the foregoing Examples, the coefficient of friction is low, and a favorable friction characteristic is exhibited. On the other hand, since the lubricating oil composition samples Nos. C1 to C4 of the Comparative Examples contain an organic molybdenum compound such as molybdenum dithiocarbamate (MoDTC), sulfurized oxymolybdenum organophosphoro-dithioate (MoDTP), etc., it can be understood that in all of these cases, the coefficient of friction is high, and the friction characteristic is insufficient. Though the lubricating oil compositions of the Examples of the invention do not have an action to adsorb on the friction surface or iron, it can be understood that they have an action to reduce the coefficient of friction on a level equal to or more than that of a lubricant composition containing a molybdenum compound which is said to strongly adsorb on the friction surface even under an operation condition of a medium to low oil temperature and a low rotation speed.

In consequence, the lubricating oil composition of the invention can be suitably used for automotive lubricating oils such as lubricating oils for internal combustion engines such as automotive engines, etc., gear oils, automatic transmission fluids, shock absorber oils and so forth.

10. Test Example 9

Performance Evaluation of the Composition of the Invention as a Lubricating Oil for Metal Working:

Various lubricating oil compositions for metal working having a composition (% by weight) shown in each example shown in the following table were prepared, and these compositions were subjected to various tests in methods shown below.

JIS A-1050 H18 (0.8 mm in thickness) was used as a rolling material.

A mineral oil of 3.2 $mm^2/s$ (40° C.) was used as a base oil, and lauryl alcohol and myristyl alcohol (6/4) were used as an oil agent.

(i) Rolling Properties Test:

A rolling test was carried out under the following condition, and a draft [{(initial thickness of material)−(residual thickness of rolled material)/(initial thickness of material)}×100%] was gradually increased, thereby measuring a draft (limited draft) before seizure occurred, or the generation of a herringbone became impossible.

Draft: 40% or more (increased at intervals of fixed time)

Rolling rate: 50 m/min (ii) Measurement Test of Roll Coating:

Three coils having a length of 300 mm were continuously rolled under the following condition; thereafter, a roll coating formed on the roll surface was dissolved in a 5% sodium hydroxide aqueous solution; and aluminum in the dissolved liquid was quantitatively determined by an atomic absorption method. A roll coating amount was determined from the obtained value.

Draft: 50

Rolling rate: 300 m/min (iii) Measurement Test of Amount of Generation of Worn Powder:

Three coils having a length of 300 mm were continuously rolled under the following condition. An amount of aluminum in the oil after the test was measured by an atomic absorption method, thereby determining an aluminum concentration in the oil. Moreover, a worn powder deposited on the aluminum surface after the rolling was wiped off using absorbent cotton, and the wiped worn powder was measured by an atomic absorption method, thereby determining an amount of the worn powder deposited on the plate surface after the rolling. Each of the amount of aluminum in the oil and the amount of worn powder deposited on the plate surface was converted into a value during rolling 1 $m^2$ of rolling material, and a total sum of the both was defined as an amount of the generation of worn powder.

Draft: 50%

Rolling rate: 300 m/min

The foregoing test results are shown in the following table.

TABLE 7

| | Lubricating Oil for Metal Working Sample No. | | | | | |
|---|---|---|---|---|---|---|
| | Example | | | | Comparative Example | |
| | 1 | 2 | 3 | 4 | C1 | C2 |
| Polyol Ester (Additive Amount: Parts by mass) | AII-9 (0.4) | AII-89 (0.4) | AIV-5 (0.4) | AVI-2 (0.4) | C-1 (0.4) | Additive-free (—) |
| Additive Amount of Base Oil (Parts by mass) | 92.6 | 92.6 | 92.6 | 92.6 | 92.6 | 92.6 |
| Additive Amount of Oil agent (Parts by mass) | 7 | 7 | 7 | 7 | 7 | 7 |
| Limited Draft % | 83 | 80 | 79 | 83 | 75 | 60 |
| Coating Amount mg | 0.9 | 0.9 | 1.1 | 0.8 | 0.9 | 1.8 |
| Amount of Generation of Worn Powder ppm | 63 | 77 | 59 | 67 | 109 | 211 |

From the results shown in the foregoing table, it can be understood that the lubricating oil composition samples Nos. 1 to 4 for metal working of the Examples of the invention can endure the aluminum working at a high speed and a high working rate, improve the working environment and conspicuously suppress the generation of a metal soap or the generation of a worn powder.

11. Test Example 10

Evaluation of Friction Performance by a Sintered Bearing Made of the Composition of the Invention:

Two sintered bearing specimens were made coexistent in a glass container, dipped in each of lubricating oil samples (4 mL) shown in the following table and then heated in a thermostat at 150° C. for 300 hours. In this connection, a sintered bearing of 3 mm in inner diameter×6 mm in outer diameter×2.5 mm in height (manufactured by Hitachi Powdered Metals Co., Ltd.; EAK-3) was used as the sintered bearing specimen. Components of constituent metals of the bearing are from 50 to 55% by weight of Cu, from 1 to 3% by weight of Sn, from 0.1 to 0.5% by weight of P, not more than 1.0% by weight of C and not more than 0.5% by weight of others, with the balance being Fe.

After the bearings were dipped and heated in each lubricating oil sample (at 150° C. for 500 hours), the bearings were measured for a coefficient of friction. The results are shown in the following table.

The test condition is as follows.

Axis: SUS420J2

Load: 30 gf

Rotation number: 2,000 rpm

Clearance: 15 μm

Circumferential temperature: 25° C.

TABLE 8

| Lubricant Oil for Sintered Bearing Sample No. | Base Oil *1 | Antioxidant *2 | Compound of the Invention | Friction Coefficient Heating Period 0 | 500 |
|---|---|---|---|---|---|
| 1 | DOS | — | — | 0.03 | 0.35 |
| 2 | DOS | — | AII-88 | 0.03 | 0.15 |
| 3 | DOS | AO-1 | AII-88 | 0.03 | 0.05 |
| 4 | TMP | — | — | 0.04 | 0.51 |
| 5 | TMP | — | AII-88 | 0.04 | 0.12 |
| 6 | TMP | AO-2 | AII-88 | 0.04 | 0.06 |
| 7 | DOS/SHG | — | — | 0.03 | 0.41 |
| 8 | DOS/SHG | — | AII-88 | 0.03 | 0.08 |
| 9 | DOS/SHG | AO-1 | AII-88 | 0.03 | 0.035 |

*1 Base oil

DOS(ester of dibasic acid): sebacic acid dioctyl (viscosity: 11.59 cSt, 40 degrees Celsius)

TMP(polyol ester): tTrimethylolpropane tricapriate (Viscosity: 14.01 cSt, 40 degrees Celsius)

SHC(synthetic hydrocarbon): hydrogen addition polybutene (Viscosity: 25.10 cSt, 40 degrees Celsius)

DOS/SHC: Mixed oil (mix ratio: 80/20; viscosity: 13.50 cSt)

*2 Antioxidant: The additive amounts of AO-1 and AO-2 were 0.5% by mass respectively.

AO-1: octadecyl-3-(3,5-di-t-butyl-4-hydroxyphenol)

AO-2: Zinc N,N-diamyldithiocarbamic acid

From the results shown in the foregoing table, it can be understood that when a lubricating oil sample having 1.0% by mass of AII-88 which is the compound of the formula (Z) of the invention blended therewith is used, the coefficient of friction of the bearing becomes greatly low; and that when an antioxidant is further used jointly, the effect for suppressing a coefficient of friction becomes conspicuous. What the coefficient of friction of the bearing is lowered contributes to electric power saving and long life of recording apparatus, household electrical appliances and so forth using such a bearing.

12. Test Example 11

Evaluation of a Molybdenum Based Complex of the Invention:

Each of molybdenum based complex-containing lubricating oil compositions of the invention (samples Nos. 1 to 5 of the Examples) and molybdenum based complex-containing lubricating oil compositions for comparison (comparative samples Nos. C1 to C3) each having a composition shown in the following table was prepared. Each of the samples was tested for a friction characteristic using the Optimol's SRV reciprocating friction tester used for the evaluation of Test Example 1 under a condition of a load of 400 N, a frequency of 50 Hz, an aptitude of 1.5 mm and an oil temperature 75° C. for 30 minutes and 130° C. for 24 hours.

In the following table, numerical values in the column of each of components means % by mass.

TABLE 9

| | Molybdenum Based Complex-containing Lubricant Oil Sample No. | | | | | | | |
|---|---|---|---|---|---|---|---|---|
| | Example | | | | | Comparative Example | | |
| | 1 | 2 | 3 | 4 | 5 | C1 | C2 | C3 |
| Lubricant Base Oil (1) | 79.3 | 80 | 78.7 | 79.4 | 73 | 84.7 | 85.5 | 85.4 |
| Mo Complex of the Invention (% by mass) | AIX-2 (7) | AIX-2 (7) | AXa-3 (7.6) | AXa-3 (7.6) | AIX-2 (7) | — | — | — |
| Mo dithiocarbamic acid | — | — | — | — | — | 1.6 | — | 1.6 |
| Mo dithiophosphate | — | — | — | — | — | — | 0.8 | — |
| Mo Element Reduced Quantity | | | | (0.07) | | | | |
| Zinc dialkyldithiophosphate (2) | 0.69 | — | 0.69 | — | AXb-1 (0.69) | 0.69 | 0.69 | — |
| Metallic Cleaning Agent (3) | | | | 2 | | | | |
| Ashless Dispersant (4) | | | | 5 | | | | |
| Antioxidant (5) | | | | 2 | | | | |
| Viscosity Index Improver (6) | | | | 4 | | | | |
| Anti-emulsifying Agent (7) | | | | 0.01 | | | | |
| Friction Coefficient (SRV) 75 degrees Celsius/30 min. | 0.059 | 0.061 | 0.054 | 0.067 | 0.068 | 0.077 | 0.081 | 0.158 |
| Friction Coefficient (SRV) 130 degrees Celsius/120 hrs. | 0.078 | 0.043 | 0.089 | 0.041 | 0.058 | 0.138 | 0.144 | >0.3 |

(1) Lubricant Base Oil: Hydrogenation purified mineral oil (the amounts of all aromatic materials: 1.3%, Sulfur content: 10 ppm, Kinetic viscosity at 100 degrees Celsius: 5.1 $mm^2/s$, Viscosity Index: 138)
(2) Zinc dialkyldithiophosphate: Alkyl: sec-butyl/sec-hexyl, Sulfur content: 15.2%, Zinc content: 7.8%, Vitriolic ash content: 11.7%
(3) Metallic Cleaning Agent: Calcium salicylate (Total base value: 120 mgKOH/g, Calcium content: 4%, Metal ratio: 1.0, Vitriolic ash content: 13.6%)
(4) Ashless Dispersant: polybutenylsuccinimide (Mn: 1400)
(5) Antioxidant: Octyl-3-(3,5-di-tert-butyl-4-hydroxyphenyl)propionate
(6) Viscosity Index Improver: OCP(Mw: 150000)
(7) Anti-emulsifying Agent: polyethylene glycol 400

From the results shown in the foregoing table, the molybdenum based complex-containing lubricating oil compositions of the invention (samples Nos. 1 to 5) exhibit an excellent low friction performance. In particular, in the samples Nos. 1 and 3 using a zinc dialkyldithiophosphate, though the initial coefficient of friction is low, the coefficient of friction slightly increases through long-term use. On the other hand, in the samples Nos. 2 and 4 not containing this zinc dialkyldithiophosphate, it can be understood that when used for a long period of time, the friction is rather reduced, and at the same time, the durability is enhanced. It may be conjectured that this is caused due to the matter that contamination of the lubricating oil composition by heat decomposition of the zinc dialkyldithiophosphate or the like is suppressed. This point is utterly contrary to the behavior of the comparative samples Nos. C1 to C3 each of which does not use the molybdenum based complex of the invention but uses molybdenum dithiophophate or molybdenum dithiocarbamate. According to this, it is suggested that by utilizing the molybdenum based complex of the invention, a structure and a function such that deterioration of the lubricating oil to be caused due to oxidation of sulfur is hardly caused are brought. In this way, the samples of the molybdenum based complex-containing lubrication oil composition of the Examples of the invention are excellent in not only the initial friction reducing effect but its maintenance and also excellent from the viewpoints of antioxidation properties, long-drain properties such as base number maintenance, etc. and high-temperature cleaning properties as compared with the samples containing zinc dithiophosphate, molybdenum dithiophosphate or molybdenum dithiocarbomate.

Figure 1:
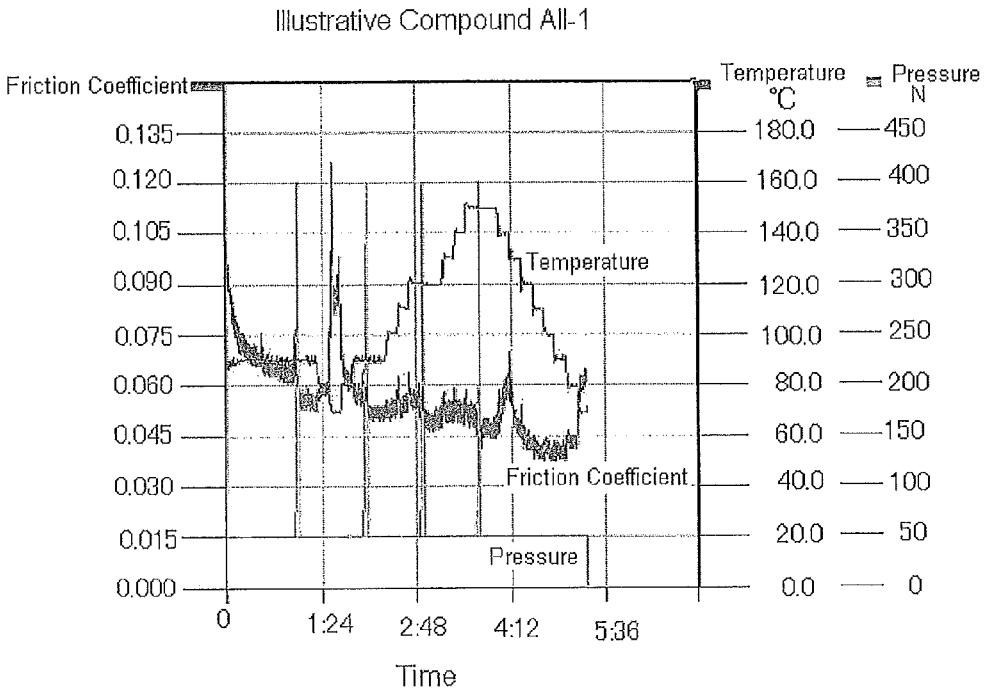
Figure 1:
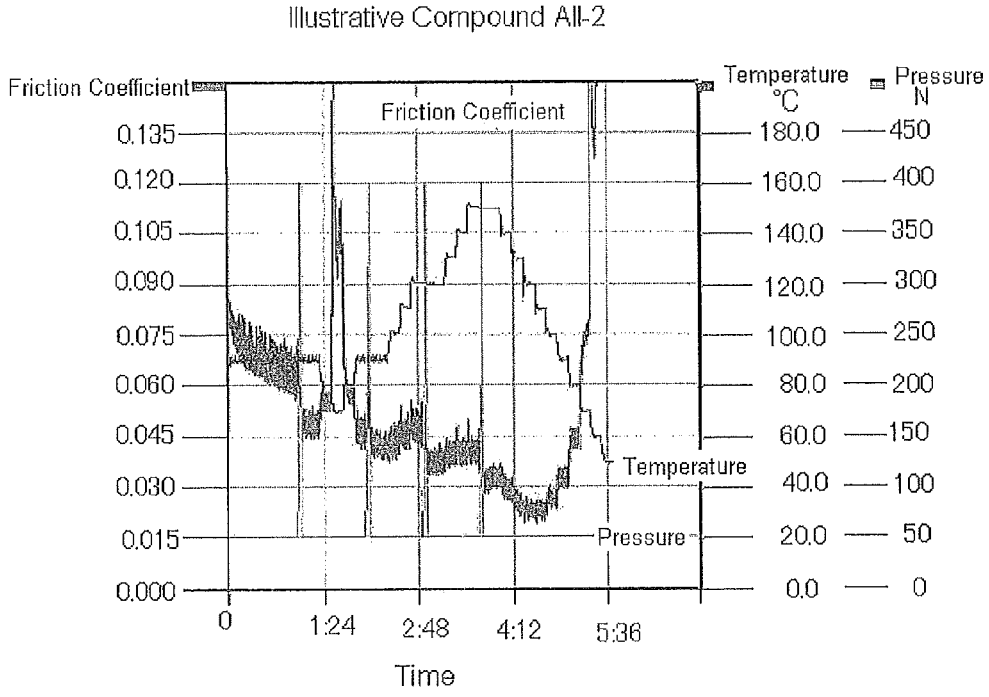

FIG. 1 is a graph showing the results of Test Example 1 of Illustrative Compounds AII-1 and AII-2.

Figure 2:
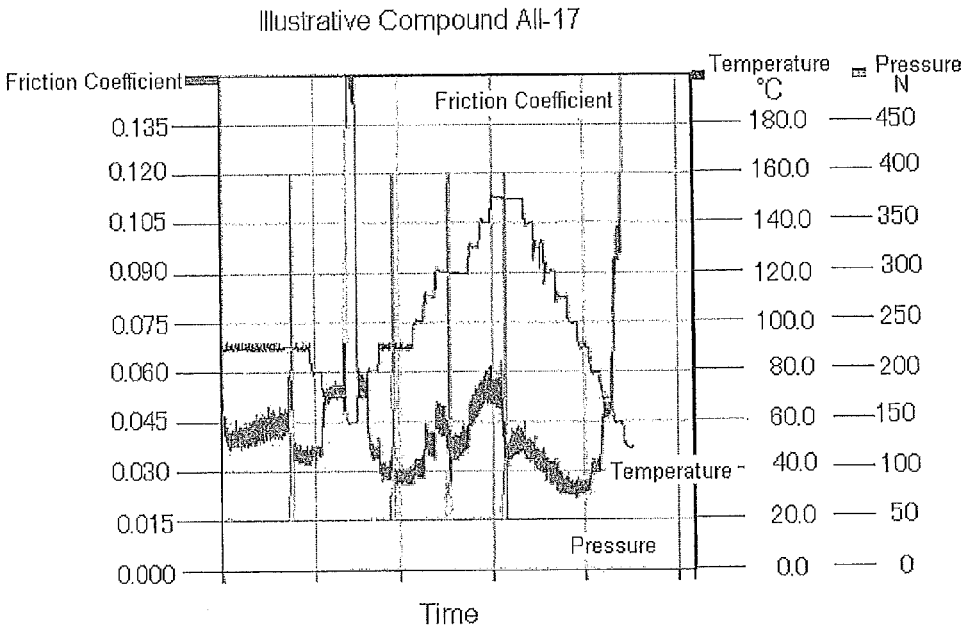
Figure 2:
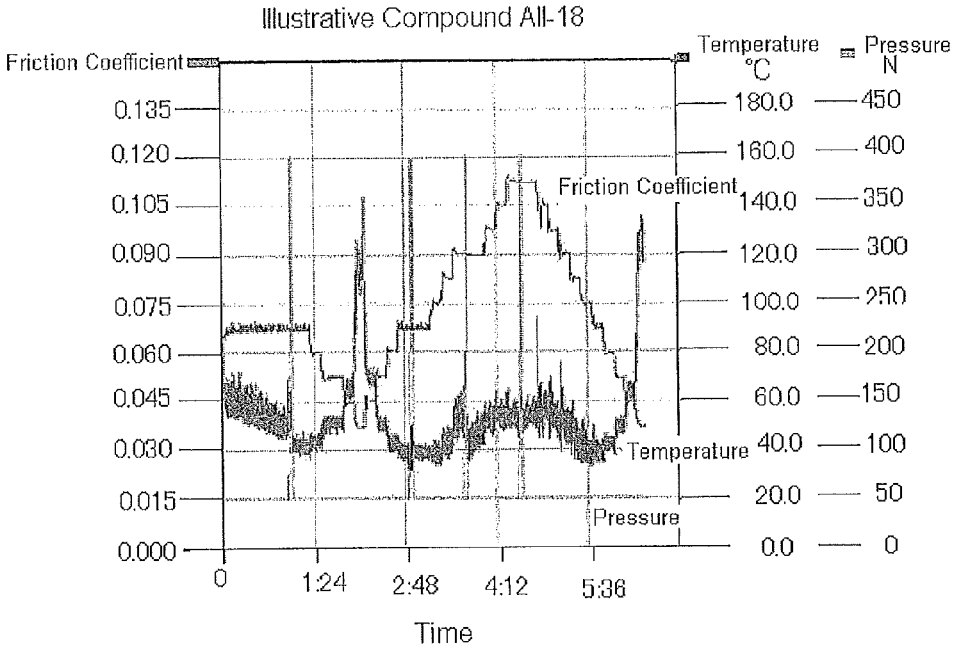

FIG. 2 is a graph showing the results of Test Example 1 of Illustrative Compounds AII-17 and AII-18.

Figure 3:
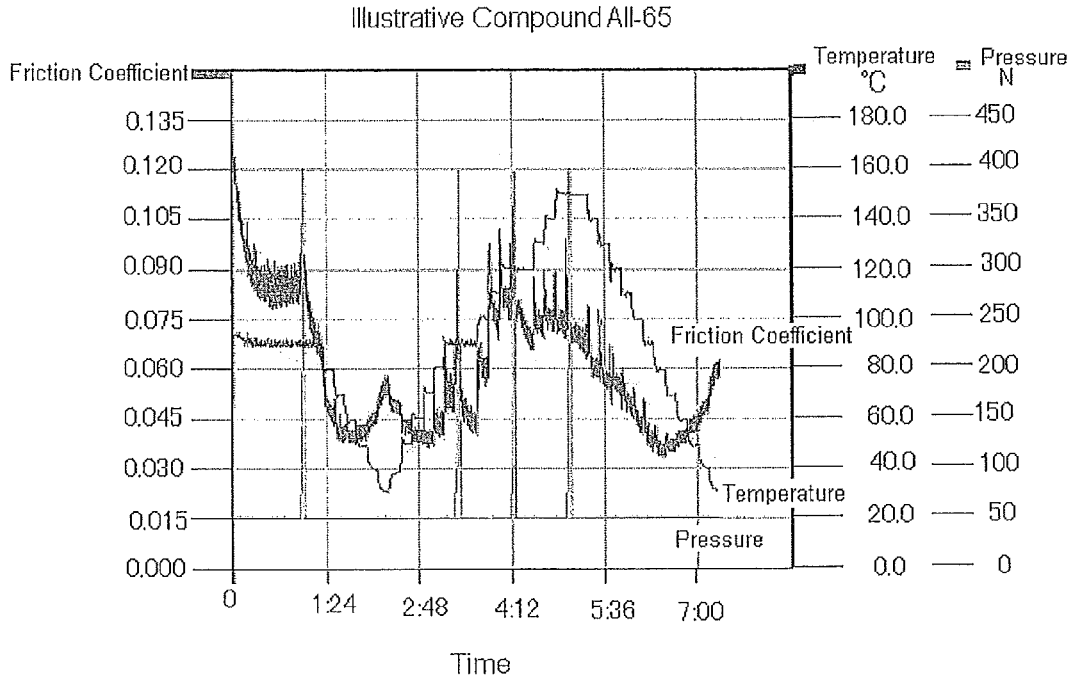

FIG. 3 is a graph showing the results of Test Example 1 of Illustrative Compounds AII-65.

Figure 4:
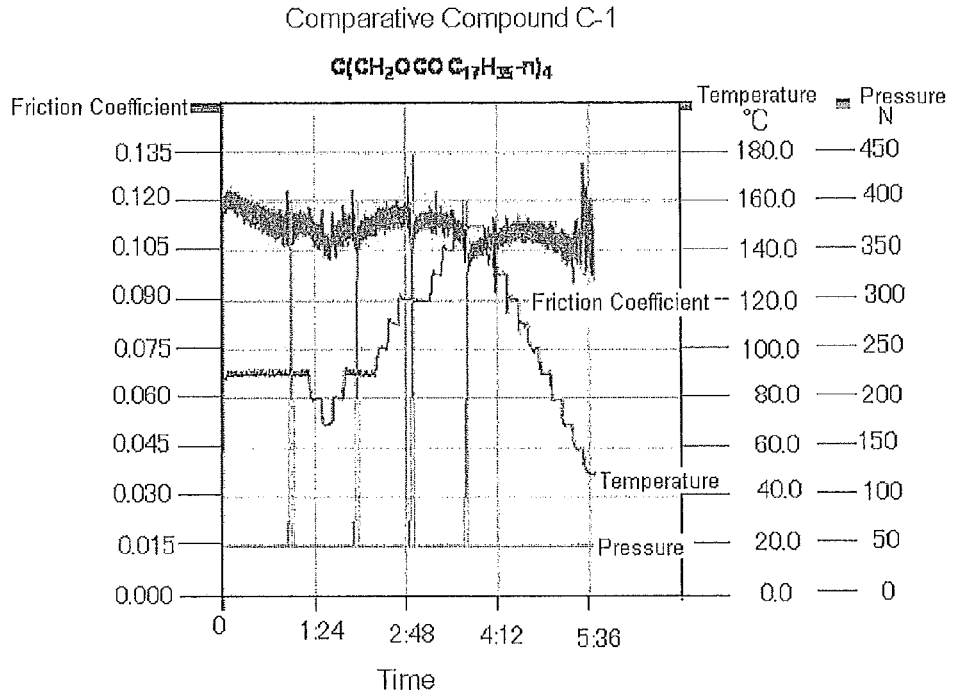
Figure 4:
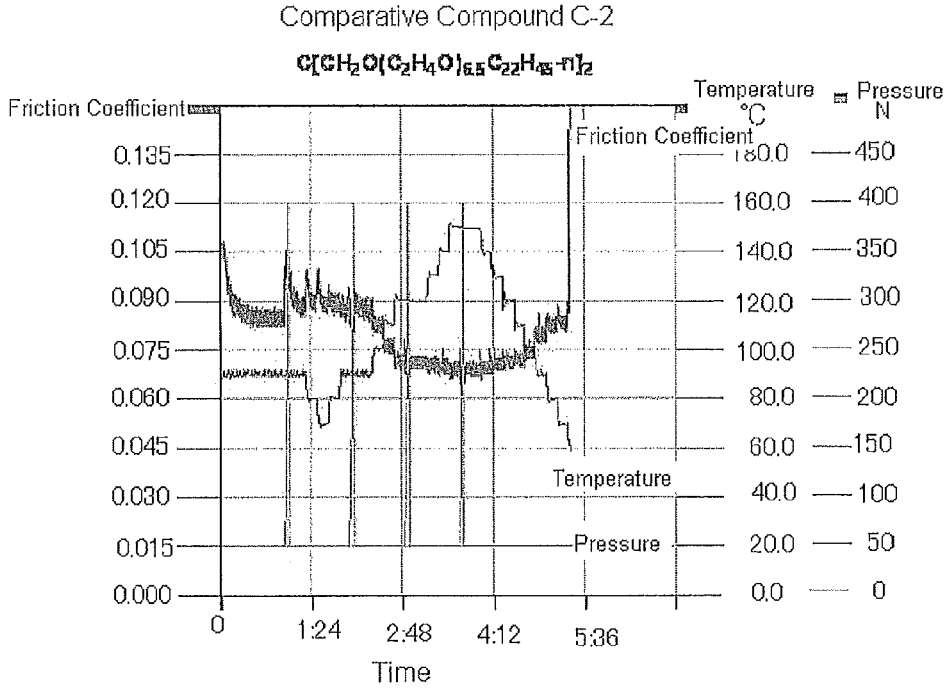

FIG. 4 is a graph showing the results of Test Example 1 of Comparative Compounds C-1 and C-2.

Figure 5:
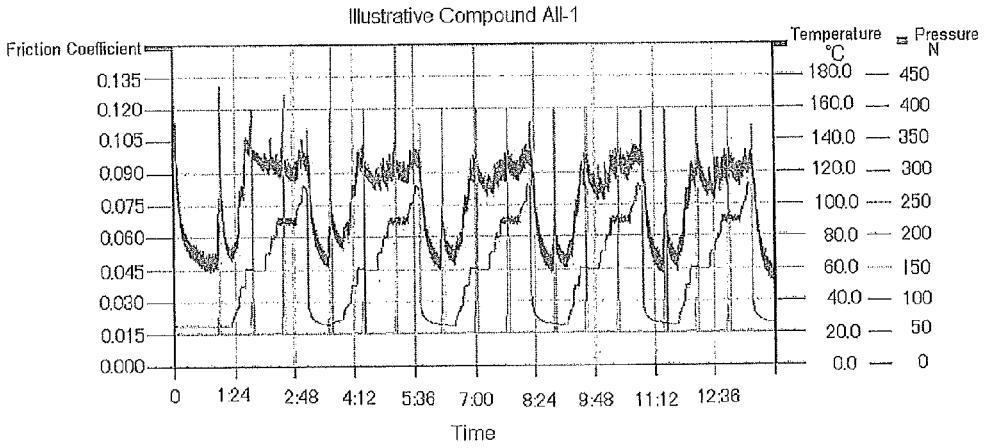
Figure 5:
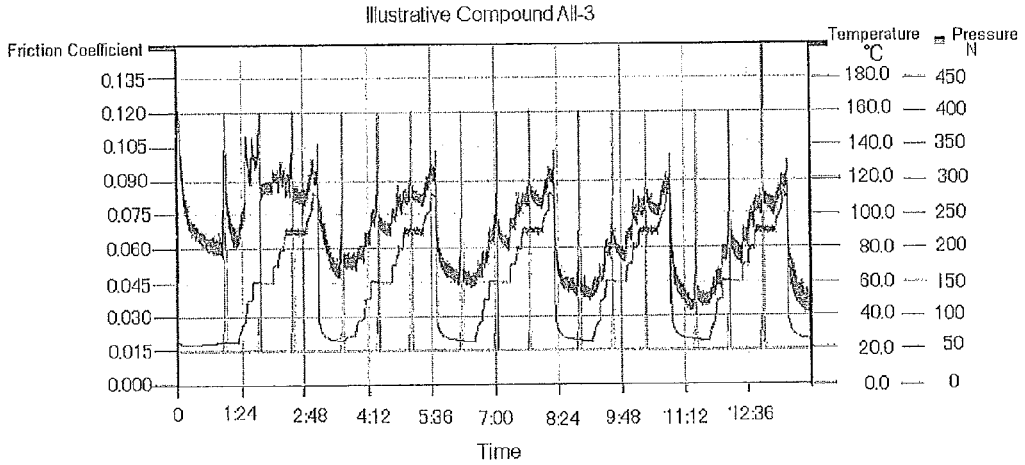

FIG. 5 is a graph showing the results of Test Example 2 of the compositions containing Illustrative Compounds AII-1 and AII-3, respectively.

Figure 6:
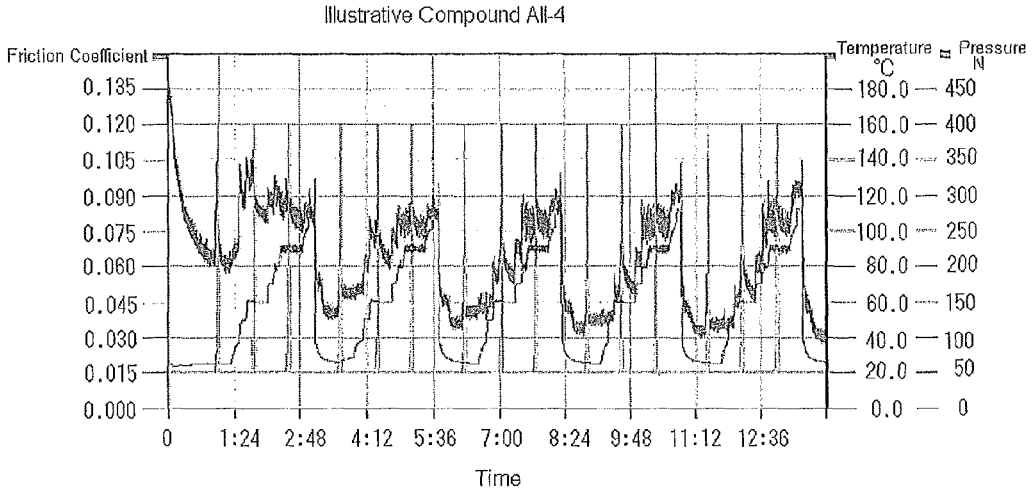
Figure 6:
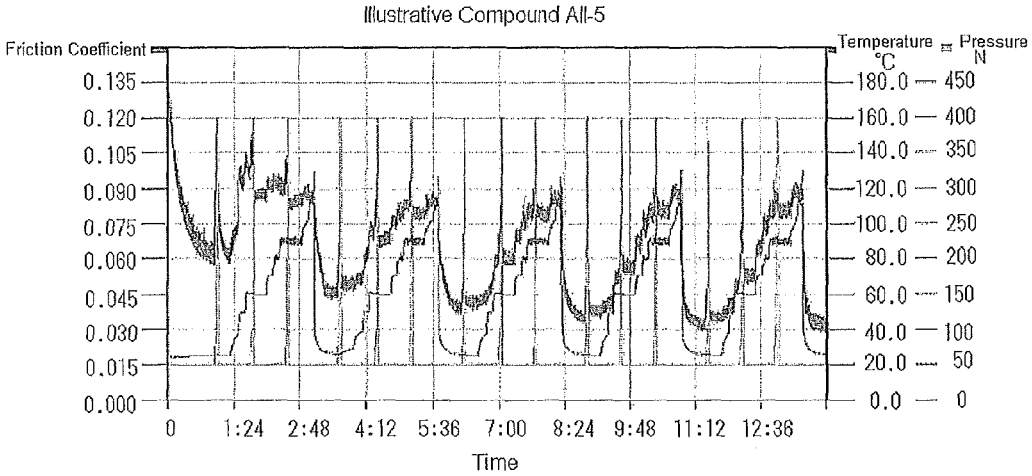

FIG. 6 is a graph showing the results of Test Example 2 of the compositions containing Illustrative Compounds AII-4 and AII-5, respectively.

Figure 7:
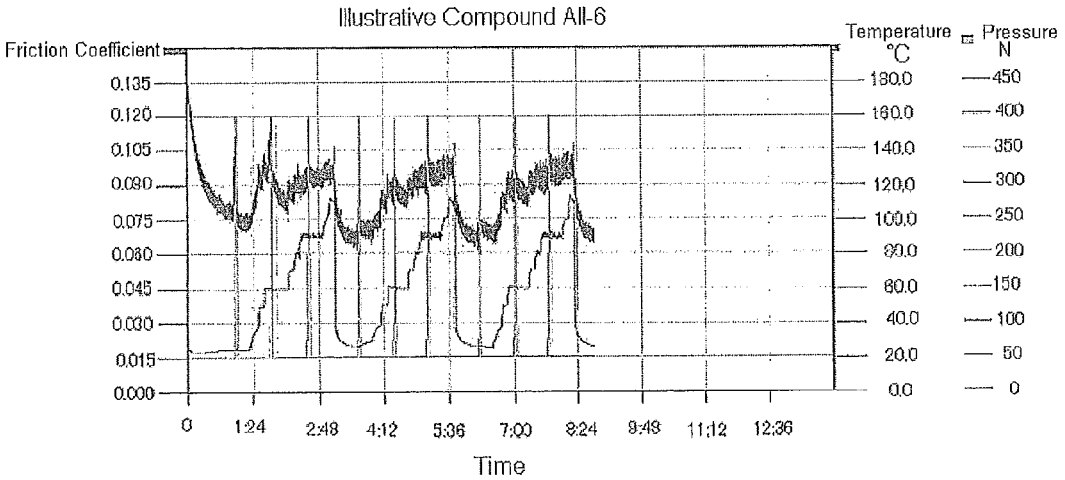
Figure 7:
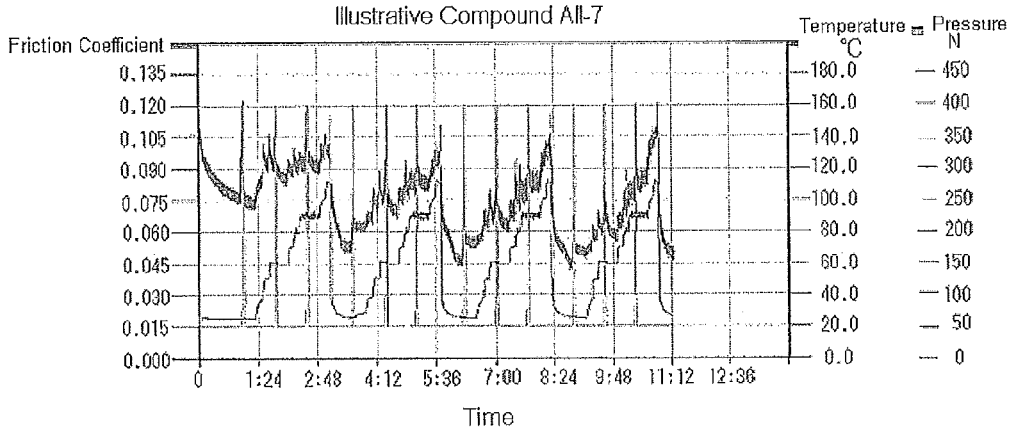

FIG. 7 is a graph showing the results of Test Example 2 of the compositions containing Illustrative Compounds AII-6 and AII-7, respectively.

Figure 8:
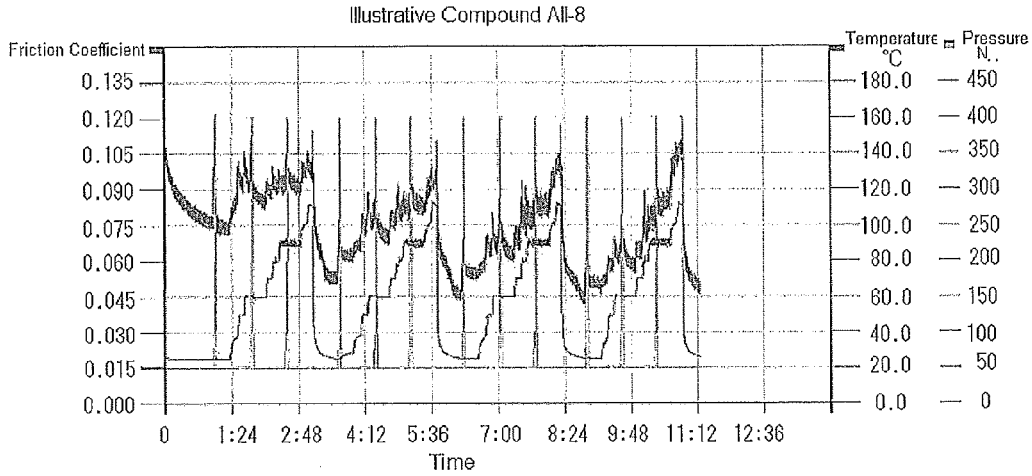
Figure 8:
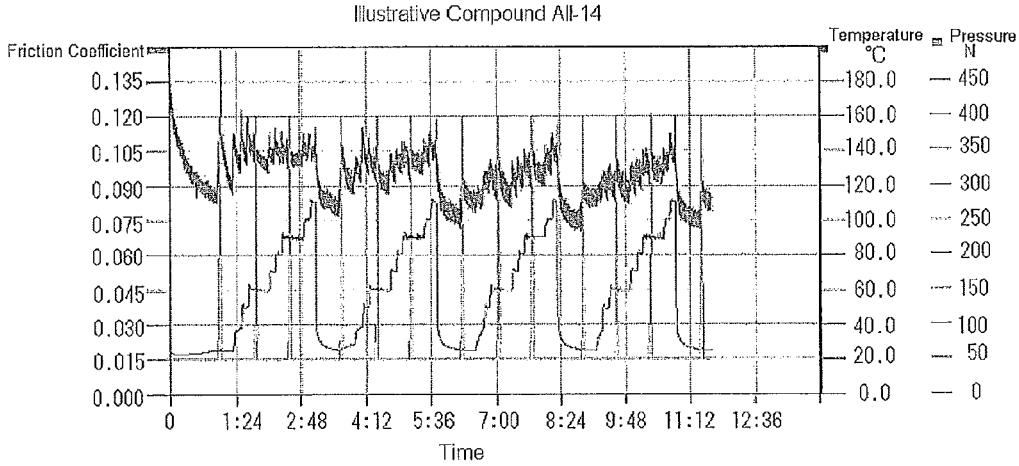

FIG. 8 is a graph showing the results of Test Example 2 of the compositions containing Illustrative Compounds AII-8 and AII-14, respectively.

Figure 9:
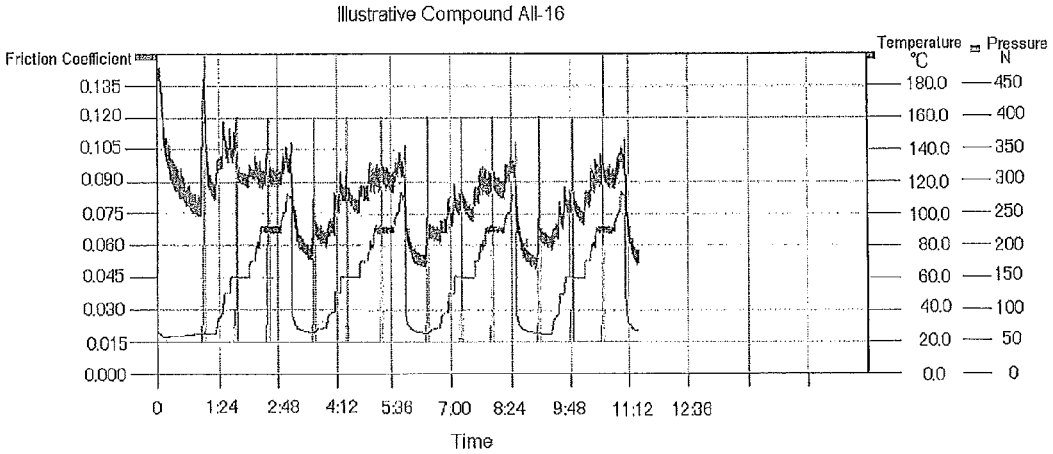
Figure 9:
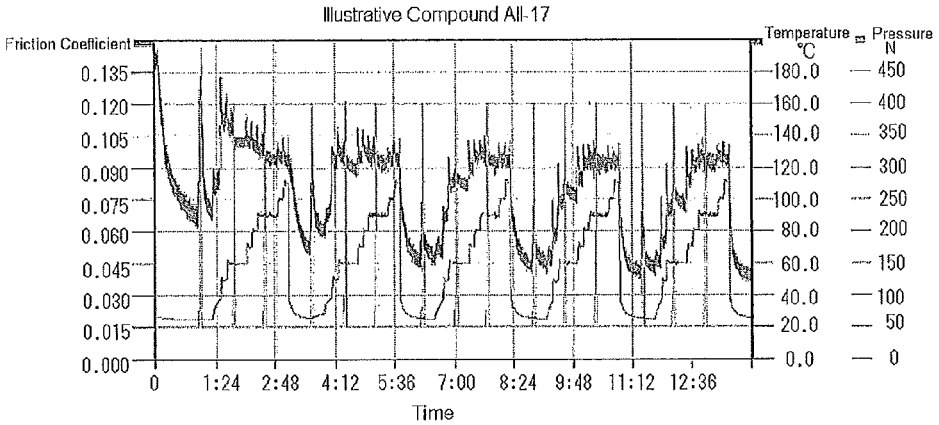

FIG. 9 is a graph showing the results of Test Example 2 of the compositions containing Illustrative Compounds AII-16 and AII-17, respectively.

Figure 10:
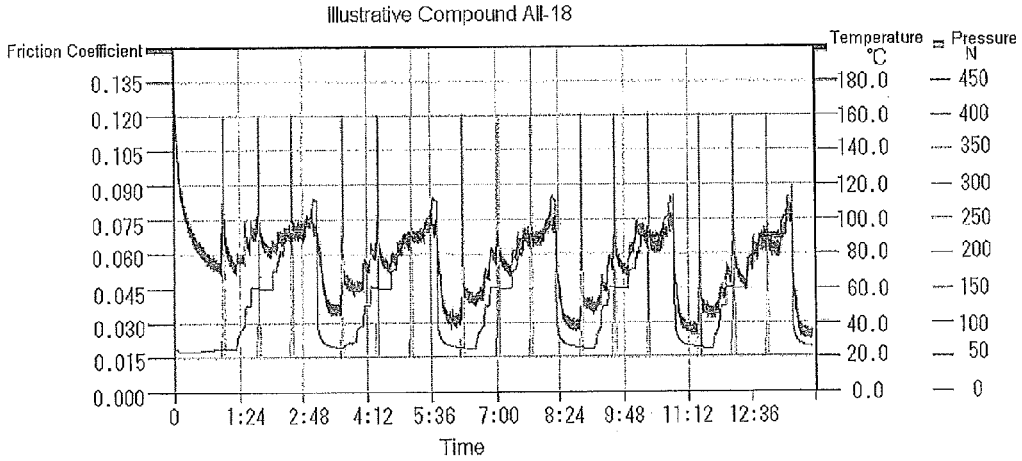
Figure 10:
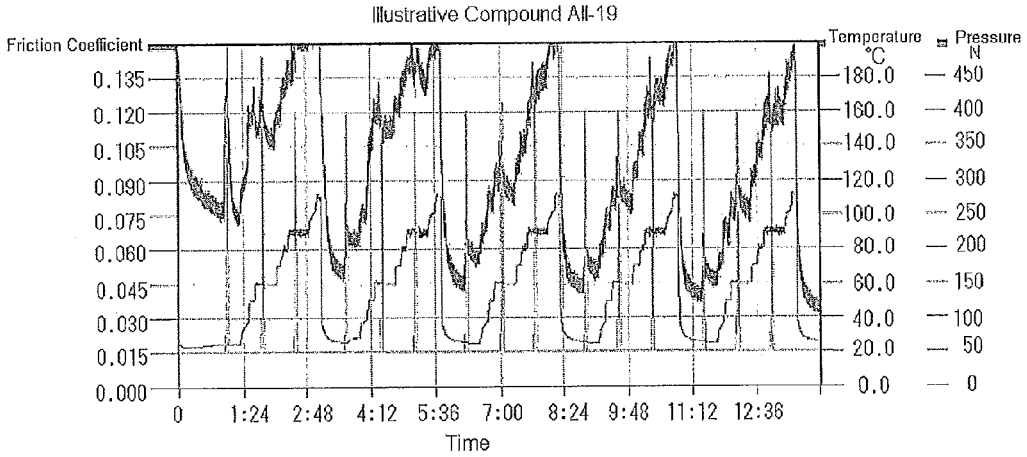

FIG. 10 is a graph showing the results of Test Example 2 of the compositions containing Illustrative Compounds AII-18 and AII-19, respectively.

Figure 11:
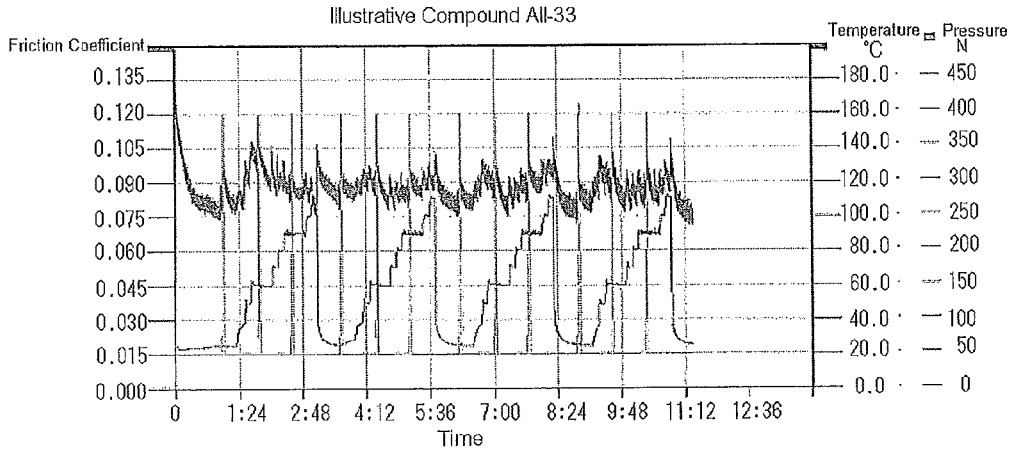
Figure 11:
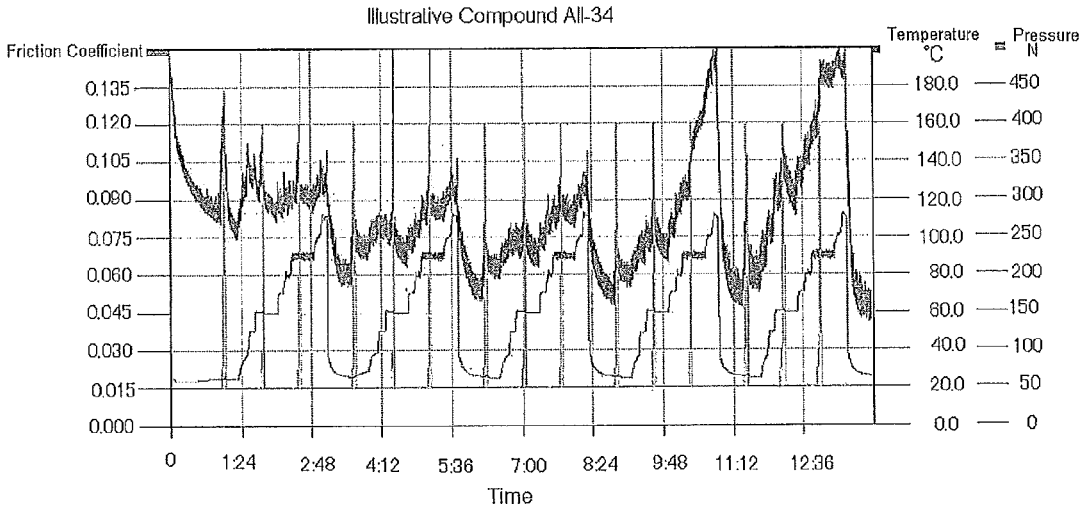

FIG. 11 is a graph showing the results of Test Example 2 of the compositions containing Illustrative Compounds AII-33 and AII-34, respectively.

Figure 12:
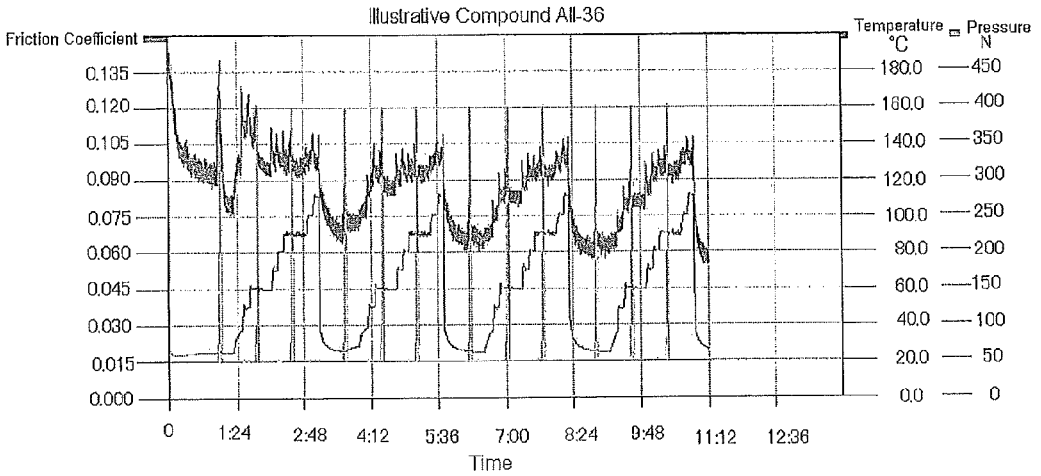
Figure 12:
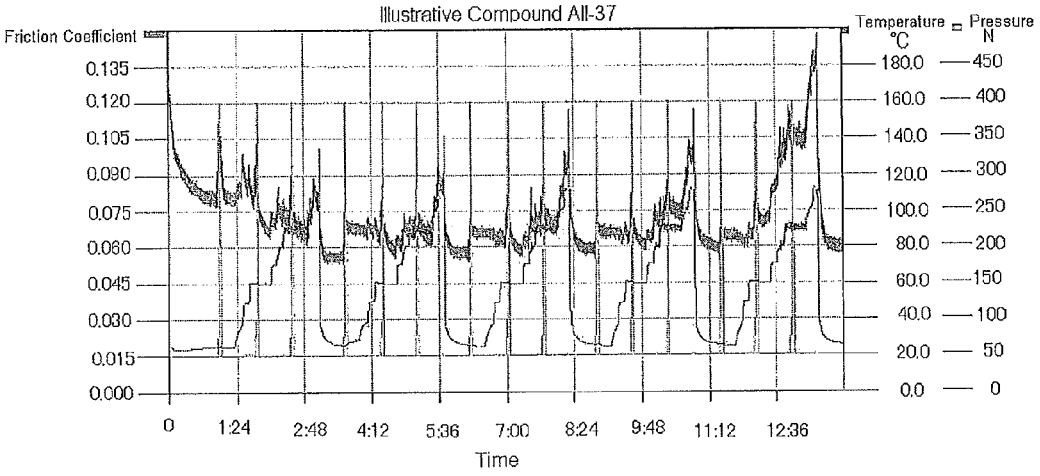

FIG. 12 is a graph showing the results of Test Example 2 of the compositions containing Illustrative Compounds AII-36 and AII-37, respectively.

Figure 13:
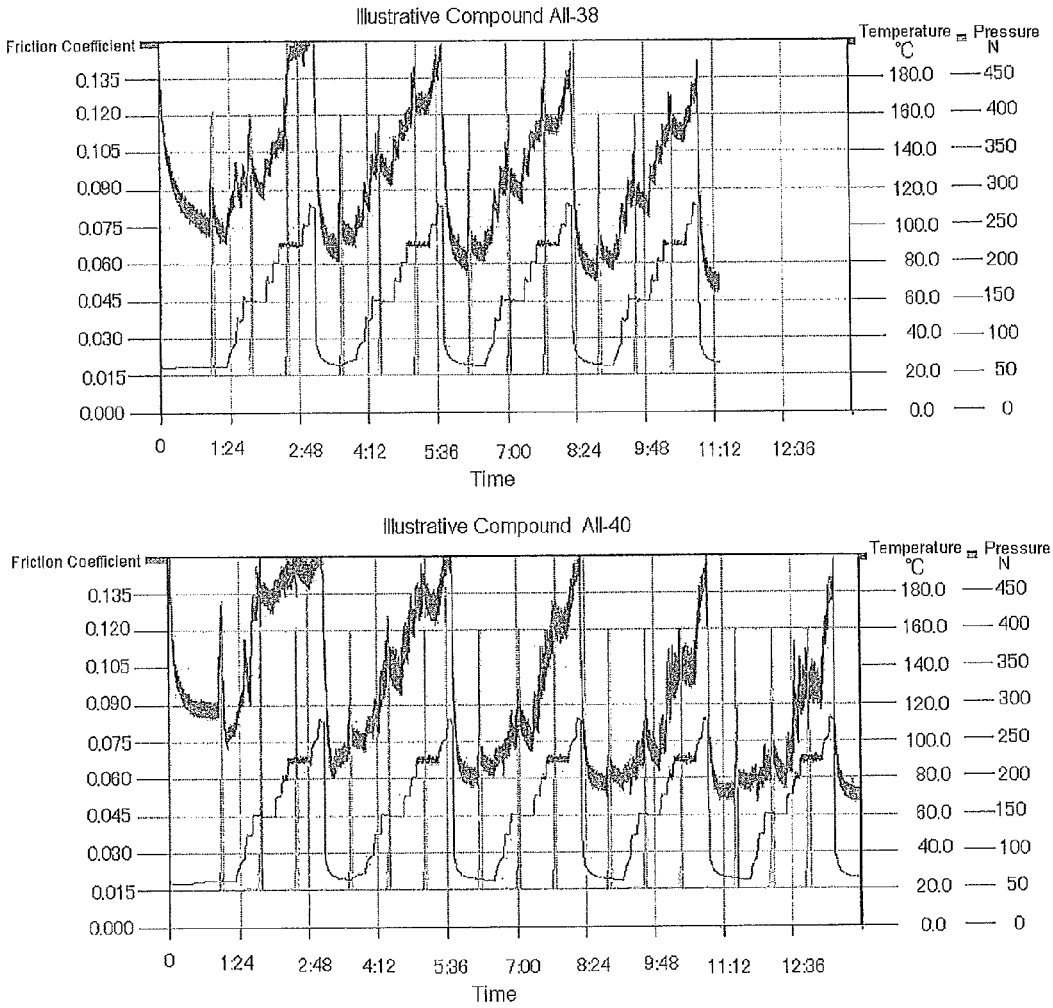

FIG. 13 is a graph showing the results of Test Example 2 of the compositions containing Illustrative Compounds AII-38 and AII-40, respectively.

Figure 14:
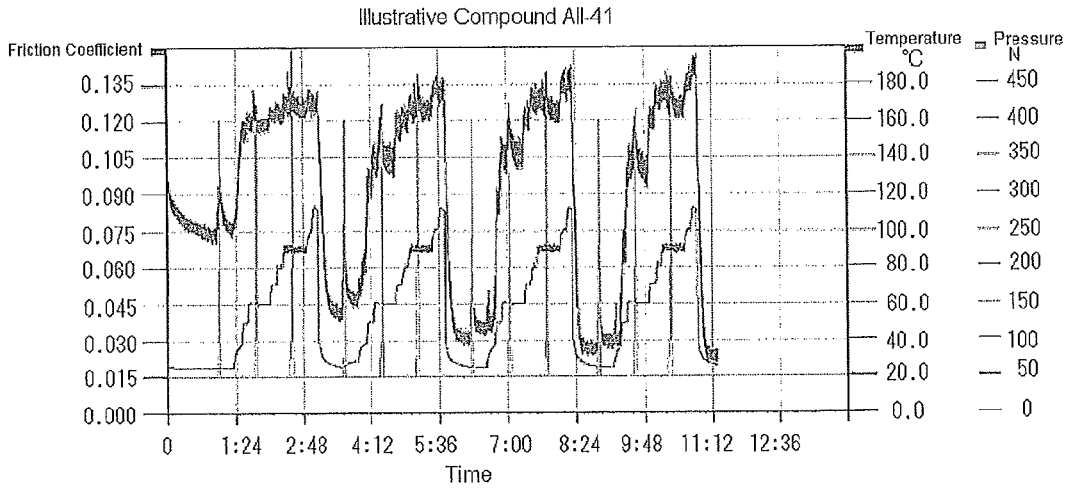
Figure 14:
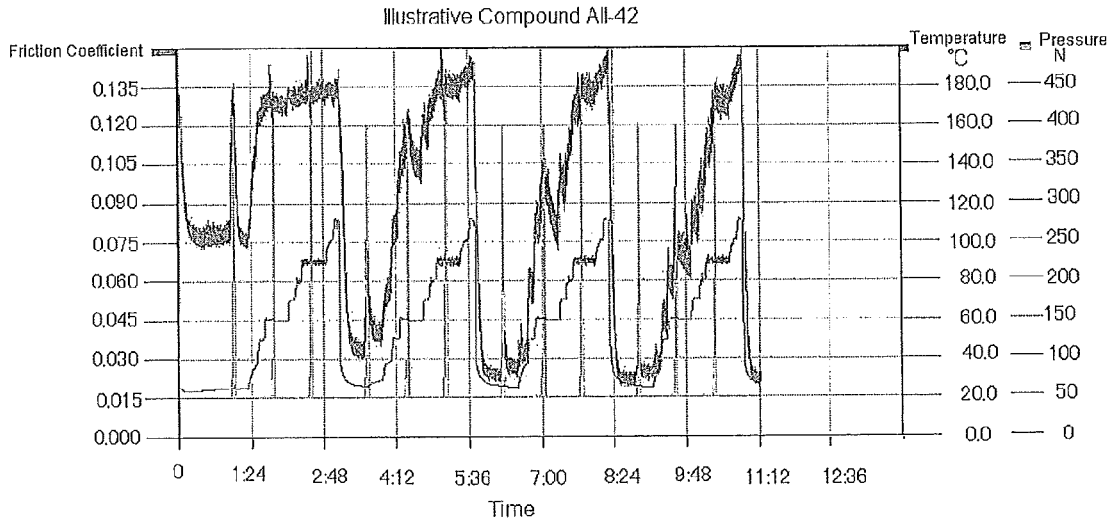

FIG. 14 is a graph showing the results of Test Example 2 of the compositions containing Illustrative Compounds AII-41 and AII-42, respectively.

Figure 15:
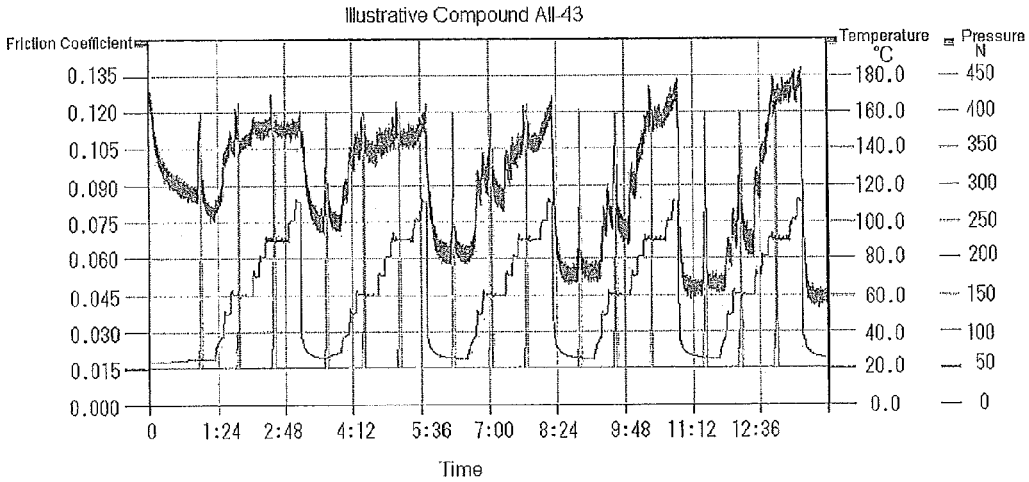

FIG. 15 is a graph showing the results of Test Example 2 of the composition containing Illustrative Compounds AII-43.

Figure 16:
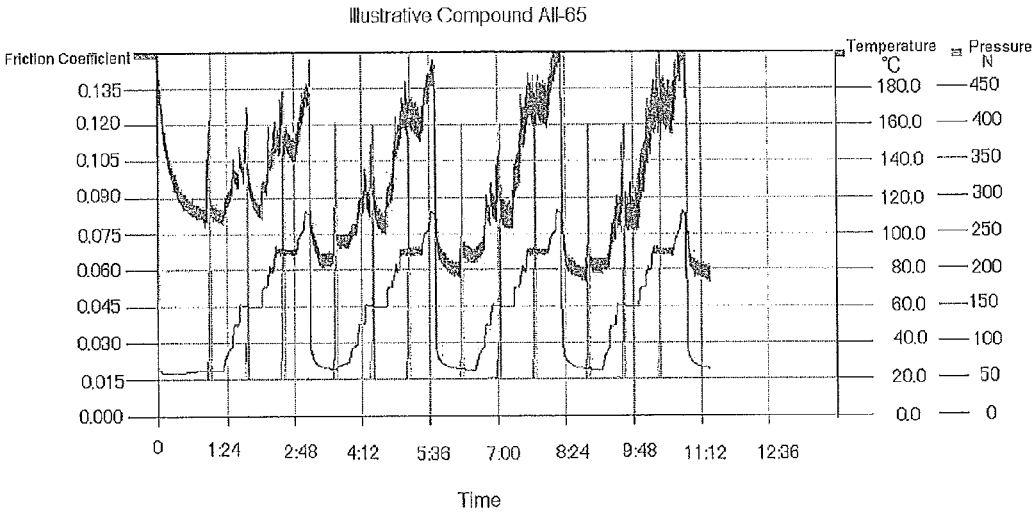

FIG. 16 is a graph showing the results of Test Example 2 of the composition containing Illustrative Compounds AII-65.

Figure 17:
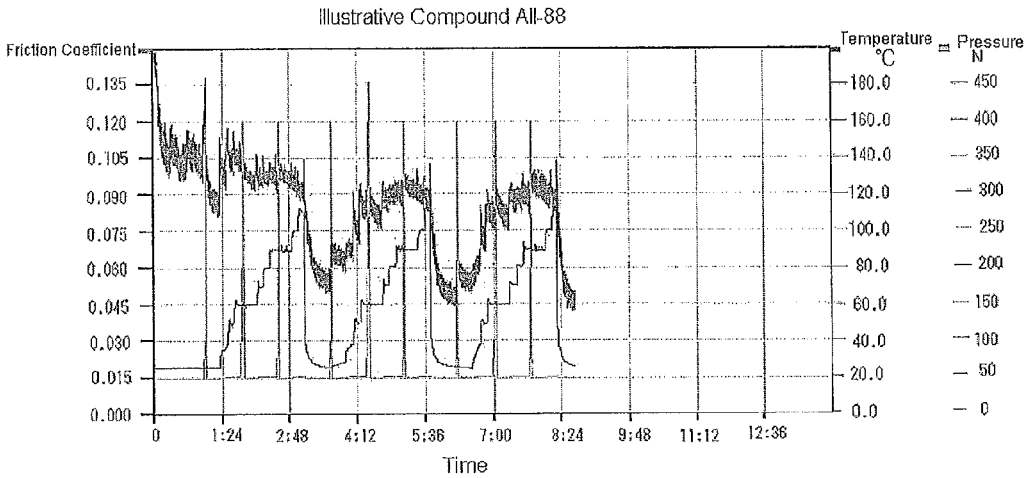
Figure 17:
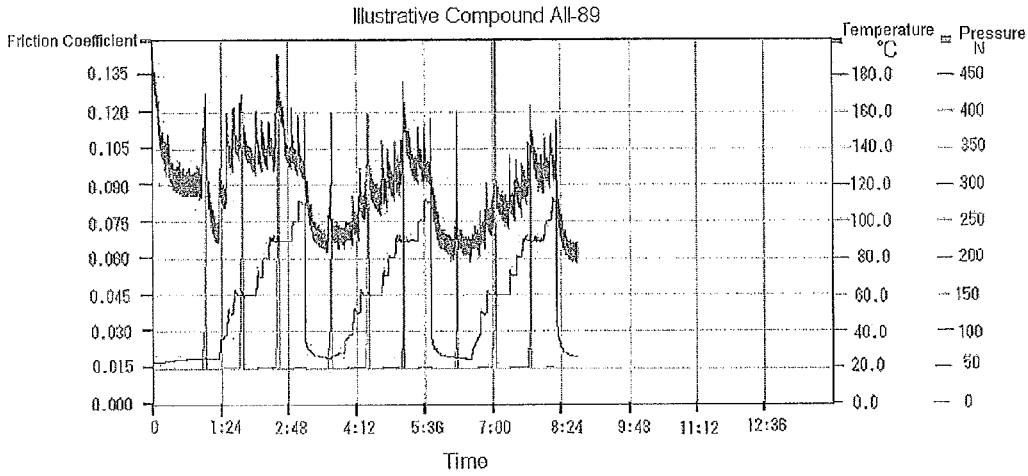

FIG. 17 is a graph showing the results of Test Example 2 of the compositions containing Illustrative Compounds AII-88 and AII-89, respectively.

Figure 18:
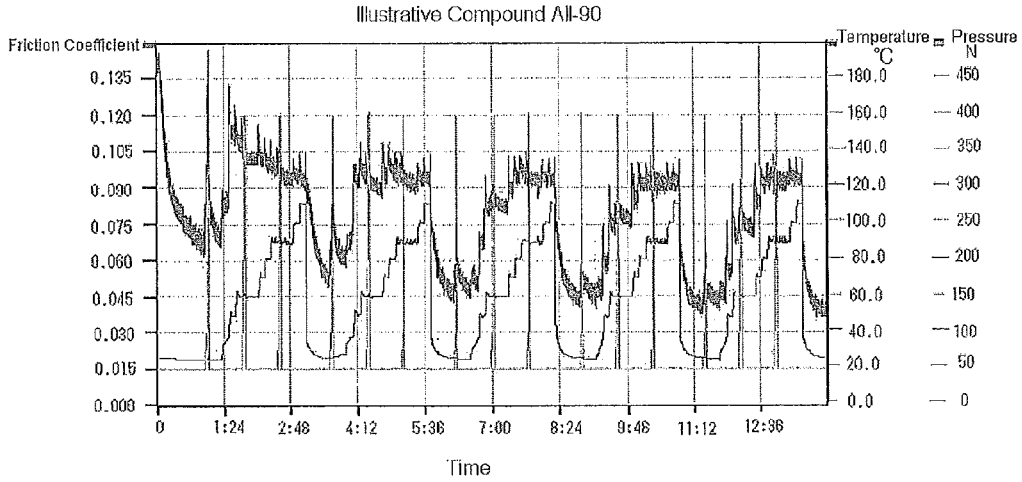

FIG. 18 is a graph showing the results of Test Example 2 of the composition containing Illustrative Compounds AII-90.

Figure 19:
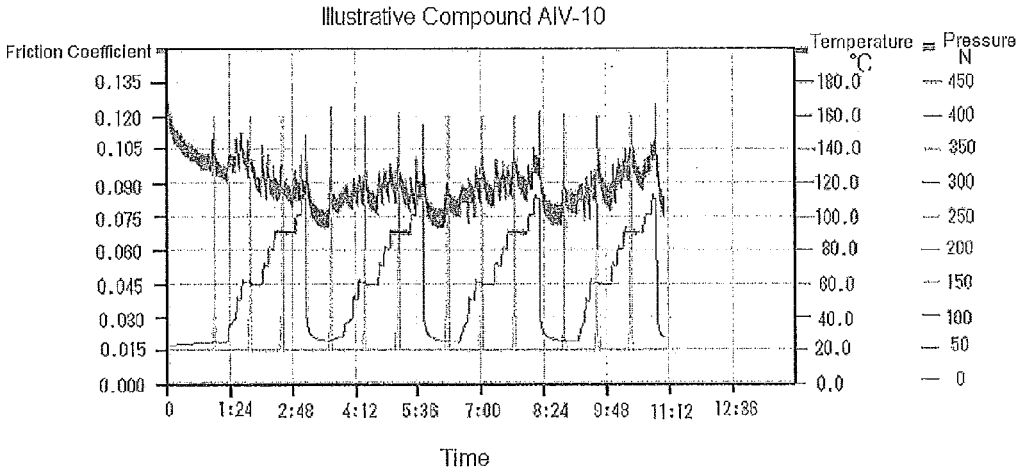

FIG. 19 is a graph showing the results of Test Example 2 of the composition containing Illustrative Compounds AIV-10.

Figure 20:
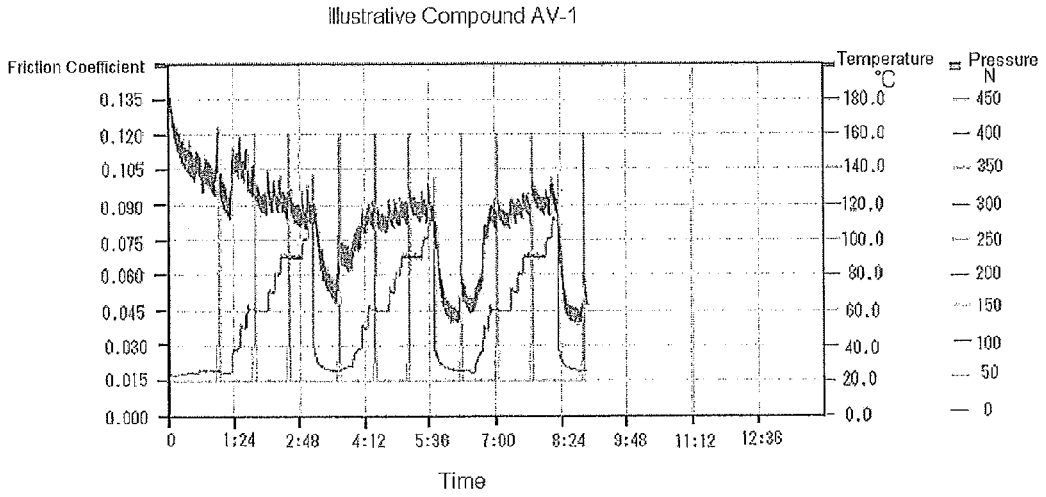

FIG. 20 is a graph showing the results of Test Example 2 of the composition containing Illustrative Compounds AV-1.

Figure 21:
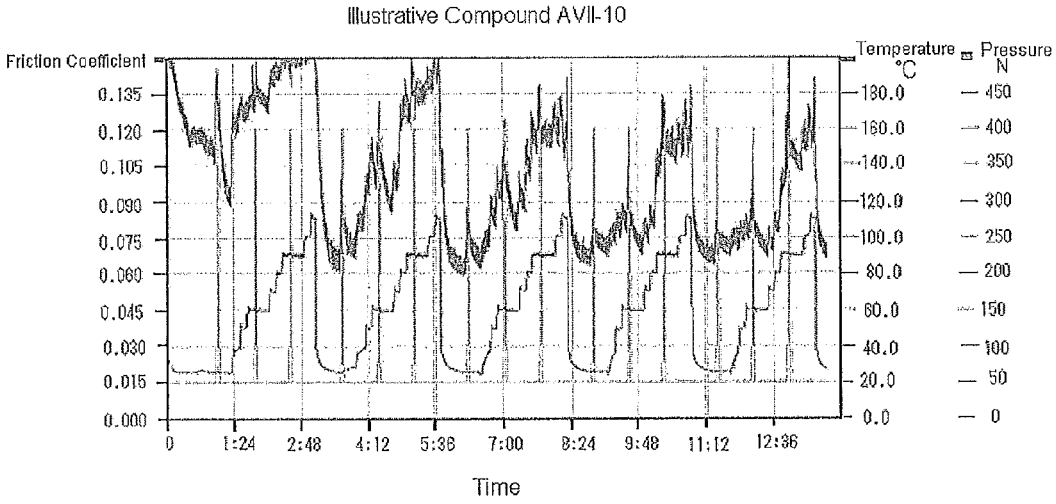

FIG. 21 is a graph showing the results of Test Example 2 of the composition containing Illustrative Compounds AVII-10.

Figure 22:
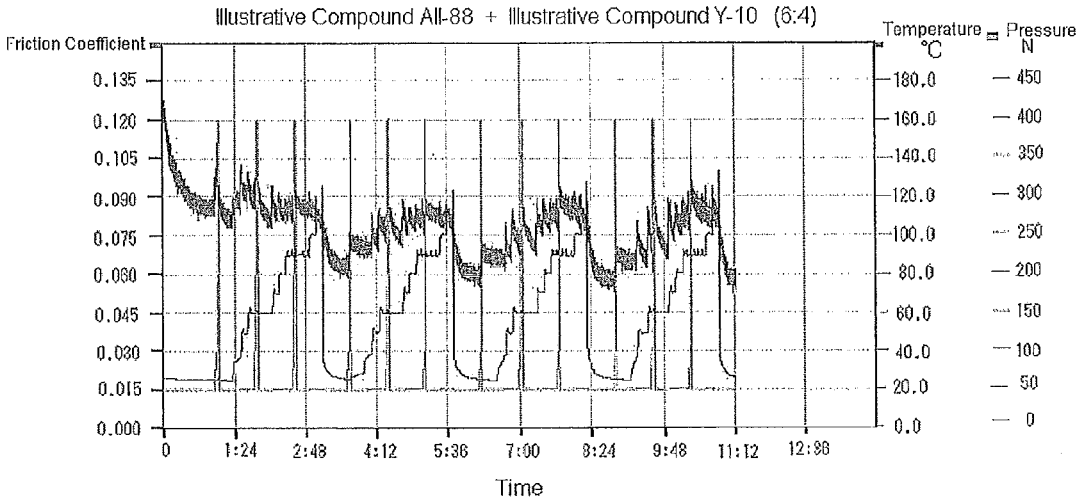

FIG. 22 is a graph showing the results of Test Example 2 of the composition containing both Illustrative Compound AII-88 and Illustrative Compound Y-1.

Figure 23:
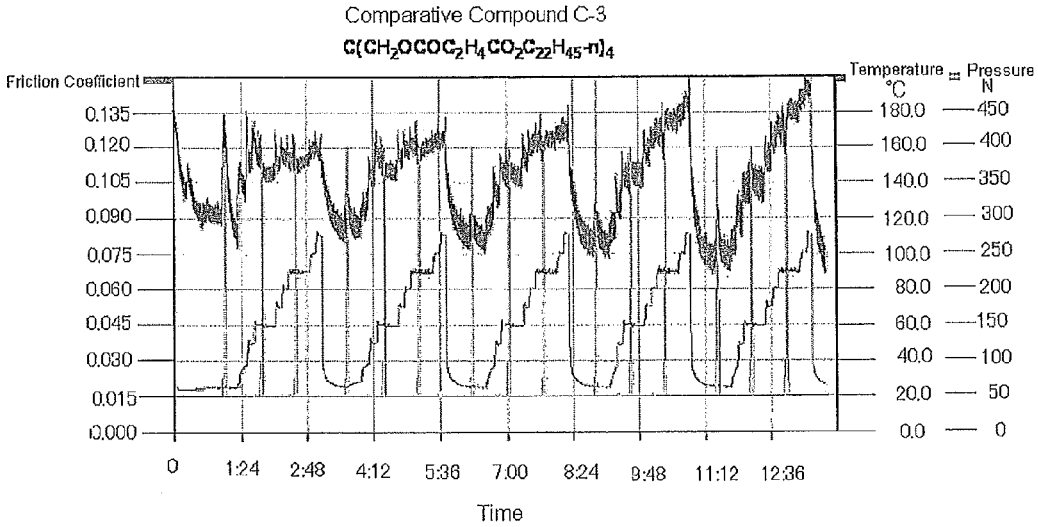
Figure 23:
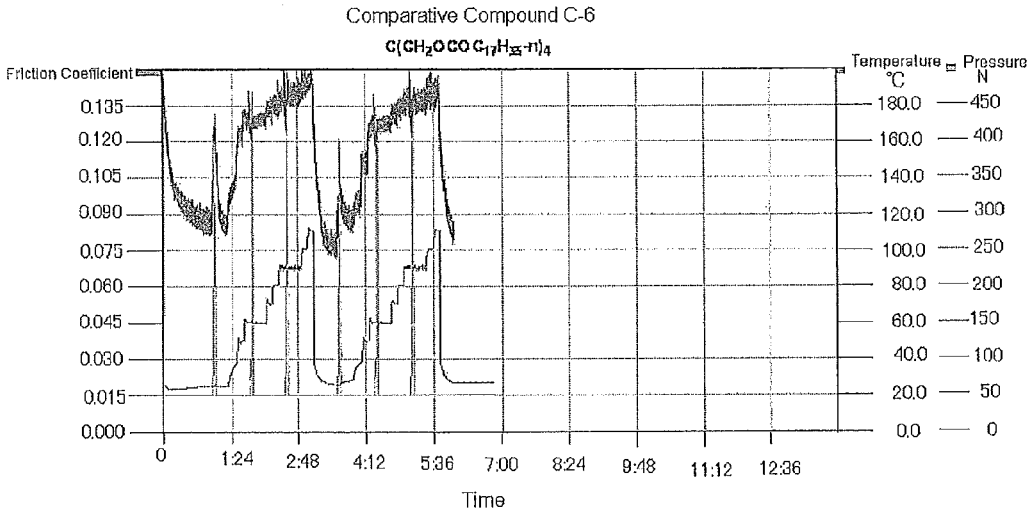

FIG. 23 is a graph showing the results of Test Example 2 of the compositions containing Comparative Compounds C-3 and C-6, respectively.

Figure 24:
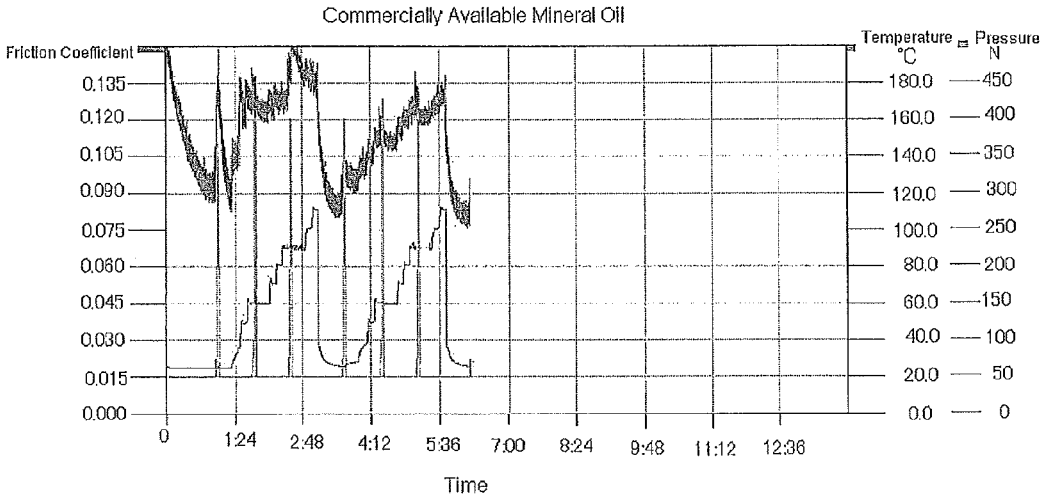

FIG. 24 is a graph showing the results of Test Example 2 of a commercially available mineral oil.

Figure 25:
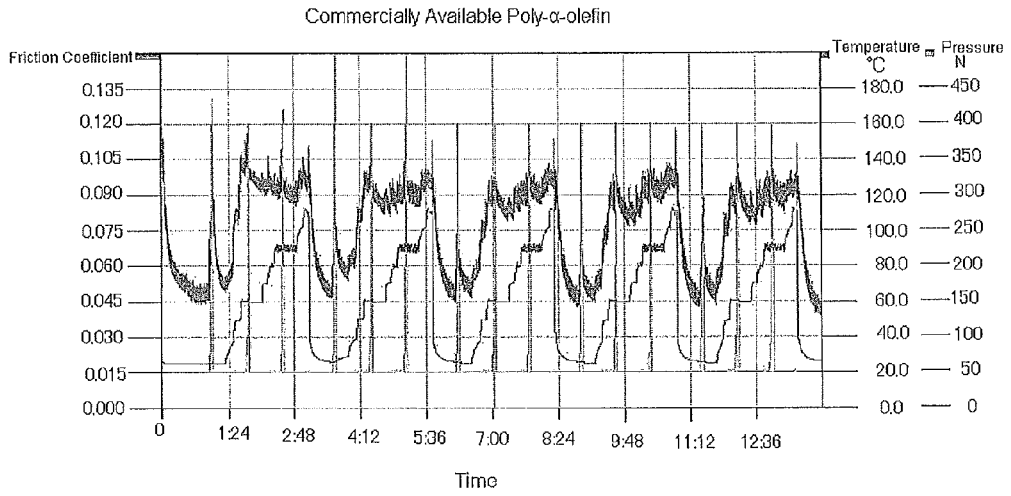
Figure 25:
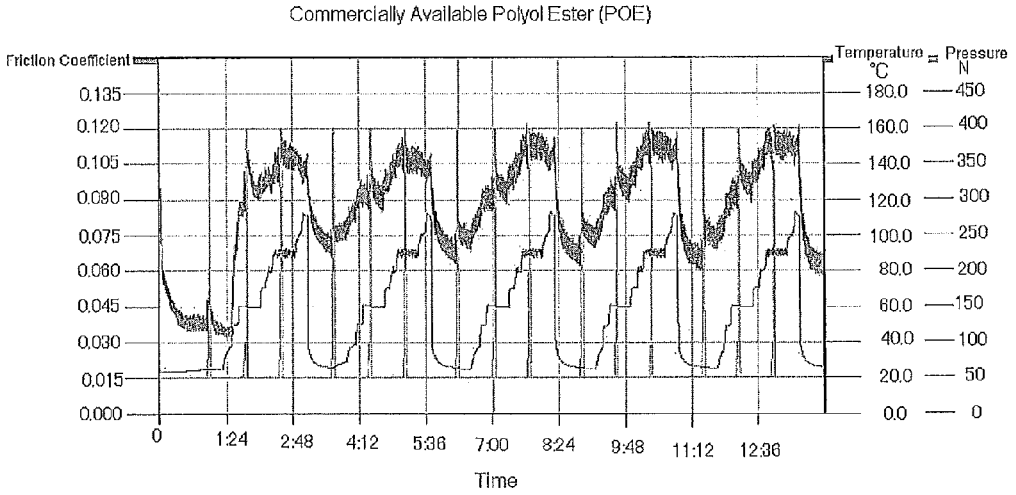

FIG. 25 is a graph showing the results of Text Example 3 of the compositions prepared using Illustrative Compound II-4 and a commercially available poly-α-olefin and a polyol ester, respectively.

Figure 26:
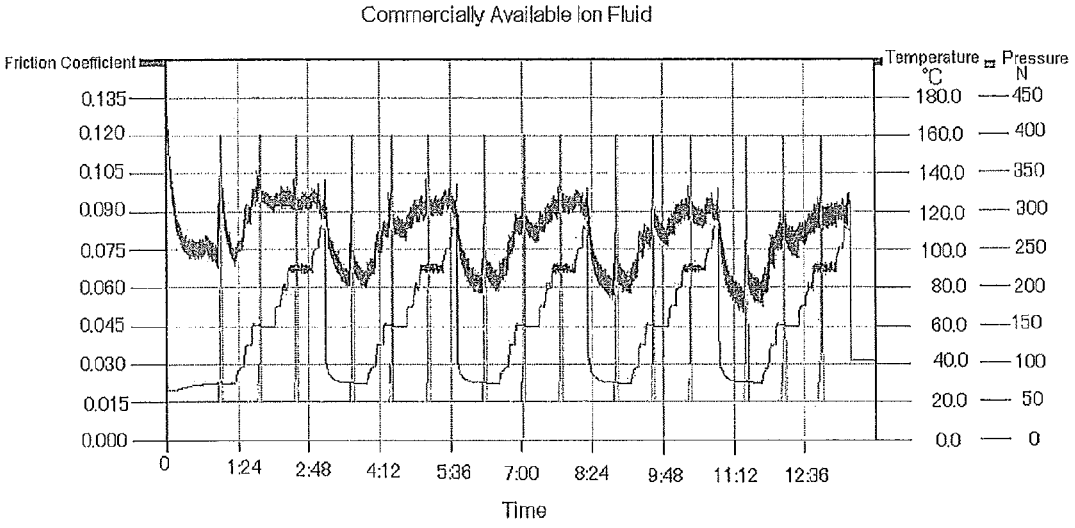
Figure 26:
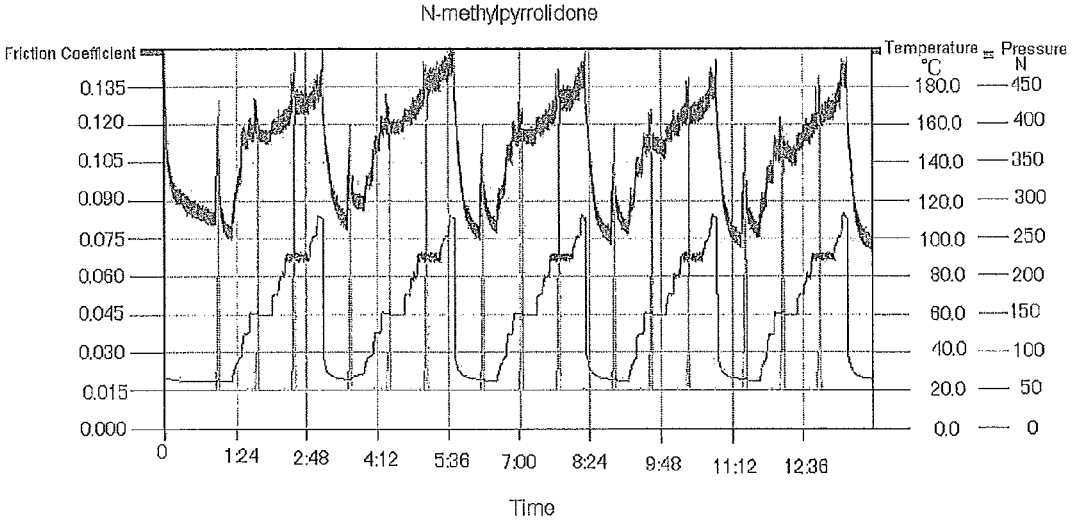

FIG. 26 is a graph showing the results of Text Example 3 of the compositions prepared using Illustrative Compound II-4 and a commercially available ion fluid and N-methylpyrrolidone, respectively.

Figure 27:
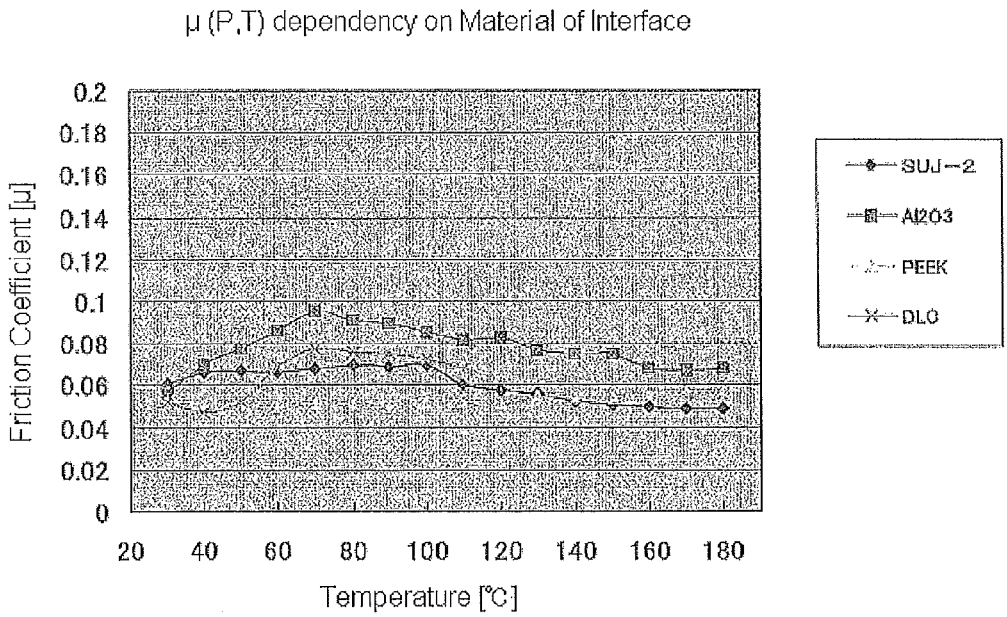

FIG. 27 is a graph showing the results of Test Example 4 of the composition containing Illustrative Compound II-1.

Figure 28:
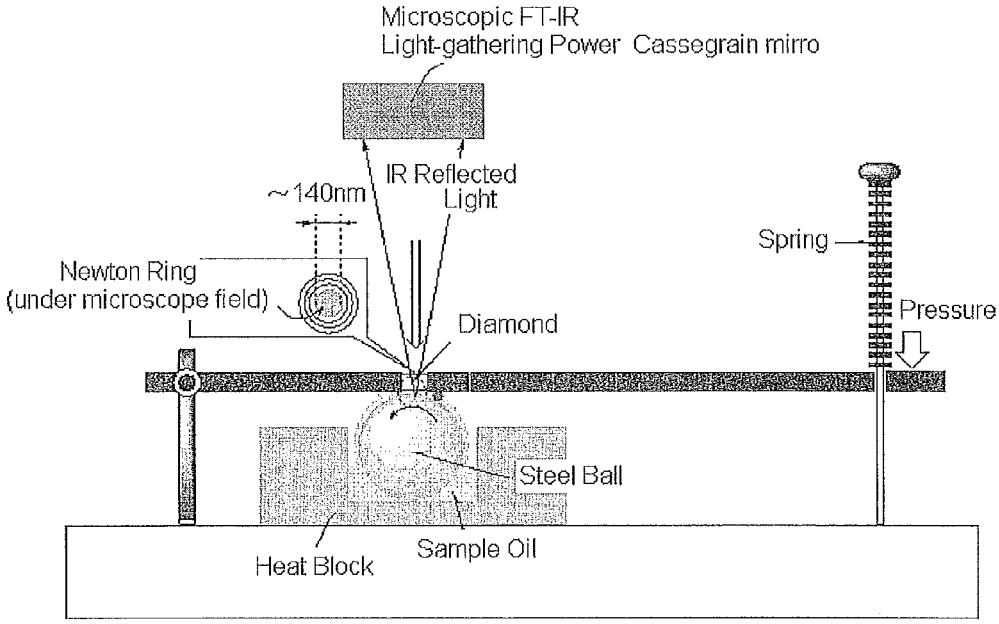

FIG. 28 is a diagrammatic view of the apparatus used in Test Example 5.

Figure 29:
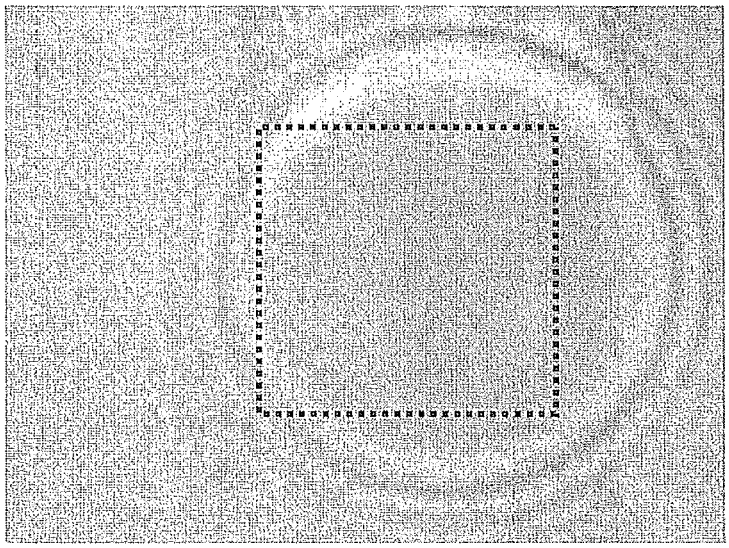

FIG. 29 is a microscopic photograph of the Newtonian ring observed in Test Example 5.

Figure 30:
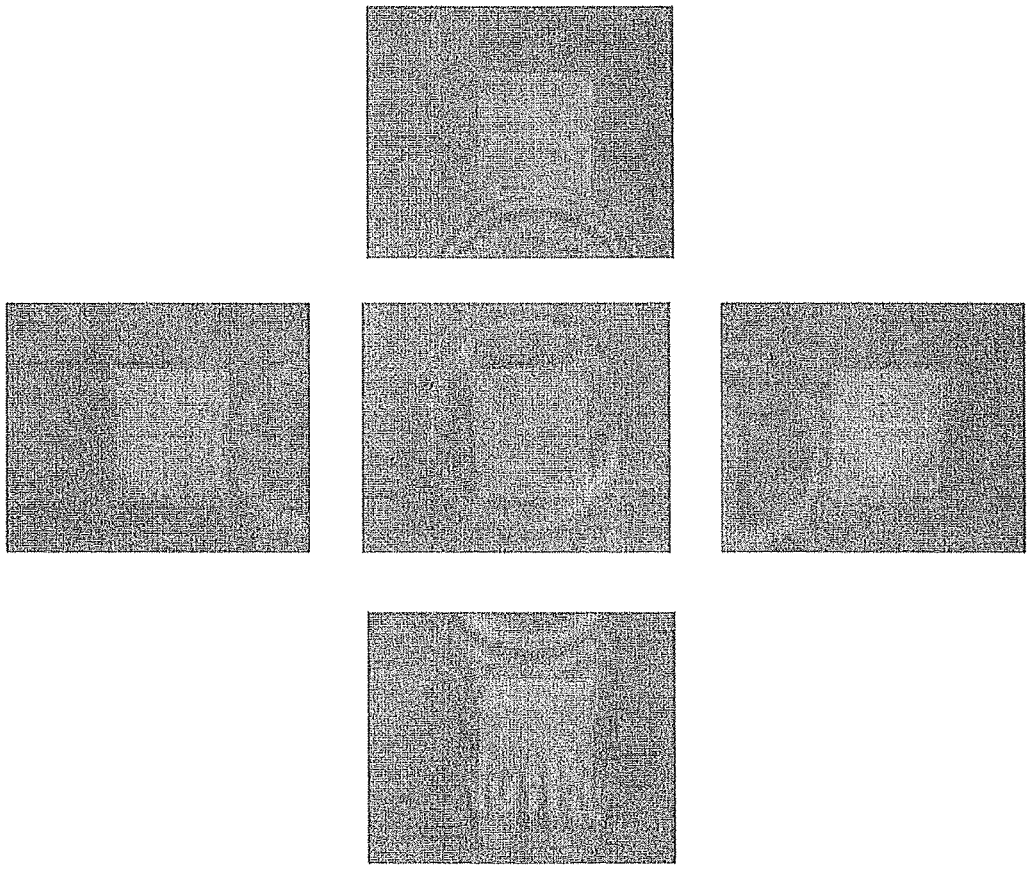
FIG. 30 is a figure showing a portion wherein a Newtonian ring is formed upon point contact, a portion where a sample flows thereinto, and right and left portions thereof.

FIG. 30 is a microscopic photograph of the Newtonian ring observed in Test Example 5.

Figure 31:
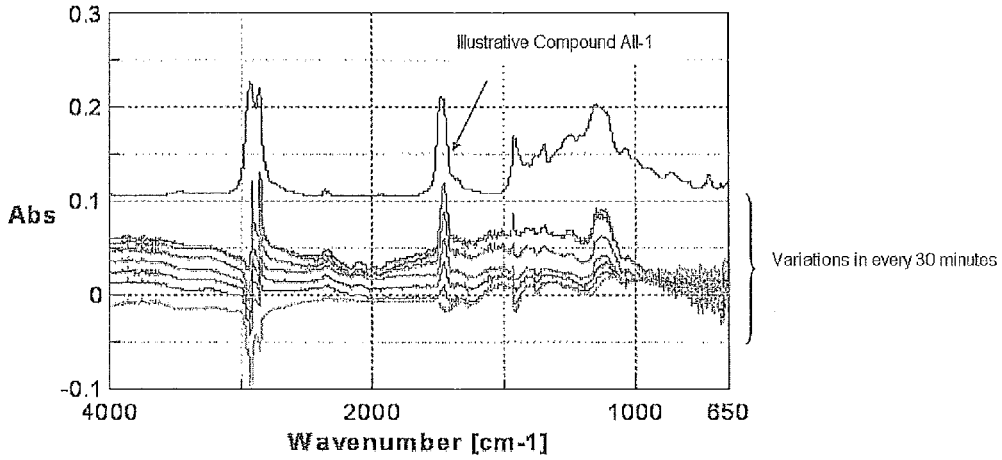
FIG. 31 is an IR spectrum thereof. From the results shown in FIG. 31, it can be understood that a stretching vibration band of a carbonyl group at 1,750 $cm^{-1}$ and a stretching vibration band of ester C—O at 1,120 $cm^{-1}$ increase with time.

FIG. 31 is an IR spectrum measured in Test Example 5.

FIG. 32 is a graph showing a fluctuation of an absorbance of an IR spectrum measured in Test Example 5 relative to a temperature change.

FIG. 33 is a graph showing a fluctuation of an absorbance of an IR spectrum measured in Test Example 5 relative to the rotation number change of a steel ball.

The invention claimed is:

1. A composition comprising an oily medium and at least one compound represented by following formula (Z):

$$A\text{-}L\text{-}\{D^1\text{-}(E)_q\text{-}D^2\text{-}(B)_m\text{—}Z^1\text{—}R\}_p \quad (Z)$$

wherein

A represents a p-valent chain or cyclic residue;

L represents a single bond, an oxy group, a substituted or non-substituted oxymethylene group represented by following formula (A-a), or a substituted or nonsubstituted oxyethyleneoxy group represented by following formula (A-b):

$$\text{—(O—C(Alk)}_2\text{)-} \quad (A\text{-}a)$$

$$\text{—(O—C(Alk)}_2\text{C(Alk)}_2\text{O)—} \quad (A\text{-}b)$$

Alk represents a hydrogen atom, a $C_1$-$C_6$ alkyl group or a cycloalkyl group;

p represents an integer of 2 or more;

$D^1$ represents a carbonyl group (—C(═O)—) or a sulfonyl group (—S(═O)$_2$—), and each $D^1$ may be the same as or different from every other $D^1$;

$D^2$ represents a carbonyl group (—C(═O)—), a sulfonyl group (—S(═O)$_2$—), a carboxyl group (—C(═O)O—), a sulfonyloxyl group (—S(═O)$_2$O—), a carbamoyl group (—C(═O)N(Alk)-) or a sulfamoyl group (—S(═O)$_2$N(Alk)-), and each $D^2$ may be the same as or different from every other $D^2$, wherein Alk represents a hydrogen atom, a $C_1$-$C_6$ alkyl group or a cycloalkyl group;

E represents a substituted or nonsubstituted alkylene group, cycloalkylene group, alkenylene group, alkynylene group or arylene group, a divalent heterocyclic aromatic ring group or heterocyclic non-aromatic ring group, a divalent group selected among an imino group, an alkylimino group, an oxy group, a sulfide group, a sulfenyl group, a sulfonyl group, a phosphoryl group and an alkyl-substituted silyl group, or a divalent group composed of a combination of two or more of these groups; q represents an integer of 0 or more; and when q is 2 or more, each E may be the same as or different from every other E;

R represents a substituted or non-substituted $C_8$ or longer alkyl group, a perfluoroalkyl group or a trialkylsilyl group, and each R may be the same as or different from every other R;

B varies depending upon R;

in the case where R represents a substituted or non-substituted $C_8$ or longer alkyl group, B represents a substituted or non-substituted oxyethylene group or a substituted or non-substituted oxypropylene group; plural Bs connecting to each other may be the same as or different from each other; and m represents a natural number of 1 or more;

in the case where R represents a perfluoroalkyl group, B represents an oxyperfluoromethylene group, an oxyperfluoroethylene group or an optionally branched oxyperfluoropropylene group; plural Bs connecting to each other may be the same as or different from each other; and m represents a natural number of 1 or more;

in the case where R represents a trialkylsilyl group, B represents a dialkylsiloxy group in which the alkyl group is selected among a methyl group, an ethyl group and an optionally branched propyl group; each B may be the same as or different from every other B; plural Bs connecting to each other may be the same as or different from each other; and m represents a natural number of 1 or more; and $Z^1$ represents a single bond, a divalent group selected among a carbonyl group, a sulfonyl group, a phosphoryl group, an oxy group, a substituted or non-substituted amino group, a sulfide group, an alkenylene group, an alkynylene group and an arylene group or a divalent group composed of a combination of two or more of these groups.

2. The composition according to claim 1, wherein in the formula (Z), A is a residue of pentaerythritol, glycerol, oligopentaerythritol, xylitol, sorbitol, inositol, trimethylolpropane, ditrimethylpropane, neopentyl glycol or polyglycerin.

3. The composition according to claim 1, wherein in formula (Z), A is a group represented by any of following formulae (AI) to (AIII):

(AI)

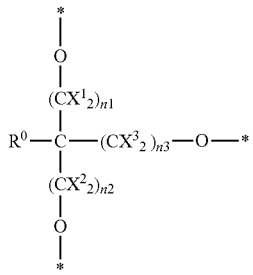

(AII)

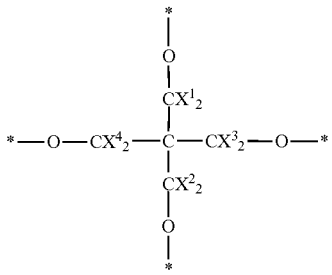

(AIII)

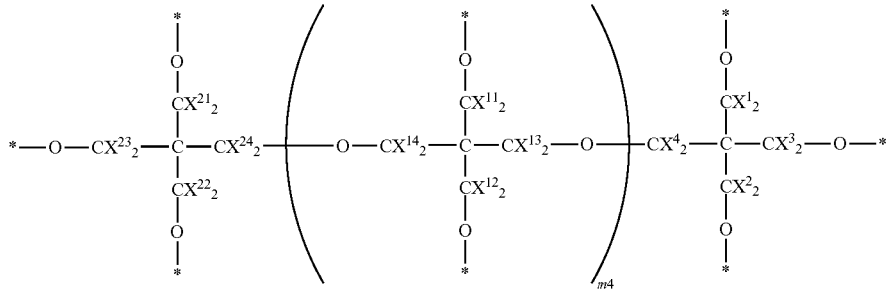

wherein

* means a bonding site to -L-$D^1$-$(E)_q$-$D^2$-$(B)_m$—$Z^1$—R; C represents a carbon atom; $R^0$ represents a hydrogen atom or a substituent; each of $X^1$ to $X^4$, $X^{11}$ to $X^{14}$ and $X^{21}$ to $X^{24}$ represents a hydrogen atom or a halogen atom and may be the same as or different from every other; each of n1 to n3 represents an integer of from 0 to 5; and m4 represents an integer of from 0 to 2.

4. The composition according to claim 1, wherein in formula (Z), A is a residue of a polymer or an oligomer represented by any of following (AIV) to (AVIII):

(AIV)

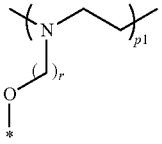

-continued (AV)

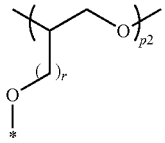

(AVI)

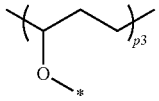

-continued (AVII)

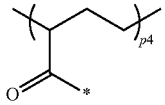

(AVIII)

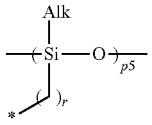

wherein

* means a bonding site to -L-$D^1$-$(E)_q$-$D^2$-$(B)_m$—$Z^1$—R; each of hydrogen atoms bonded to the respective carbon atoms in the formulae may be substituted with a $C_1$-$C_4$ alkyl group or a halogen atoms; in the case where two or more substituents are present, each of them may be the same as or different from every other; Alk represents a hydrogen atom, a $C_1$-$C_6$ alkyl group or a cycloalkyl group; each of p1 to p5 represents a number of 2 or more; and r represents an integer of from 1 to 3.

5. The composition according to claim 1, wherein in formula (Z), A is a residue of dithiocarbamic acid or dithiophosphoric acid ionically bonded or coordinate bonded to zinc or molybdenum.

6. The composition according to claim 1, containing at least one compound represented by following formula (Y) together with the at least one compound represented by formula (Z):

$$R—Z^1—(B)_m\text{-}D^1\text{-}(E)_q\text{-}D^2\text{-}(B)_m—Z^1—R \quad (Y)$$

wherein the symbols are synonymous with those in the formula (Z) according to claim 1, respectively.

7. The composition according to claim 1, wherein in the formula (Z), each $—(B)_m—Z^1—R$ is a group represented by following formula (ECa), and each $—(B)_mZ^1—R$ may be the same as or different from every other $—(B)_m—Z^1—R$:

$$\left(CX^{a1}X^{a2})_{na1}O\right)_{na2}—L^a—R^a \quad (ECa)$$

wherein in the formula (ECa), C represents a carbon atom; O represents an oxygen atom; $R^a$ corresponding to R in the formula (Z) represents a substituted or non-substituted $C_8$ or longer alkyl group; $L^a$ corresponding to $Z^1$ in the formula (Z) represents a single bond or a divalent connecting group; each of $X^{a1}$ and $X^{a2}$ represents a hydrogen atom or a halogen atom; na1 represents an integer of from 1 to 4; when na1 is 2 or more, plural $X^{a1}$s and $X^{a2}$s may be the same as or different from each other; and na2 represents a number of from 1 to 35.

8. The composition according to claim 7, wherein in formula (Z) or formula (Y), $L^a$ corresponding to $Z^1$ is a single bond or a divalent connecting group composed of a combination of one or more members selected among a carbonyl group, a sulfonyl group, a phosphoryl group, an oxy group, a substituted or non-substituted amino group, a thio group, an alkylene group, an alkenylene group, an alkynylene group and an arylene group.

9. The composition according to claim 1, wherein in formula (Z), each $—(B)_m—Z^1—R$ is a group represented by following formula (ECb), and each $—(B)_m—Z^1—R$ may be the same as or different from every other $—(B)_m—Z^1—R$:

$$\left(CX^{a1}X^{a2})_{na1}O\right)_{na2}—(C_nF_{2n}O)_{nc}—L^{a1}—C_mF_{2m+1} \quad (ECb)$$

wherein in the formula (ECb), C represents a carbon atom; O represents an oxygen atom; each of $X^{a1}$ and $X^{a2}$ represents a hydrogen atom or a halogen atom; na1 represents an integer of from 1 to 4; when na1 is 2 or more, plural $X^{a1}$s and $X^{a2}$s may be the same as or different from each other; $L^{a1}$ corresponding to $Z^1$ in the formula (Z) represents a single bond; na2 represents a number of from 0 to 2; nc represents a number of from 1 to 10; m represents a number of from 1 to 12; and n represents a number of from 1 to 3.

10. The composition according to claim 1, wherein in formula (Z), each $—(B)_m—Z^1—R$ is a group represented by following formula (ECc), and each $—(B)_m—Z^1—R$ may be the same as or different from every other $—(B)_m—Z^1—R$:

$$—(Si(Alk')_2O)_{nb}—L^{a1}—Si(Alk')_3 \quad (ECc)$$

wherein in formula (ECc), each Alk' may be the same as or different from every other Alk' and represents a $C_1$-$C_4$ alkyl group; $L^{a1}$ corresponding to $Z^1$ in the formula (Z) represents a single bond; and nb represents a number of from 1 to 10.

11. The composition according to claim 1, wherein in formula (Z), R is a group including a linear $C_{12}$ or longer alkyl group.

12. The composition according to claim 1, wherein in the formula (Z), m of $(B)_m$ is from 7 to 12.

13. The composition according to claim 1, wherein the compound represented by the formula (Z) has a viscosity-pressure modulus at 40° C. of not more than 15 $GPa^{-1}$.

14. The composition according to claim 1, wherein the oily medium is a mineral oil, a poly-α-olefin, a polyol ester, (poly) phenyl ether, an ion fluid, a silicone oil or a fluorocarbon oil, or a mixture of two or more kinds selected among these materials.

15. The composition according to claim 1, wherein each of constituent elements of all of the components is only one or more members selected among carbon, hydrogen, oxygen and nitrogen.

16. The composition according to claim 1, wherein the compound represented by formula (Z) is a liquid crystalline compound.

17. The composition according to claim 1, having a viscosity at 40° C. of not more than 30 mPa·s.

18. The composition according to claim 1, wherein the compound represented by formula (Z) is a compound satisfying the following conditions (A) and (B):

(A) an average value of particle sizes of the compound dispersed in an oily medium at room temperature and measured by a dynamic light scattering method is not more than 1 μm, the compound is dispersed in a state close to a monodispersed state, and its clearing point is not higher than 55° C.; and (B) a melting point is not higher than 70° C.

19. The composition according to claim 1, wherein the compound represented by the formula (Z) is at least dispersed in the oily medium and satisfies the following condition (C):

(C) when passing through a gap between a steel ball having a diameter of 2 cm and a diamond plate and under a pressure of 100 MPa at a rate of 0.1 m/sec or more, a maximum optical density of an infrared absorption in a portion of 160 microns in square far from a center of a formed Newtonian ring by 300 μm is increased by 0.05 or more.

20. The composition according to claim 1, wherein the oily medium is an oily medium composed of at least one member selected among a mineral oil, a poly-α-olefin, a synthetic ester oil, a diphenyl ether oil, a fluorocarbon oil and a silicone oil.

21. The composition according to claim 1, further containing at least one member selected among an organic zinc compound, a molybdenum compound, an organic phosphorus compound and an organic sulfur compound.

22. A process of using the composition according to claim 1 for lubrication comprising disposing the composition on a sliding interface of inorganic materials or porous materials thereof, or resins or porous materials thereof.

23. The composition according to claim 1, which is a mold release agent.

24. The composition according to claim 1, wherein the oily medium is a fuel for combustion engine.

25. The composition according to claim 1, wherein the oily medium is an engine oil for internal combustion engine.

26. The composition according to claim 1, which is a bearing oil.

27. The composition according to claim 1, which is a grease oil.

28. The composition according to claim 1, which is a cutting oil.

29. A method for forming a coating film comprising disposing the composition according to claim 1 between two surfaces, and sliding the two surfaces, thereby forming a coating film composed of the composition on at least one of the surfaces.

* * * * *